US006328008B1

(12) United States Patent
Io

(10) Patent No.: US 6,328,008 B1
(45) Date of Patent: Dec. 11, 2001

(54) VALVE TIMING CONTROL SYSTEM FOR INTERNAL COMBUSTION ENGINE

(75) Inventor: Shinichi Io, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/631,787

(22) Filed: Aug. 3, 2000

(30) Foreign Application Priority Data

Aug. 3, 1999 (JP) ..... 11-220510
Oct. 6, 1999 (JP) ..... 11-286123

(51) Int. Cl.[7] ..... F01L 1/34
(52) U.S. Cl. ..... 123/90.17; 74/568 R
(58) Field of Search ..... 123/90.15, 90.17, 123/90.31; 74/568 R

(56) References Cited

U.S. PATENT DOCUMENTS 4,771,742 * 9/1988 Nelson et al. ..... 123/90.17
5,172,662 * 12/1992 Hampton ..... 123/90.17
5,174,253 * 12/1992 Yamazaki et al. ..... 123/90.17
5,203,291 * 4/1993 Suga et al. ..... 123/90.17
5,305,719 * 4/1994 Clarke et al. ..... 123/90.17
5,381,764 * 1/1995 Fukuma et al. ..... 123/90.17
5,680,836 * 10/1997 Pierik ..... 123/90.17
6,129,061 * 10/2000 Okuda et al. ..... 123/90.17

FOREIGN PATENT DOCUMENTS 5-1514 1/1993 (JP) .
6-10977 1/1994 (JP) .
6-66328 3/1994 (JP) .
7-91459 4/1995 (JP) .
7-332385 12/1995 (JP) .
9-250309 9/1997 (JP) .

* cited by examiner

*Primary Examiner*—Weilun Lo
(74) *Attorney, Agent, or Firm*—Foley & Lardner

(57) ABSTRACT

A valve timing control system includes; a rotor rotated by a crankshaft of the internal combustion engine; a camshaft rotated according to the rotation of the rotor to open and close an intake valve and an exhaust valve of the internal combustion engine; and a rotational phase controller for variably controlling a rotational phase of the camshaft relative to the rotor. The rotational phase controller is disposed between the rotor and the camshaft. The rotational phase controller includes; a clutch selectably put in one of a holding state for forbidding a relative rotation between the rotor and the camshaft in at least one of rotational directions and a releasing state for allowing the relative rotation; and a generator for generating a holding toque directing to the rotational direction forbidden by the clutch and applying the holding torque to the clutch when the clutch is put in the holding state.

22 Claims, 30 Drawing Sheets

VALVE TIMING CONTROL SYSTEM FOR INTERNAL COMBUSTION ENGINE

BACKGROUND OF THE INVENTION

1. Field of the Invention

The present invention relates to a valve timing control system for varying valve timing of intake and exhaust valves of an internal combustion engine for a motor vehicle according to a vehicle driving condition.

2. Description of the Related Art

Various valve timing control systems have been proposed and in practical use for the purpose of further improving performance of internal combustion engines. Japanese Patent Unexamined Publication No. 5(1993)-1514 discloses a typical valve timing control system which employs a pair of spring clutches and a selector for switching operation of the spring clutches. This conventional valve timing system is arranged to vary the valve timing by controlling a phase varying device installed between a sprocket and a camshaft. The phase varying device for preferably varying the valve timing into an advanced state or retarded state as shown in FIG. 30 has a pair of spring clutches coaxial with the camshaft and a clutch switching mechanism for controlling holding states of the spring clutches.

Japanese Patent Unexamined Publication No. 9(1997)-250309 discloses another conventional valve timing control system which comprises a rotational phase controlling device constituted by a solenoid clutch and a sun-and-planet gear set. This conventional valve timing control system keeps a stationary holding state between a sprocket and a camshaft by applying a biasing force of a plate spring to the solenoid clutch.

SUMMARY OF THE INVENTION

Although the former conventional system has many outstanding features such as a simplicity of overall constitution, a small size and a light weight, it is yet required to further stably keep the holding state between the sprocket and the camshaft against alternating torque applied from the engine valves to the camshaft. On the other hand, although the latter conventional system can ensure a sufficient holding force by increasing the biasing force of the plate spring, this change of the plate spring requires the solenoid clutch to generate a larger force against the increased biasing force of the plate spring. However, this improvement requires the latter system to become larger in size.

It is, therefore, an object of the present invention to provide an improved valve timing control system for an internal combustion engine which preferably executes the holding of a rotational phase of the camshaft to the sprocket by stabilizing holding condition by means of a clutch and preventing the alternating torque from decreasing the clutch's tightening force.

There is provided a valve timing control system for an internal combustion engine according to the present invention. This valve timing control system comprises; a rotor rotated by a crankshaft of the internal combustion engine; a camshaft rotated according to the rotation of the rotor to open and close an intake valve and an exhaust valve of the internal combustion engine; and a rotational phase controller for variably controlling a rotational phase of the camshaft relative to the rotor. The rotational phase controller is disposed between the rotor and the camshaft. The rotational phase controller comprises; a clutch selectably put in one of a holding state for forbidding a relative rotation between the rotor and the camshaft in at least one of rotational directions and a releasing state for allowing the relative rotation; and a generator for generating a holding toque directing to the rotational direction forbidden by the clutch and applying the holding torque to the clutch when the clutch is put in the holding state.

The other objects and features of this invention will become understood from the following description with reference to the accompanying drawings.

DETAILED DESCRIPTION OF THE EMBODIMENT

As is seen in FIGS. 1 through 31, there is provided a valve timing control system for an internal combustion engine, according to preferred embodiments of the present invention.

FIGS. 1 through 6 show the valve timing control system, according to a first embodiment of the present invention.

A driven sprocket 1 acting as a rotor is connected to a crank shaft (not shown) of the internal combustion engine via a timing belt (not shown). The driven sprocket 1 is rotated by the crankshaft in a direction A (clockwise) in FIG. 2 around a camshaft 2.

Figure 2:
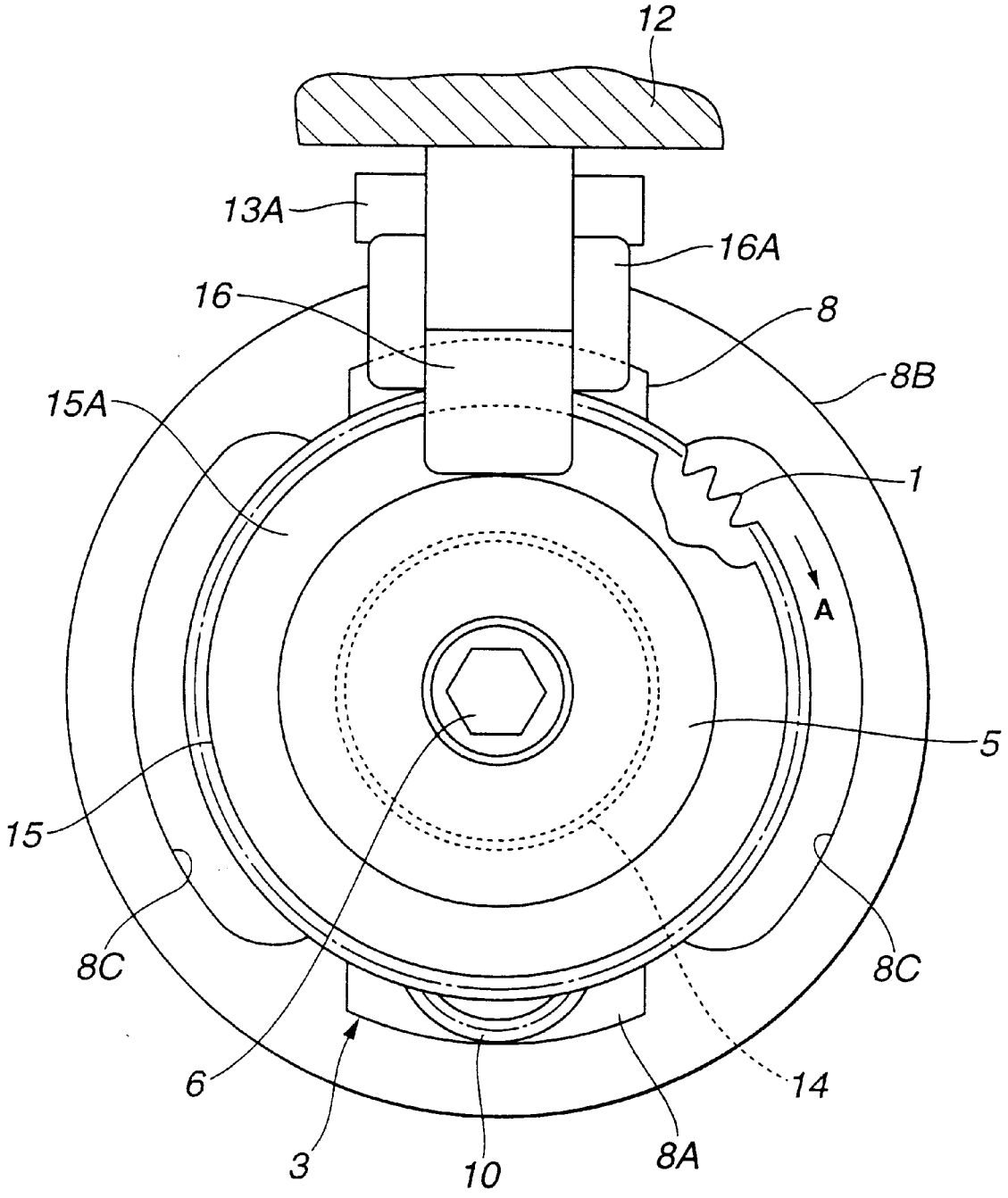
FIG. 2 is a partly cross sectional side view of the valve timing control system taken in the direction of arrow substantially along the line II—II of FIG. 1.

The camshaft 2 is rotatably disposed on a cylinder head (not shown) of the internal combustion engine. In accordance with the rotation of the driven sprocket 1, the camshaft 2 is also rotated in the direction A in FIG. 2. The camshaft 2 acts to open and close either one of or both of intake valve and exhaust valves (not shown) of the internal combustion engine. The camshaft 2 has a small diameter portion 2A and an external gear 7. The small diameter portion 2A is located at an endmost portion of the camshaft 2 as shown in FIG. 2. Around an outer periphery of the small diameter portion 2A, there are rotatably disposed an input gear member 4 and a carrier 8.

A sun-and-planet gear set 3 is disposed between the driven sprocket 1 and the camshaft 2. The sun-and-planet gear set 3 acts as a rotational phase controller for variably controlling rotational phases. The sun-and-planet gear set 3 also acts as a holding force generator for a spring clutch 14. The sun-and-planet gear set 3 is constituted by an input gear member 4, an output drum 5, a carrier 8, a pair of first planet gears 10 and a pair of second planet gears 11.

The input gear member 4 acts as a first rotary member of the sun-and-planet gear set 3. The input gear member 4 has a stepped cylinder. The input gear member 4 is rotatably disposed, via bearings, around the outer periphery of the small diameter portion 2A of the camshaft 2. A flange 4A circular in shape projects from an outer periphery of the input gear member 4. The driven sprocket 1 is fixed to the flange 4A with bolts. Therefore, the input gear member 4 rotates integrally with the driven sprocket 1 around the circumference of the small diameter portion 2A.

Moreover, around the outer periphery of the input gear member 4, there are provided an external gear 4B and a drum 4C in such a manner as to interpose therebetween the flange 4A in an axial direction of the camshaft 2. The external gear 4B acts as a first gear. The drum 4C is smaller in diameter than the external gear 4B, and is circular in shape. The spring clutch 14 is wound around outer peripheries of the drum 4C and the output drum 5. The external gear 4B meshes with the first planet gears 10, and acts as a sun gear for the first planet gears 10.

The output drum 5 acts as a second rotary member of the sun-and-planet gear set 3. The output drum 5 is tightened at the head end of the small diameter portion 2A of the camshaft 2 with a bolt 6. The output drum 5 rotates integrally with the camshaft 2. The output drum 5 has an outer diameter substantially the same as that of the drum 4C of the input gear member 4. The spring clutch 14 allows the output drum 5 to be held stationary to the drum 4C and released from the drum 4C, which is to be mentioned hereinafter.

The external gear 7 is integrally disposed around the outer periphery of the camshaft 2. The external gear 7 acts as a second gear. The external gear 7 meshes with the second planet gears 11, and acts as a sun gear for the second planet gears 11. The external gear 7 is smaller in diameter and is smaller in the number of the teeth than the external gear 4B of the input gear member 4. Moreover, the external gear 7 transmits a rotational torque to the camshaft 2 via the second planet gears 11. The external gear 7 continuously rotates integrally with the camshaft 2.

Figure 3:
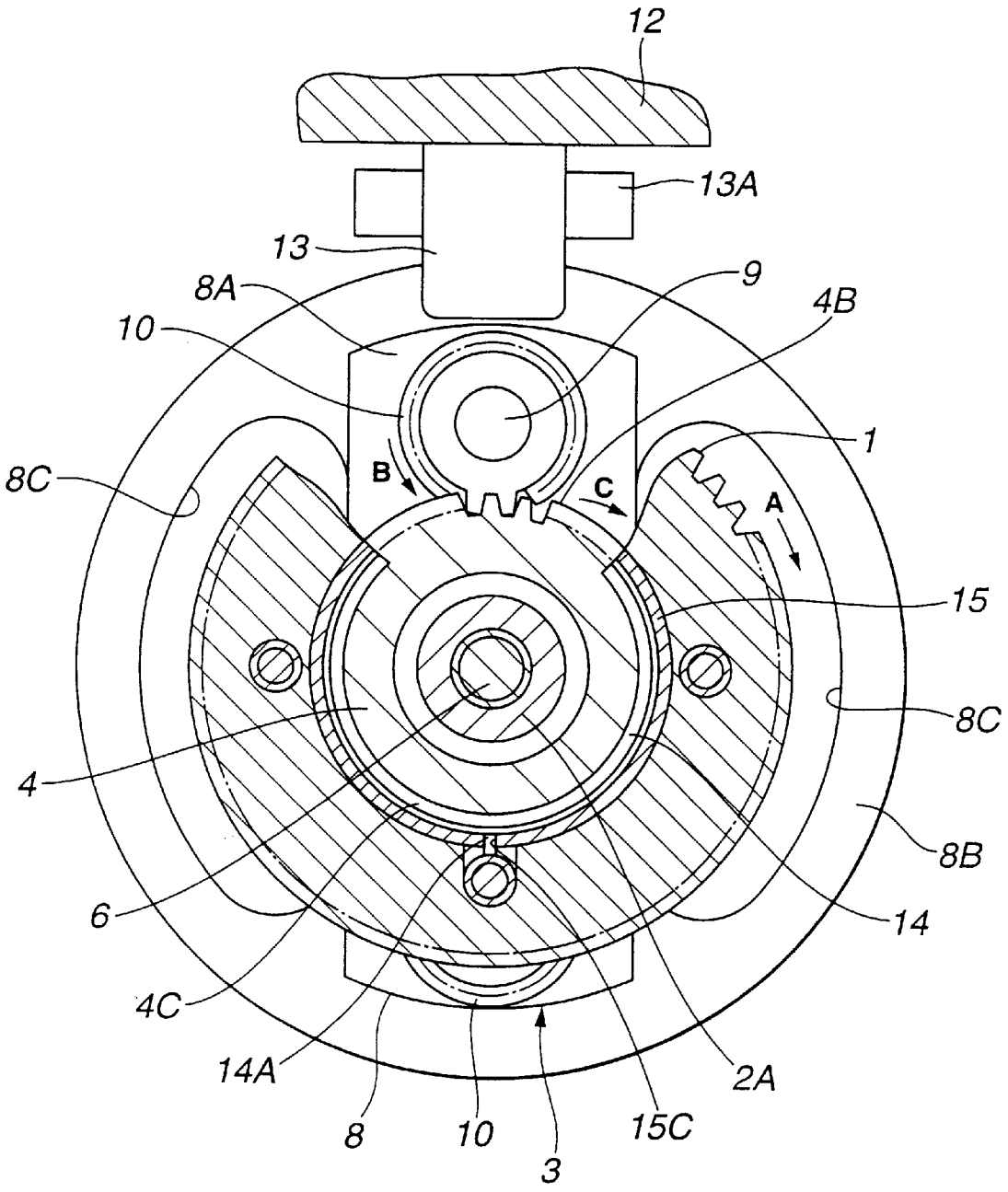
FIG. 3 is a cross sectional view showing the valve timing control system taken in the direction of arrows substantially along the line III—III in FIG. 1.

The carrier 8 acts as a third rotary member of the sun-and-planet gear set 3. The carrier 8 is formed into a stepped cylindrical shape. As is seen in FIG. 3, the carrier 8 has a shaft support 8A and a disk 8B. The shaft support 8A is substantially rectangular, and extends between a pair of the first planet gears 10. The disk 8B is circular, and is formed integrally with the shaft support 8A around an outer periphery of the shaft support 8A. As is seen in FIG. 3, the disk 8B has a pair of cutouts 8C interposing therebetween the shaft support 8A. Each of the cutouts 8C is shaped into a circular arc. The pair of the cutouts 8C help reduce a weight of the carrier 8.

Figure 1:
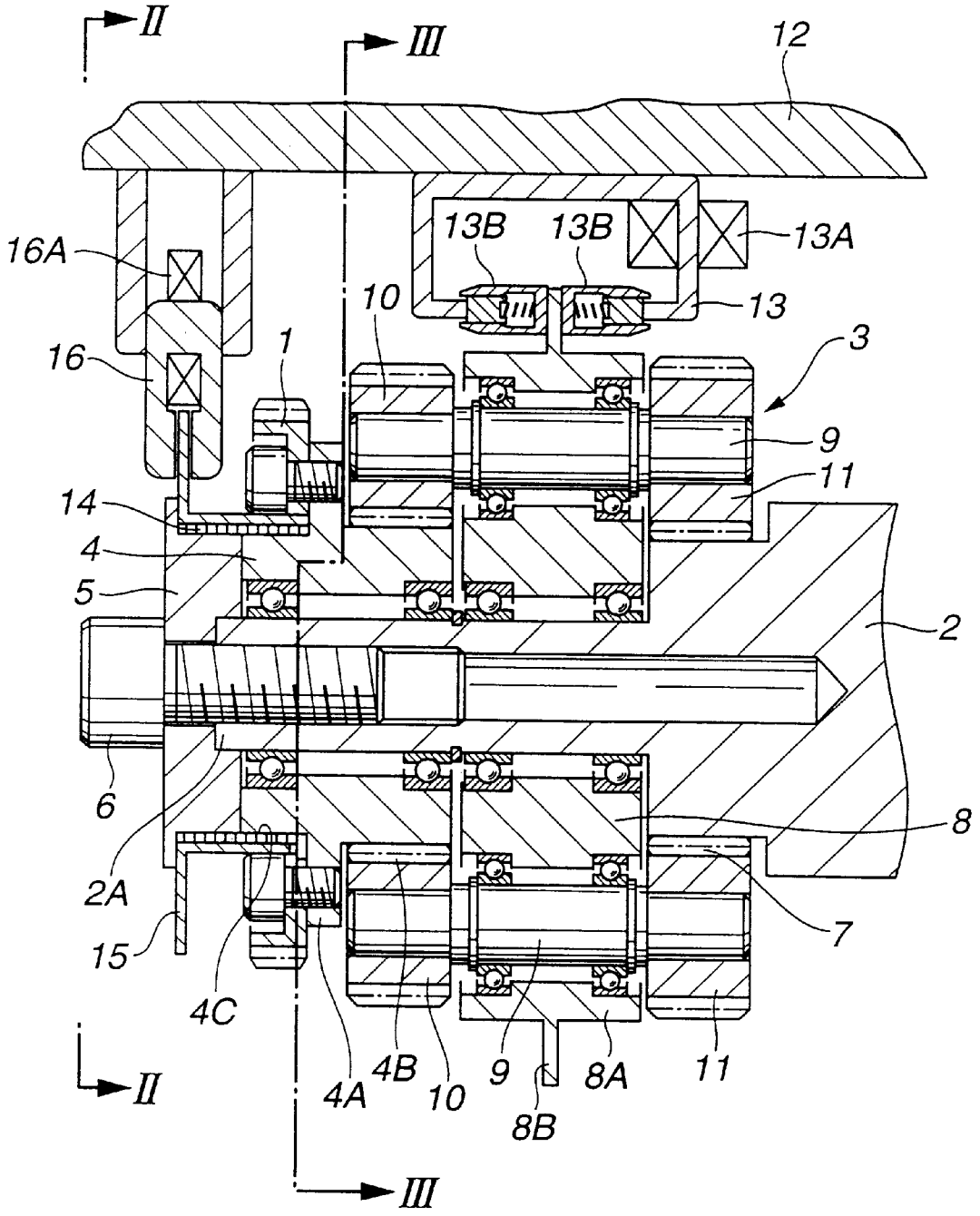
FIG. 1 is a cross sectional view showing a valve timing control system of an internal combustion engine, according to a first embodiment of the present invention.
Figure 4:
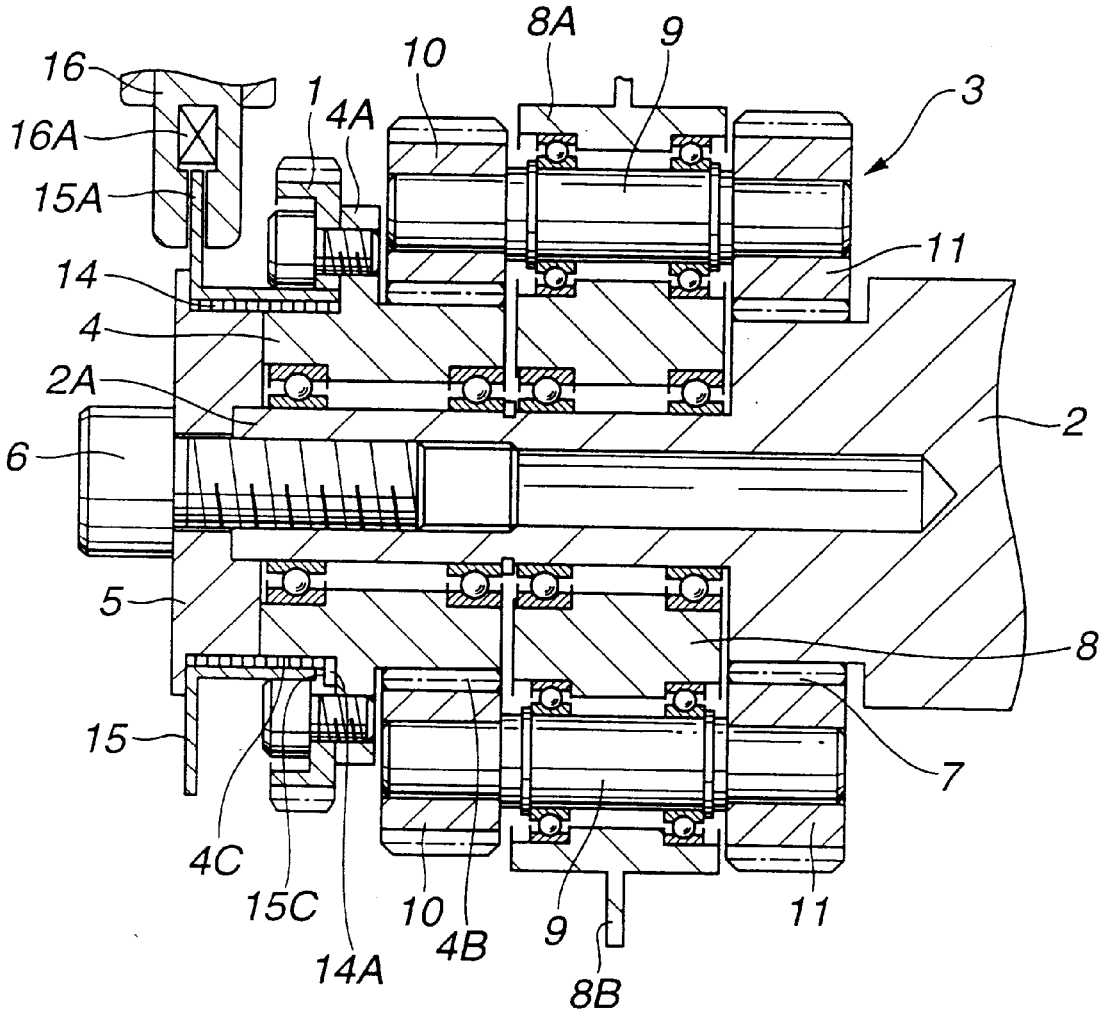
FIG. 4 is an enlarged cross sectional view showing an essential part of the valve timing control system in FIG. 1.

As is seen in FIGS. 1 and 4, the carrier 8 is rotatably disposed, via the bearings, around the outer periphery of the small diameter portion 2A of the camshaft 2. A pair of planet shafts 9 are rotatably installed to the shaft support 8A. The planet shafts 9 are separated from each other at a predetermined distance in a radial direction from the small diameter portion 2A of the camshaft 2. Each of the planet shafts 9 has first and second ends projecting from the shaft support 8A. The first end of the planet shaft 9 is integrated with the first planet gear 10. The second end of the planet shaft 9 is integrated with the second planet gear 11.

Each of the first planet gears 10 is fixed to the first end of the planet shaft 9 through a press fitting method. The first planet gears 10 mesh with the external gear 4B of the input gear member 4, and transmit a rotational torque to the planet shaft 9 from the driven sprocket 1.

Each of the second planet gears 11 is fixed to the second end of the planet shaft 9 through the press fitting method. The second planet gears 11 mesh with the external gear 7 of the camshaft 2, and transmit the rotational torque to the camshaft 2 from the planet gear shaft 9. The second planet gears 11 are larger in the number of teeth than the first planet gears 10. The difference in the number of teeth between the first and second planet gears 10 and 11 causes an increased speed of rotation as follows: When a solenoid brake 13 brakes a rotation of the carrier 8, the camshaft 2 is allowed to rotate faster than the driven sprocket 1 by a speed difference corresponding to the difference in the number of teeth between the first and second planet gears 10 and 11.

A support frame 12 such as the cylinder of the internal combustion engine is disposed above the valve timing control system of the present invention. The solenoid brake 13 is fixed to the support frame 12, and acts as a rotational speed adjuster. The solenoid brake 13 has a brake control coil 13A and a pair of dampers 13B. When an external signal magnetizes the brake control coil 13A, the solenoid brake 13 allows the pair of the dampers 13B to interpose therebetween the disk 8B of the carrier 8, to thereby apply to the carrier 8 a braking force as a load. When the external signal demagnetizes the brake control coil 13A, the solenoid brake 13 allows the pair of the dampers 13B to minimize the interposing force. In this condition, substantially no braking force is applied to the disk 8B of the carrier 8, and therefore, the carrier 8 is allowed to rotate with substantially no load applied.

In other words, as is seen in FIG. 3, when the driven sprocket 1 is rotated in the direction A, the rotational force of the driven sprocket 1 is transmitted from the external gear 4B of the input gear member 4 to the first planet gears 10. With this, the first planet gears 10 begin to rotate in a direction B on the planet gear shafts 9, respectively, and simultaneously receive a revolving force for revolving the first planet gears 10 around the input gear member 4 in a direction C. The revolving force is transmitted to the carrier 8 as a rotational torque.

When the carrier 8 rotates in the direction C with no load applied, the first planet gears 10 rotate on the planet gear shafts 9, and revolve around the outer periphery of the external gear 4B of the input gear member 4. Furthermore, the second planet gears 11 rotate on the planet gear shafts 9, and revolve around the outer periphery of the external gear 7 of the camshaft 2. In this condition, the rotational torque from the driven sprocket 1 is not transmitted to the camshaft 2. Thereby, the camshaft 2 is retarded relative to the driven sprocket 1 in respect of the rotational phase (retarded angle direction).

Contrary to this, when the solenoid brake 13 brakes the carrier 8 to retard the rotational speed of the carrier 8, the rotation of the carrier 8 in the direction C in FIG. 3 is limited. With this, the rotations of the first and second planet gears 10 and 11 in the direction B transmit the rotational torque from the external gear 7 to the camshaft 2. With the rotational torque applied to the camshaft 2, the camshaft 2 is rotated. Thereby, the camshaft 2 is advanced in respect of the rotational phase (advanced angle direction).

Figure 5:
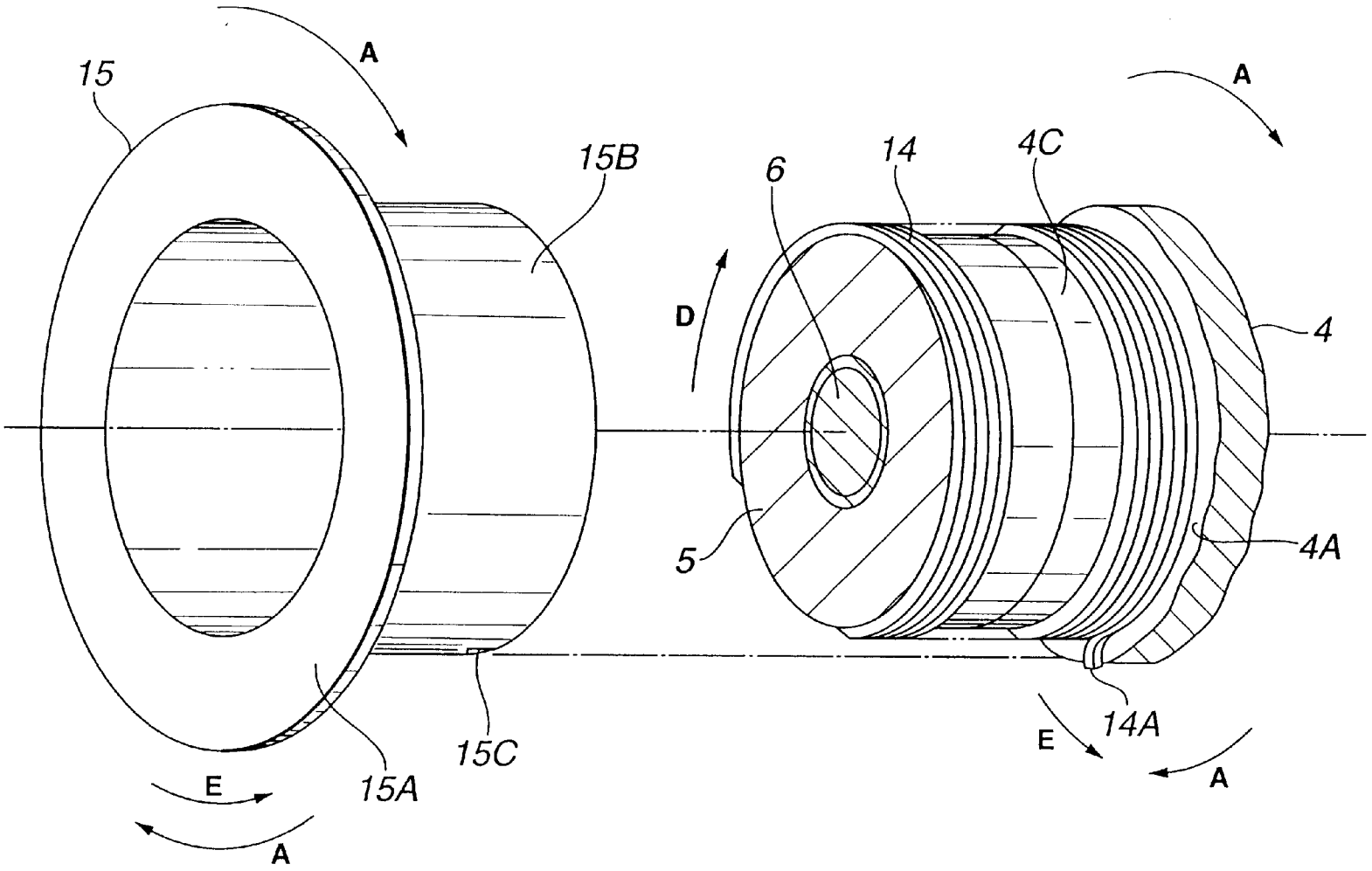
FIG. 5 is an exploded perspective view showing a spring clutch and a clutch control disk in FIG. 1.

The spring clutch 14 is wound around the drum 4C of the input gear member 4 and the output drum 5. As is seen in FIG. 5, the spring clutch 14 is a right handed coil. The spring clutch 14 has a first side wound around the outer periphery of the output drum 5, and a second side wound around the outer periphery of the drum 4C. At an end of the second side of the spring clutch 14, there is provided a hook 14A projecting radially outwardly.

The spring clutch 14 has a known constitution similar to those disclosed in Japanese Patent Unexamined Publication No. 6(1994)-10977, No. 6(1994)-66328, No. 7(1995)-91459 and No. 7(1995)-332385.

Since the spring clutch 14 is a right handed coil, the spring clutch 14 receives a torsional torque in a direction to reduce its coil diameter when the input gear member 4 integral with the driven sprocket 1 rotates in the direction A (clockwise in FIG. 2), as is seen in FIGS. 3 and 5. With this, the spring clutch 14 firmly winds around the output drum 5 acting as a follower. Thereby, the spring clutch 14 holds stationary the connection between the drum 4C of the input gear member 4 and the output drum 5.

Contrary to this, when the output drum 5 integral with the camshaft 2 rotates such that the rotational phase of the output drum 5 advances relative to that of the driven sprocket 1 and the input gear member 4, the spring clutch 14 receives the torsional torque in the direction to increase its coil diameter (direction D in FIG. 5). With this, the spring clutch 14 is slightly spaced apart from an outer surface of the output drum 5, to thereby allow the drum 4C of the input gear member 4 and the output drum 5 to be released from each other. With this, the drum 4C and the output drum 5 rotate relative to each other.

A clutch control disk 15 is disposed around an outer periphery of the spring clutch 14 with a minor gap therebetween. As is seen in FIG. 5, the clutch control disk 15 has a circular disk 15A, and a cylinder 15B extending axially from an inner periphery of the disk 15A. The cylinder 15B of the clutch control disk 15 is mated with the outer periphery of the spring clutch 14 in such a manner as to have a play therebetween.

The cylinder 15B has an edge formed with a small cutout 15C. The cutout 15C of the cylinder 15B is shaped into a right-angled "U." As is seen in FIG. 4, the cutout 15C is hooked by the hook 14A of the spring clutch 14. The clutch control disk 15 rotates integrally with the spring clutch 14 in the direction A in FIG. 5 until the braking force is applied to the clutch control disk 15 by a clutch releasing device 16.

Once the braking force is applied to the clutch control disk 15 by the clutch releasing device 16, the clutch control disk 15 receives the braking torque in a direction E in FIG. 5. Therefore, the clutch control disk 15 rotates more slowly than the spring clutch 14 (input gear member 4), and the cutout 15C of the clutch control disk 15 allows the hook 14A of the spring clutch 14 to make a movement relative to the other portion of the spring clutch 14 in the direction E.

This relative movement puts the spring clutch 14 such that a slight space is formed between the spring clutch 14 and the outer surface of the drum 4C of the input gear member 4. With this, the spring clutch 14 allows the drum 4C of the input gear member 4 to be released from the output drum 5, and therefore, the drum 4C and the output drum 5 rotate relative to each other.

Figure 6:
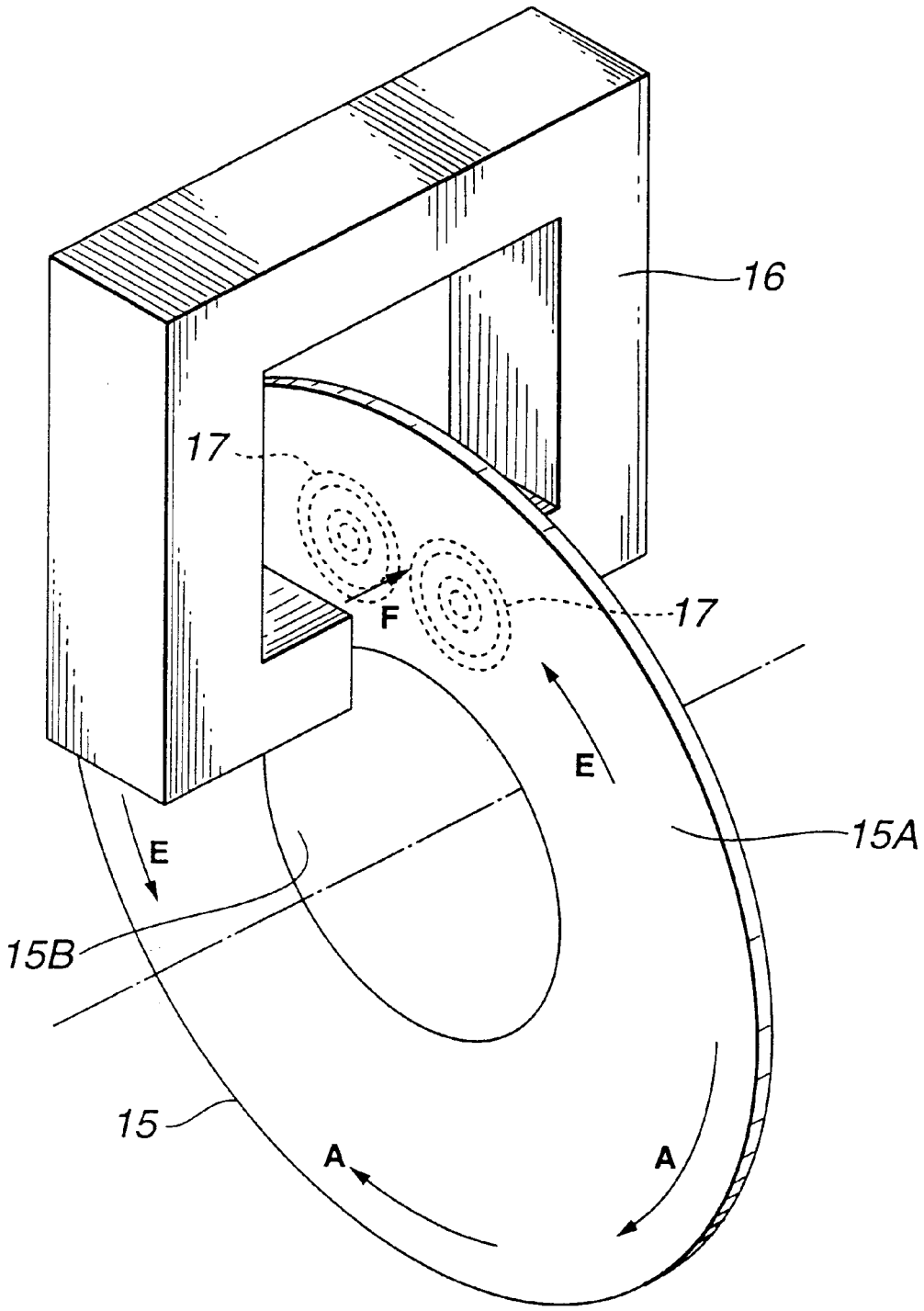
FIG. 6 is a perspective view showing a principle of applying a braking force to the clutch control disk with a clutch releasing device.

The clutch releasing device 16 is fixed to the support frame 12. The clutch releasing device 16 and the clutch control disk 15 constitute a clutch releasing means. The clutch releasing device 16 has a clutch control coil 16A. The clutch releasing device 16 is shaped into a right-angled "U" having a first end and a second end. The first and second ends of the clutch releasing device 16 interpose therebetween the disk 15A of the clutch control disk 15 in the axial direction of the camshaft 2. As is seen in FIG. 6, the clutch releasing device 16 causes a magnetic field in a direction F toward a surface of the disk 15A when the clutch control coil 16A of the clutch releasing device 16 is magnetized with the external signal applied.

With this, there occur eddy currents 17 on the surface of the disk 15A. The eddy currents 17 are indicated by dotted circles in FIG. 6. With this, the clutch control disk 15 receives, as the braking force in the direction E in FIG. 6, the magnetic field (force) caused by the eddy currents 17. The thus obtained braking force allows the spring, clutch 14 to move in a releasing direction.

The valve timing control system for the internal combustion engine according to the first embodiment of the present invention has the following operations.

At first, there is disclosed how the sun-and-planet gear set 3 controls rotational phase variations of the camshaft 2. However, operations of the spring clutch 14 are temporarily disregarded in this explanation for convenience sake.

Namely, when the brake control coil 13A of the solenoid brake 13 is deenergized to thereby demagnetize the brake control coil 13A, the solenoid brake 13 does not apply the braking force to the disk 8B of the carrier 8. Thereby, the carrier 8 makes a rotation with substantially no load applied thereto.

In this condition, when the driven sprocket 1 rotates in the direction A (clockwise) in FIG. 3, the rotational force is transmitted from the external gear 4B of the input gear member 4 to the first planet gears 10. With this, the first planet gears 10 rotate on the planet shaft 9 in the direction B, and receive a revolving force for revolving the first planet gears 10 around the input gear member 4 in the direction C. The revolving force is then transmitted to the carrier 8 as a rotational torque.

As a result, the carrier 8 rotates freely in the direction C. The first planet gears 10 rotate around the planet shafts 9, and revolve around the periphery of the external gear 4B of the input gear member 4. The second planet gears 11 rotate around the planet shafts 9, and revolve around the outer periphery of the external gear 7 of the camshaft 2. With this, the rotational torque from the driven sprocket 1 is not transmitted to the camshaft 2. Thus, the camshaft 2 is retarded in respect of the rotational phase relative to the driven sprocket 1 (retarded angle control).

When the brake control coil 13A of the solenoid brake 13 is energized to some degree to magnetize the brake control coil 13A, the solenoid brake 13 applies the braking force to the disk 8B of the carrier 8 to thereby allow the carrier 8 to rotate more slowly. As the carrier 8 rotates more slowly, the rotational torque in the direction B of each of the first and second planet gears 10 and 11 is transmitted from the external gear 7 to the camshaft 2. This rotational torque allows the camshaft 2 to rotate such that the camshaft 2 rotates in the same direction and at the same speed as the driven sprocket 1 (phase holding control).

Then, when the braking force by the solenoid brake 13 is further increased to such an extent that the carrier 8 substantially stops rotating, the first and second planet gears 10 and 11 stop their revolutions and the rotation of the carrier 8 in the direction C. Thereby, each of the first and second planet gears 10 and 11 makes rotations only in the direction B at the fixed revolutionary position around the camshaft 2. The second planet gears 11 are larger in the number of teeth than the first planet gear 10. Therefore, although the first planet gears 10 and the second planet gears 11 rotate integrally, the camshaft 2 rotates faster than the input gear member 4 by the speed difference corresponding to the teeth difference. Thereby, the camshaft 2 is advanced in respect of the rotational phase relative to the sprocket 1 (advanced angle control).

Figure 31:
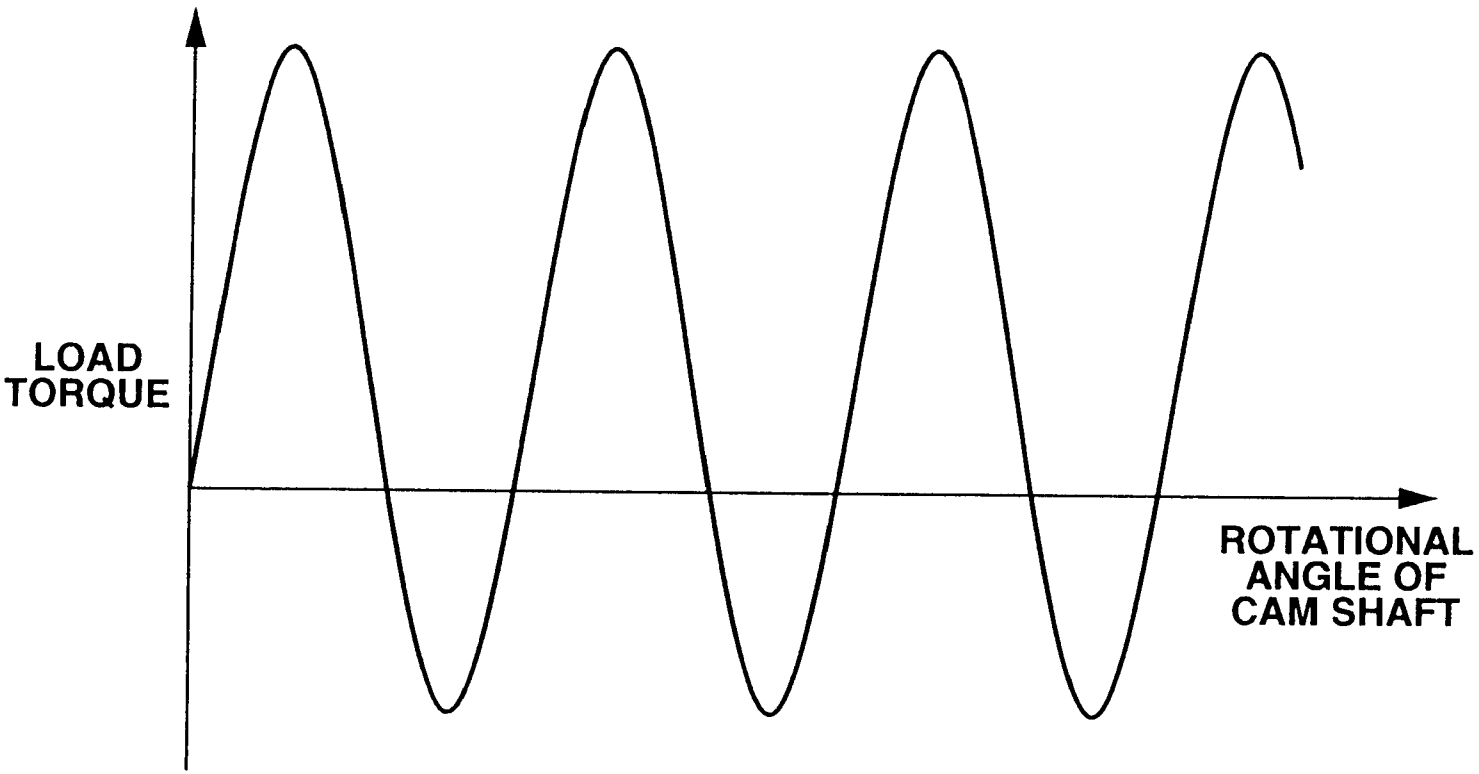
FIG. 31 is a graph showing characteristic curves of a load torque applied to the camshaft.

In the above-mentioned control with the sun-and-planet gear set 3 for rotational phase variation of the camshaft 2 regardless of the control of the spring clutch 14, there occurs a backlash and the like between the external gear 4B and the first planet gear 10, and between the external gear 7 and the second planet gear 11. Also, as is seen in FIG. 31, the torque applied to the camshaft 2 alternates between positive and negative as the valve opens and closes. The thus alternating torque causes a small looseness between the external gear 4B and the first planet gear 10, and between the external gear 7 and the second planet gear 11. With this, the camshaft 2 is slightly shifted in respect of the rotational phase relative to the driven sprocket 1 even when the phase holding control is executed.

Therefore, in the first embodiment, the spring clutch 14 is wound around the drum 4C of the input gear member 4 and the output drum 5, to thereby hold stationary the connection between the drum 4C and the output drum 5.

In this case, the spring clutch 14 is a right handed coil. Therefore, when the input gear member 4 rotates integrally with the driven sprocket 1 in the direction A (clockwise) in FIG. 3, the spring clutch 14 receives the torsional torque in the direction to reduce its coil diameter under a torque condition expressed by the following Expression (1):

$$\text{Angular velocity of driven sprocket } \mathbf{1} \geqq \text{Angular velocity of camshaft } \mathbf{2} \quad (1)$$

Under this condition, the spring clutch 14 firmly winds around the output drum 5 (follower), to thereby hold stationary the connection between the drum 4C of the input gear member 4 and the output drum 5.

Taking for example the above-mentioned retarded angle control with the sun-and-planet gear set 3, the drum 4C of the input gear member 4 rotates in the direction A in FIG. 5 faster than the output drum 5. Thereby, the spring clutch 14 receives the torsional torque in the direction to reduce its coil diameter if the clutch releasing device 16 is put in an inoperative condition. With this, the spring clutch 14 firmly winds around the output drum 5 (follower), to thereby hold stationary the area between the drum 4C of the input gear member 4 and the output drum 5.

As a result, the camshaft 2 is fixed in respect of the rotational phase relative to the driven sprocket 1 if the torque condition of Expression (1) is once satisfied. Thereby, as is seen in Table 1, the phase holding control is carried out. In this condition, the external gear 7 of the camshaft 2 meshes with the second planet gear 11. Tooth faces of the external gear 7 and the second planet gear 11 keep contacting each other. Therefore, even when the alternating torque (between positive and negative) shown in FIG. 31 is applied to the camshaft 2, the spring clutch 14 holds stationary the connection between the drum 4C and the output drum 5. That is, this arrangement preferably prevents problems caused by the backlash, and suppresses any hammering noise between the tooth faces which noise may be caused when the alternating torque is applied.

TABLE 1

| | Phase holding control | Retarded angle control | Advanced angle control |
|---|---|---|---|
| Solenoid brake 13 | Inoperative (Demagnetized) | Inoperative (Demagnetized) | Operative (Magnetized) |
| Clutch releasing device 16 | Inoperative (Demagnetized) | Operative (Magnetized) | Inoperative (Demagnetized) |
| Spring clutch 14 | Held | Released | Released |

In order to operate the clutch releasing device 16 for the retarded angle control as shown in Table 1 by timely magnetizing the clutch control coil 16A, the braking torque is applied to the clutch control disk 15 in the direction E in FIG. 5. Under this brake torque applied condition, the clutch control disk 15 rotates more slowly than the spring clutch 14. Therefore, the cutout 15C of the clutch control disk 15 moves the hook 14A of the spring clutch 14 in the direction E relative to an original position of the hook 14A.

With this, the spring clutch 14 on the side of the hook 14A is slightly spaced apart from the outer surface of the drum 4C of the input gear member 4, to thereby allow the stationary connection between the drum 4C and the output drum 5 to be released. With this, the drum 4C and the output drum 5 rotate relative to each other. Thereby, the spring clutch 14 cancels the torque transmission. This means the rotational torque from the driven sprocket 1 is not transmitted to the camshaft 2. Thus, the camshaft 2 is retarded in respect of the rotational phase relative to the driven sprocket 1.

On the other hand, as is seen in Table 1, the solenoid brake 13 is operated for the above-mentioned advanced angle control. Then, the output drum 5 integral with the camshaft 2 rotates in the direction to be advanced in respect of the rotational phase relative to the driven sprocket 1 and the input gear member 4. Thereby, the spring clutch 14 receives the torsional torque in the direction to increase its coil diameter (direction D in FIG. 5) in a torque condition expressed by the following Expression (2):

$$\text{Angular velocity of driven sprocket } \mathbf{1} < \text{Angular velocity of camshaft } \mathbf{2} \quad (2)$$

The spring clutch 14 is slightly spaced apart from the outer surface of the output drum 5, to thereby allow the drum 4C of the input gear member 4 and the output drum 5 to be released from each other. With this, the drum 4C and the output drum 5 rotate relative to each other. Thus, the rotational phase of the camshaft 2 is advanced relative to that of the driven sprocket 1.

Then, when the rotational phase of the camshaft 2 is advanced relative to the driven sprocket 1 by a predetermined angle, the braking force with the solenoid brake 13 is released so that the spring clutch 14 holds stationary the connection between the drum 4C and the output drum 5 in the advanced condition. Thereby, the phase holding control is again executed for holding the rotational phase of the camshaft 2 relative to that of the driven sprocket 1.

With the thus arranged first embodiment according to the present invention, the rotational phase of the camshaft 2 relative to that of the driven sprocket 1 is variably controlled by using the sun-and-planet gear set 3, the solenoid brake 13, the spring clutch 14, the clutch control disk 15 and the clutch releasing device 16. This enables the rotational phase control between the driven sprocket 1 and the camshaft 2 to be accurately executed for the retarded angle condition, the advanced angle condition and the holding condition.

Moreover, by stable holding of the rotational phases between the driven sprocket 1 and the camshaft 2 through the spring clutch 14, the tightening force of the spring clutch 14 is prevented from being reduced (The tightening force tends to be reduced by the alternating torque during valve's open and closed conditions). Any noise due to torque fluctuations is prevented from occurring. A slight shift in the rotational phase of the camshaft 2 relative to the driven sprocket 1 is prevented.

Figure 7:
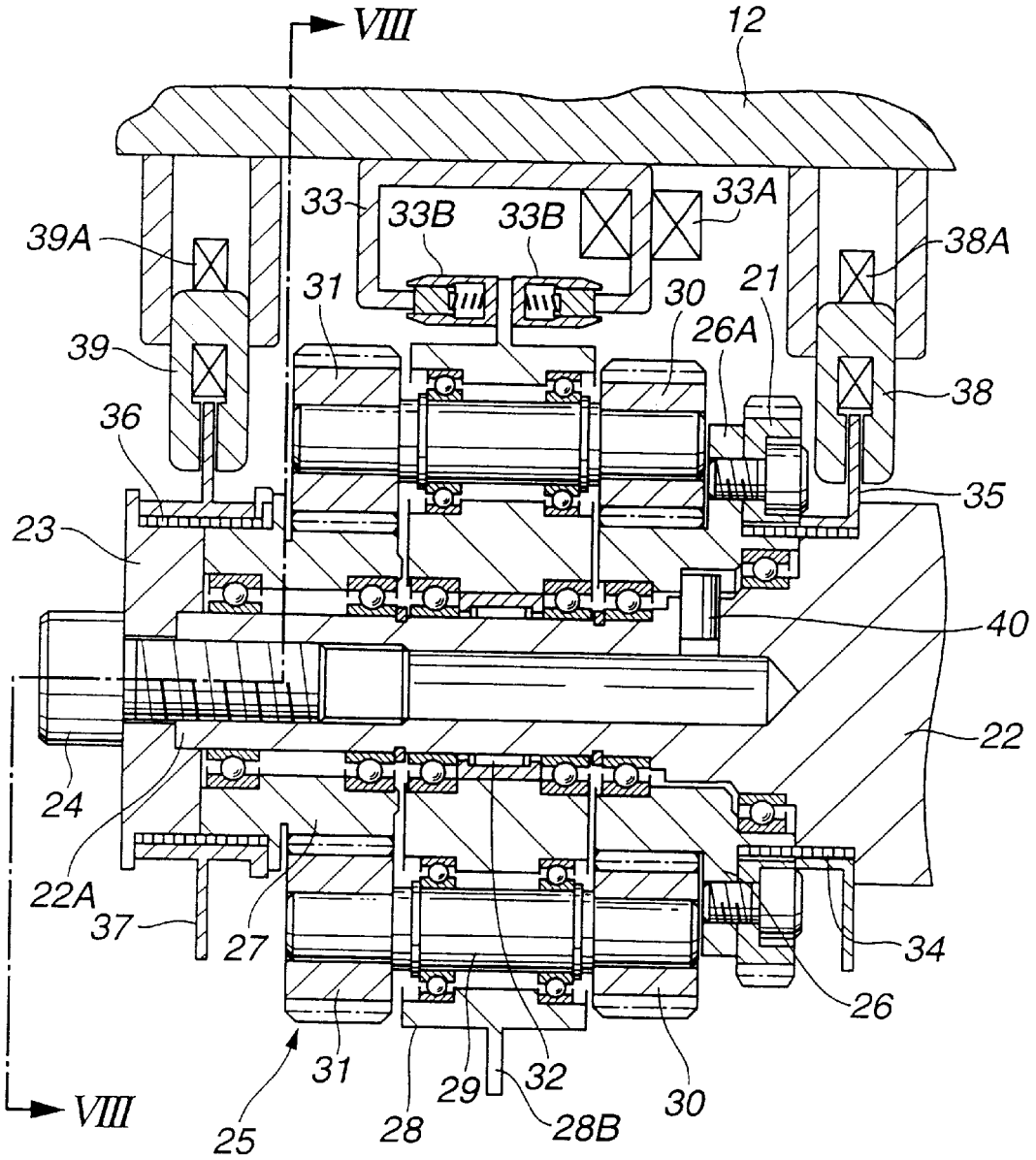
FIG. 7 is a cross section showing the valve timing control system, according to a second embodiment of the present invention.
Figure 8:
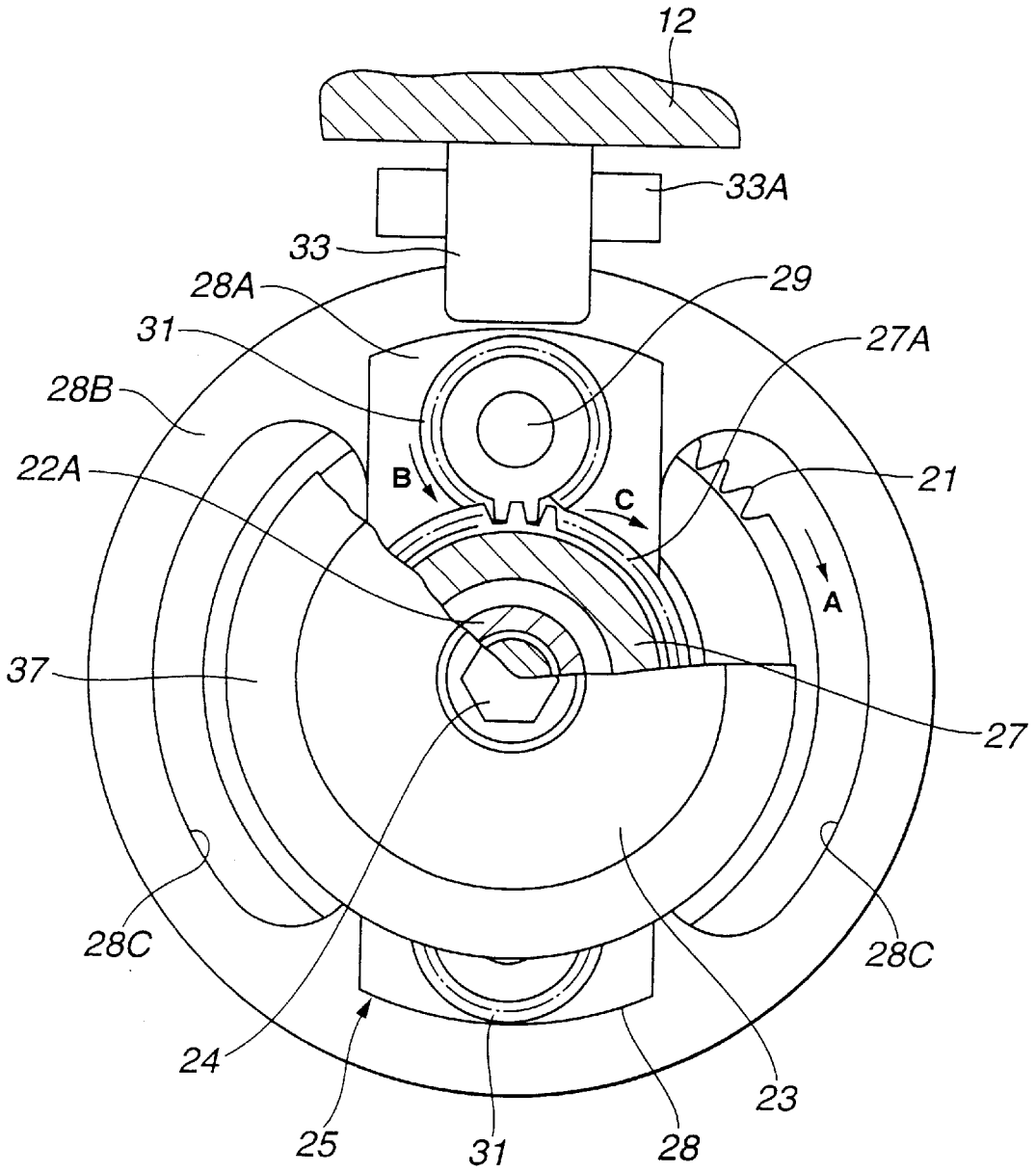
FIG. 8 is a cross sectional view of the valve timing control system taken in the direction of arrows substantially along the line VIII—VIII in FIG. 7.
Figure 9:
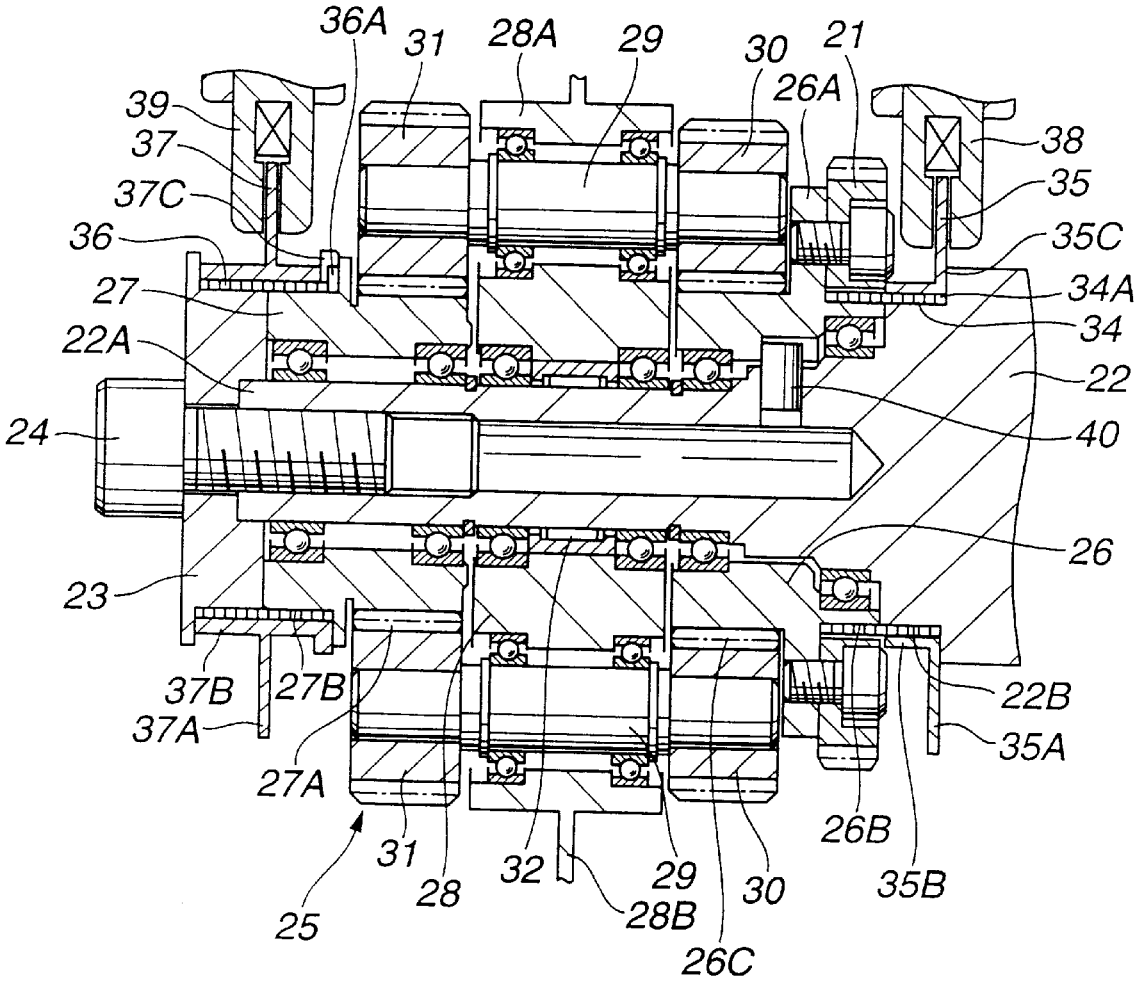
FIG. 9 is an enlarged cross sectional view showing an essential part of the valve timing control system in FIG. 7.

FIGS. 7 through 9 show a second embodiment of the present invention. In the second embodiment, a plurality of spring clutches are used in order to further stabilize the rotational phase holding control of holding the connection between a driven sprocket 21 and a camshaft 22. Moreover, an accurate switching control is carried out between the holding condition, the retarded angle condition, the advanced angle condition.

In the second embodiment, the elements same as those in the first embodiment have the same numerals. Therefore, repeated explanations for the same elements are omitted in the second embodiment.

The driven sprocket 21 acting as a rotor has the same constitution as the driven sprocket 1 in the first embodiment. The camshaft 22 has almost the same constitution as the camshaft 2 in the first embodiment, and has a small diameter portion 22A.

The camshaft 22 has, at a bottom end position of the small diameter portion 22A, a drum 22B circular in shape. The drum 22B has an outer diameter substantially the same as that of a drum 26B of an input gear member 26. A first spring clutch 34 is installed on the drum 22B and the drum 26B, and allows the drum 22B and the drum 26B to be held stationary to each other and released from each other.

An output drum 23 constitutes a part of the camshaft 22. The output drum 23 is tightened at a head end of the small diameter portion 22A of the camshaft 22 with a bolt 24 so as to rotate integrally with the camshaft 22. The output drum 23 has an outer diameter substantially the same as that of a drum 27B of an output gear member 27. A second spring clutch 36 is installed on the output drum 23 and the drum 27B, and allows the output drum 23 and the drum 27B to be held stationary to each other and released from each other.

A sun-and-planet gear set 25 is disposed between the driven sprocket 21 and the camshaft 22. The sun-and-planet gear set 25 acts as a rotational phase controller for variably controlling the rotational phase of the camshaft 22 relative to that of the driven sprocket 21. The sun-and-planet gear set 25 also acts as a holding force generator for the first spring clutch 34 and the second spring clutch 36. The sun-and-planet gear set 25 is constituted by the input gear member 26, the output gear member 27, a carrier 28, a pair of first planet gears 30 and a pair of second planet gears 31.

The input gear member 26 acts as a first rotary member of the sun-and-planet gear set 25. The input gear member 26 is formed into a stepped cylinder. The input gear member 26 is rotatably disposed, via bearings, around an outer periphery of the small diameter portion 22A of the camshaft 22. Around an outer periphery of the input gear member 26, there is provided a flange 26A circular in shape. The driven sprocket 21 is fixed to the flange 26A with bolts.

The input gear member 26 rotates integrally with the driven sprocket 21 around the outer periphery of the small diameter portion 22A of the camshaft 22. Moreover, around the outer periphery of the input gear member 26, there are provided an external gear 26C and the drum 26B of a circular shape in such a manner as to interpose therebetween the flange 26A in the axial direction. The external gear 26C acts as a first gear.

The output gear member 27 acts as a second rotary member of the sun-and-planet gear set 25. The output gear member 27 is formed into a stepped cylinder. The output gear member 27 is rotatably disposed, via bearings and the like, around the outer periphery of the small diameter portion 22A of the camshaft 22. Around an outer periphery of the output gear member 27, there are provided an external gear 27A and the drum 27B of a circular shape spaced apart from each other in the axial direction. The external gear 27A acts as a second gear.

The carrier 28 acts as a third rotary member of the sun-and-planet gear set 25. Like the carrier 8 in the first embodiment, the carrier 28 has a shaft support 28A and a disk 28B. As is seen in FIG. 8, the disk 28B has a pair of cutouts 28C interposing therebetween the shaft support 28A. Each of the cutouts 26C is shaped into a circular arc.

The carrier 28 is rotatably disposed, via bearings and the like, around the outer periphery of the small diameter portion 22A of the camshaft 22. A pair of planet shafts 29 are rotatably installed to the shaft support 28A. Each of the planet shafts 29 has first and second ends projecting from the shaft support 28A of the carrier 28. The first end of the planet shaft 29 is integrated with the first planet gear 30. The second end of the planet shaft 29 is integrated with the second planet gear 31.

The pair of first planet gears 30 mesh with the external gear 26C of the input gear member 26, and transmit a rotational torque from the driven sprocket 21 to the planet gear shaft 29. The second planet gears 31 mesh with the external gear 27A of the output gear member 27, and transmit the rotational torque from the planet shaft 29 to the output gear member 27.

Moreover, the second planet gears 31 are larger in the number of teeth than the first planet gears 30. The difference in the number of teeth between the first and second planet gears 30 and 31 causes an increased speed as follows: When a solenoid brake 33 brakes the rotation of the carrier 28, the output gear member 27 is allowed to rotate faster than the input gear member 26 (driven sprocket 21) by a speed difference corresponding to the difference in the number of teeth between the first and second planet gears 30 and 31.

A one-way clutch 32 is disposed between the small diameter portion 22A of the camshaft 22 and the carrier 28. The one-way clutch 32 prevents the carrier 28 from making a rotation in a direction C (clockwise) in FIG. 8 relative to the camshaft 22, and allows the carrier 28 to make a rotation in the counter-clockwise direction relative to the camshaft 22.

The solenoid brake 33 is fixed to the support frame 12, and acts as a rotational speed adjuster. Like the solenoid brake 13 according to the first embodiment, the solenoid brake 33 has a brake control coil 33A and a pair of dampers 33B.

The first spring clutch 34 is wound around the drum 22B of the camshaft 22 and the drum 26B of the input gear member 26. Like the spring clutch 14 according to the first embodiment, the first spring clutch 34 is a right handed coil. The first spring clutch 34 has a first side wound around the outer periphery of the drum 26B, and a second side wound around an outer periphery of the drum 22B. At an end of the second side of the first spring clutch 34, there is provided a hook 34A projecting radially outwardly.

The first spring clutch 34 is the right handed coil. Therefore, when the input gear member 26 rotates integrally with the driven sprocket 21 in the direction A (clockwise) in FIG. 8, the first spring clutch 34 receives a torsional torque in a direction to increase its coil diameter under a torque condition satisfying the following Expression (3):

$$\text{Angular velocity of driven sprocket } \mathbf{21} > \text{Angular velocity of camshaft } \mathbf{22} \quad (3)$$

The first spring clutch 34 is slightly spaced apart from an outer surface of the drum 26B. The first spring clutch 34, therefore, allows the drum 26B of the input gear member 26 and the drum 22B of the camshaft 22 to be released from each other. As a result, the drum 26B and the drum 22B can rotate relative to each other.

Contrary to this, when the camshaft 22 rotates in a direction to be advanced in respect of the rotational phase relative to the driven sprocket 21 and the input gear member 26, the first spring clutch 34 receives a torsional torque in a direction to reduce its coil diameter under a torque condition satisfying the following Expression (4):

$$\text{Angular velocity of camshaft } \mathbf{22} \geqq \text{Angular velocity of driven sprocket } \mathbf{21} \quad (4)$$

With this, the first spring clutch 34 firmly winds around the drum 22B and the drum 26B, to thereby hold stationary the connection between the drum 22B and the drum 26B.

A first clutch control disk 35 is disposed around an outer periphery of the first spring clutch 34 with a minor gap therebetween. As is seen in FIG. 9, the first clutch control disk 35 has a circular disk 35A, and a cylinder 35B extending axially from an inner periphery of the disk 35A. The cylinder 35B of the first clutch control disk 35 mates with the outer periphery of the first spring clutch 34 in such a manner as to have a play therebetween.

The first clutch control disk 35 has a small cutout 35C at an edge (corner) defined between the disk 35A and the cylinder 35B. The cutout 35C has a cross section shaped into a right-angled "U." The cutout 35C is hooked by a hook 34A of the first spring clutch 34. The first clutch control disk 35 rotates integrally with the first spring clutch 34 in the direction A (clockwise) until the braking force is applied to the first clutch control disk 35 by a first clutch releasing device 38.

Once the braking force is applied to the first clutch control disk 35 by the first clutch releasing device 38, the first clutch control disk 35 receives the braking torque in the counter-clockwise direction. Thereby, the cutout 35C of the first clutch control disk 35 allows the hook 34A of the first spring clutch 34 to make a movement in the counter-clockwise direction relative to the other portion of the first spring clutch 34. With this, the first spring clutch 34 in the vicinity of the hook 34A is slightly spaced apart from the outer surface of the drum 22B, and therefore, the first spring clutch 34 allows the camshaft 22 to be released from the input gear member 26. As a result, the camshaft 22 and the input gear member 26 rotate relative to each other.

The second spring clutch 36 of a right handed coil is wound around the drum 27B of the output gear member 27 and the output drum 23. The second spring clutch 36 has a first side wound around an outer periphery of the output drum 23, and a second side wound around an outer periphery of the drum 27B of the output gear member 27. At an end of the second side of the second spring clutch 36, there is provided a hook 36A projecting radially outwardly.

The second spring clutch 36 is the right handed coil. Therefore, when the output gear member 27 rotates in the direction A (clockwise) in FIG. 8, the second spring clutch 36 receives a torsional torque in a direction to decrease its coil diameter under a torque condition satisfying the following Expression (5):

Angular velocity of output gear member 27≧Angular velocity of camshaft 22 (5)

With this, the second spring clutch 36 firmly winds around the output drum 23 (follower), to thereby hold stationary the connection between the drum 27B of the output gear member 27 and the output drum 23.

Contrary to this, when the output drum 23 rotates in a direction to be advanced in respect of the rotational phase relative to the output gear member 27, the second spring clutch 36 receives a torsional torque in a direction to increase its coil diameter under a torque condition satisfying the following Expression (6):

Angular velocity of output drum 23>Angular velocity of output gear member 27 (6)

With this, the second spring clutch 36 is slightly spaced apart from the outer surface of the output drum 23. The second spring clutch 36 allows the output drum 23 and the drum 27B of the output gear member 27 to be released from each other. The output drum 23 and the drum 27B rotate relative to each other.

A second clutch control disk 37 is disposed around an outer periphery of the second spring clutch 36 with a minor gap therebetween. As is seen in FIG. 9, the second clutch control disk 37 has a cross section shaped into "T." The second clutch control disk 37 has a circular disk 37A, and a cylinder 37B extending in the axial direction. The cylinder 37B of the second clutch control disk 37 mates with the outer periphery of the second spring clutch 36 in such a manner as to have a play therebetween.

The cylinder 37B has at an end thereof a small cutout 37C. As is seen in FIG. 9, the cutout 37C is hooked by a hook 36A of the second spring clutch 36. The second clutch control disk 37 rotates integrally with the second spring clutch 36 in the clockwise direction until the braking force is applied to the second control disk 37 by a second clutch releasing device 39.

Once the braking force is applied to the second clutch control disk 37 by the second clutch releasing device 39, the second clutch control disk 37 receives the braking torque in the counter-clockwise direction. Thereby, the cutout 37C allows the hook 36A of the second spring clutch 36 to make a movement in the counter-clockwise direction relative to the other portion of the second spring clutch 36. With this, the second spring clutch 36 in the vicinity of the hook 36A is slightly spaced apart from the outer surface of the drum 27B of the output gear member 27. With this, the second spring clutch 36 allows the drum 27B and the output drum 23 to be released from each other. Consequently, the drum 27B and the output drum 23 can rotate relative to each other.

Each of the first and second clutch releasing devices 38 and 39 is fixed to the support frame 12. The first clutch releasing device 38 and the first clutch control disk 35 constitute a first clutch releasing means, while the second clutch releasing device 39 and the second clutch control disk 36 constitute a second clutch releasing means. Like the clutch releasing device 16 according to the first embodiment, the first and second clutch releasing devices 38 and 39 have respectively clutch control coils 38A and 39A.

A stopper pin 40 is installed at the small diameter portion 22A of the camshaft 22. The stopper pin 40 projects radially outwardly from a bottom end of the small diameter portion 22A, and is engageable with an inner periphery of the input gear member 26. The stopper pin 40 controls the rotation of the camshaft 22 relative to the input gear member 26 within a predetermined range of angle, to thereby determine the maximum phase differences of the camshaft 22 to the driven sprocket 21 for the retarded angle control and the advanced angle control.

The second embodiment ensures operations and advantages substantially the same as those of the first embodiment. Disclosed below are specifics about the operations and the advantages of the second embodiment of the present invention.

At first, when the brake control coil 33A of the solenoid brake 33 is demagnetized as is seen in Table 2 and when the driven sprocket 21 rotates in the direction A (clockwise) in FIG. 8, the rotation of the driven sprocket 21 is transmitted from the external gear 26C of the input gear member 26 to the first planet gears 30. The first planet gears 30 rotate on the planet shafts 29 and revolve around the input gear member 26. The revolving force of the first planet gears 30 is transmitted to the carrier 28 as a rotational torque.

Under this condition, the first spring clutch 34 receives the torsional torque in the direction to increase its coil diameter under the torque condition satisfying Expression (3). With this, the first spring clutch 34 is slightly spaced apart from the outer surface of the drum 26B of the input gear member 26, to thereby allow the input gear member 26 and the camshaft 22 to rotate relative to each other.

However, the one-way clutch 32 disposed between the camshaft 22 and the carrier 28 prevents the carrier 28 from rotating in the clockwise direction relative to the camshaft 22. Thereby, the first and second planet gears 30 and 31 make rotations only without making revolutions. With this, the rotation of the second planet gears 31 is transmitted to the output gear member 27 via the external gear 27A.

Then, the rotation of the output gear member 27 is transmitted as the torsional torque in the direction to reduce the coil diameter of the second spring clutch 36 under the condition satisfying Expression (5). The second spring clutch 36 firmly winds around the output drum 23 (follower), to thereby hold stationary the connection between the drum 27B of the output gear member 27 and the output drum 23.

The second planet gears 31 are larger in the number of teeth than the first planet gears 30. Therefore, the second planet gears 31 rotate the camshaft 22 faster than the first planet gears 30 rotate the driven sprocket 21 by a speed difference corresponding to the difference in the number of teeth. If the rotation of the camshaft 22 integral with the output gear member 27 in the clockwise direction in FIG. 8 is even a little faster than that of the driven sprocket 21, the first spring clutch 34 receives the torsional torque in the direction to reduce its coil diameter under the torque condition satisfying Expression (4). With this, the first spring clutch 34 firmly winds around the area between the drum 22B and the drum 26B, to thereby hold stationary the drum 22B and the drum 26B.

As a result, the camshaft 22 rotates integrally with the output gear member 27 in the clockwise direction, and the rotation of the driven sprocket 21 is transmitted to the camshaft 22 via the sun-and-planet gear set 25 and the second spring clutch 36. During this period, the camshaft 22 rotates integrally with the driven sprocket 21 while keeping the rotational phase of the camshaft 22 relative to the driven sprocket 21 (phase holding control).

TABLE 2

| | Phase holding control | Retarded angle control | Advanced angle control |
|---|---|---|---|
| Solenoid brake 33 | Inoperative (Demagnetized) | Inoperative (Demagnetized) | Operative (Magnetized) |
| First clutch releasing device 38 | Inoperative (Demagnetized) | Inoperative (Demagnetized) | Operative (Magnetized) |
| Second clutch releasing device 39 | Inoperative (Demagnetized) | Operative (Magnetized) | Inoperative (Demagnetized) |
| First spring clutch 34 | Held | Released | Released |
| Second spring clutch 36 | Held | Released | Held |

In this condition, the external gear 26C meshes with the first planet gears 30 while the external gear 27A meshes with the second planet gears 31. Tooth faces of the external gears 26C and 27A keep contacting, respectively, those of the first and second planet gears 30 and 31, and the first and second spring clutches 34 and 36 are both put in the stationary connecting condition. Thereby, even when the alternating torque (between positive and negative) shown in FIG. 31 is applied to the camshaft 22, the first and second spring clutches 34 and 36 keep holding stationary with each other. That is, this arrangement preferably prevents problems caused by the backlash, and suppresses any hammering noise between the tooth faces which noise may be caused when the alternating torque is applied.

Next, when the second clutch releasing device 39 is operated under this condition in order to apply the braking torque to the second clutch control disk 37 in the counter-clockwise direction, the cutout 37C allows the hook 36A of the second spring clutch 36 to make a movement relative to the other portion of the second spring clutch 36 in the counter-clockwise direction. Therefore, the holding condition by the second spring clutch 36 is released, and the torque is not transmitted between the drum 27B of the output gear member 27 and the output drum 23.

As a result, when the second clutch releasing device 39 is in operation, the rotational torque from the driven sprocket 21 is not transmitted to the camshaft 22 via the sun-and-planet gear set 25 and the first spring clutch 34 is released under the torque condition satisfying Expression (3). Thus, the camshaft 22 is retarded in respect of the rotational phase relative to the driven sprocket 21. Canceling the operation of the second clutch releasing device 39 achieves an automatic recovery of the phase holding control.

Next, when the brake control coil 33A of the solenoid brake 33 is magnetized as is seen in Table 2 to apply the rotational torque (braking force) to the carrier 28 in the counter-clockwise direction in FIG. 8, the camshaft 22 rotates faster than the input gear member 26 by the speed difference corresponding to the teeth difference between the first and second planet gears 30 and 31.

In this condition, when the first clutch releasing device 38 is operated in order to apply the braking torque to the first clutch control disk 35 in the counter-clockwise direction in FIG. 9. With this, the first spring clutch 34 in the vicinity of the hook 34A is slightly spaced apart from the outer surface of the drum 22B, to thereby allow the camshaft 22 and the input gear member 26 to be released from each other.

Thereby, the camshaft 22 rotates faster than the input gear member 26 by the speed difference corresponding to the teeth difference between the first and second planet gears 30 and 31. Consequently, the camshaft 22 is advanced in respect of the rotational phase relative to the driven sprocket 21. Thereafter, canceling the operation of the first clutch releasing device 38 achieves the automatic recovery of the phase holding control.

FIGS. 10 through 13 show the valve timing control system, according to a third embodiment of the present invention.

In the third embodiment, a plurality of spring clutches are used in order to further stabilize the rotational phase holding control. Moreover, one of the spring clutches is used as a one-way clutch. The valve timing control system of the third embodiment is simple in constitution. An accurate switching control of the rotational phase is carried out between the holding condition, the retarded angle condition, the advanced angle condition. The elements same as those in the first embodiment have the same numerals. Therefore, repeated explanations for the same elements are omitted in the third embodiment.

A driven sprocket 51 acting as a rotor has the constitution substantially the same as that of the driven sprocket 1 in the first embodiment.

A camshaft 52 has almost the same constitution as the camshaft 2 in the first embodiment. Furthermore, the camshaft 52 has a stepped portion 52A having a plurality of stepped portions. The diameter of the stepped portion 52A becomes smaller stepwise in a direction toward a head end of the camshaft 52.

An output drum 53 constitutes a part of the camshaft 52. The output drum 53 is tightened at the head end of the stepped portion 52A of the camshaft 52 with a bolt 54, and therefore, the output drum 53 rotates integrally with the camshaft 52. The output drum 53 has an outer diameter substantially the same as that of a drum 58C of an output gear member 58. A second spring clutch 65 is installed around the output drum 53 and the drum 58C to allow the output drum 53 to be held stationary to the drum 58C and released from the drum 58C.

A ring drum 55 constituting a part of the camshaft 52 is disposed between an input gear member 57 and a carrier 59. The ring drum 55 is fixed around an outer periphery of the stepped portion 52A. The ring drum 55 has an outer diameter substantially the same as those of a drum 57B and a drum 59C. A first spring clutch 64 is installed around the drum 57B, the ring drum 55 and the drum 59C to allow the ring drum 55 to be held stationary to the drums 57B and 59C and released from the drums 57B and 59C.

A sun-and-planet gear set 56 is disposed between the driven sprocket 51 and the camshaft 52. The sun-and-planet gear set 56 acts as a rotational phase controller for variably controlling rotational phases. The sun-and-planet gear set 56 also acts as a holding force generator for the first spring clutch 64 and the second spring clutch 65. The sun-and-planet gear set 56 has the input gear member 57, the output gear member 58, the carrier 59, a pair of first planet gears 61 and a pair of second planet gears 62.

Figure 12:
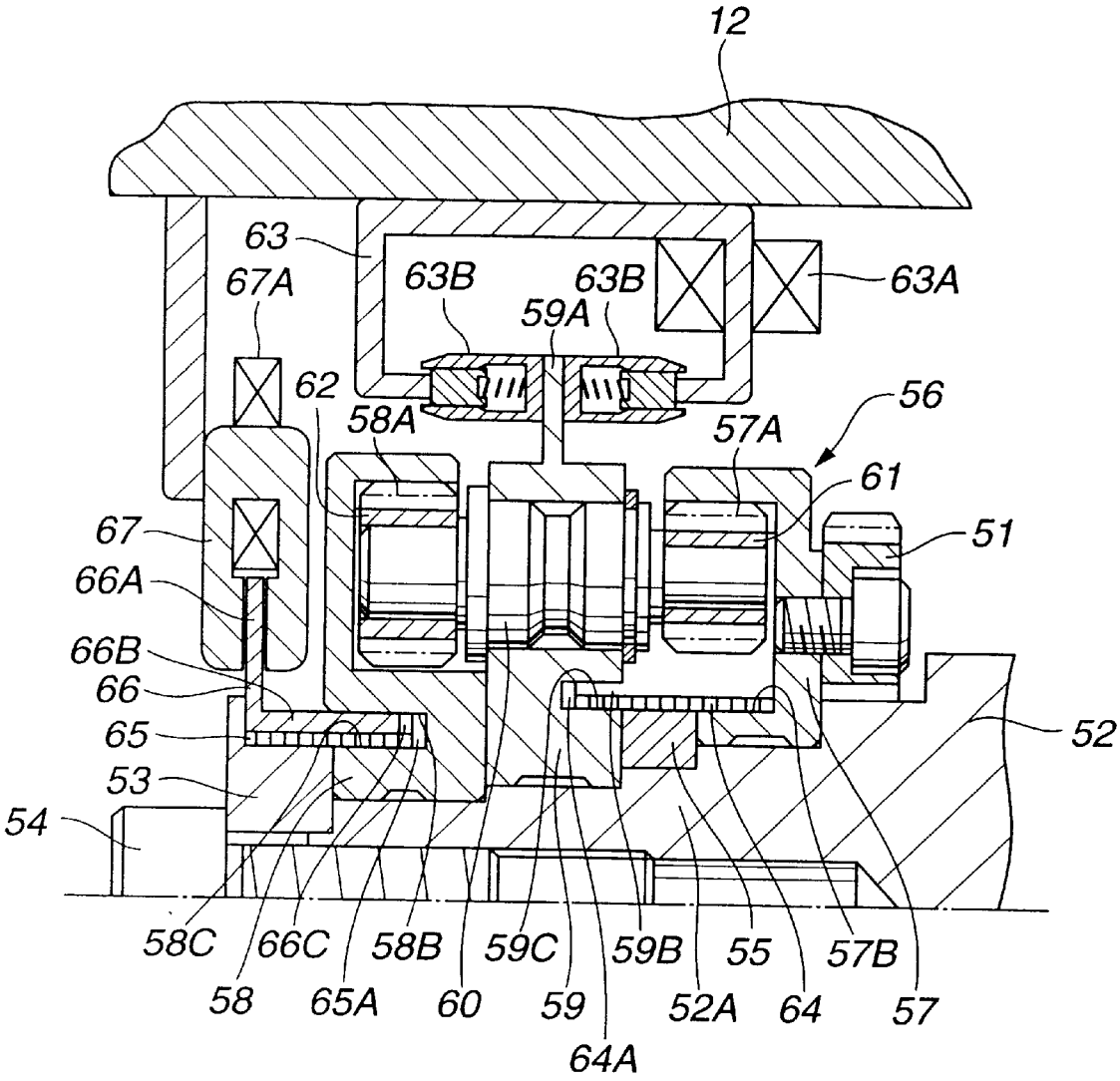
FIG. 12 is an enlarged cross sectional view of an essential part of the valve timing control system in FIG. 10.

The input gear member 57 acting as a first rotary member of the sun-and-planet gear set 56 formed into a ring having a cross section shaped into a right-angled "U" as shown in FIG. 12. The input gear member 57 is rotatably disposed around the outer periphery of the stepped portion 52A of the camshaft 52. The input gear member 57 is fixed to the driven sprocket 51 with bolts. The input gear member 57 rotates integrally with the driven sprocket 51 around the outer periphery of the stepped portion 52A of the camshaft 52. Moreover, the input gear member 57 has an internal gear 57A and a drum 57B which correspond to free ends of the U-shaped cross section. The internal gear 57A acting as a first gear is provided at an outer portion of the input gear member 57 so as to project toward the stepped portion 52A. The drum 57B is rotatably disposed on the stepped portion 52A.

The output gear member 58 acts as a second rotary member of the sun-and-planet gear set 56. The output gear member 58 is formed into a ring having a cross section shaped into a right-angled "S." The output gear member 58 is rotatably disposed around the outer periphery of the stepped portion 52A of the camshaft 52. Moreover, the output gear member 58 has an internal gear 58A, the drum 58C and a first clutch groove 58B defined between the internal gear 58A and the drum 58C. The internal gear 58A acting as a second gear is provided at an outer portion of the output gear member 58 so as to project toward the stepped portion 52A. The drum 58C is rotatably disposed on the stepped portion 52A. The internal gear 58A of the output gear member 58 has the number of teeth substantially the same as that of the internal gear 57A of the input gear member 57.

The first clutch groove 58B is formed on the output gear member 58 so as to define a cylindrical space whose inner diameter is generally the same as the diameter of the output drum 53. The drum 58C is disposed on an inside of the first clutch groove 58B. In the first clutch groove 58B, there are provided a second end of the second spring clutch 65 and a second end of a cylinder 66B of a clutch control disk 66.

The carrier 59 acts as a third rotary member of the sun-and-planet gear set 56. The carrier 59 has a constitution substantially the same as that of the carrier 8 in the first embodiment. Around an outer periphery of the carrier 59, there is formed a disk 59A integrally with the carrier 59. Moreover, the carrier 59 has a second clutch groove 59B. An inner periphery of the second clutch groove 59B acts as a drum 59C. The second clutch groove 59B has therein a first end of the first spring clutch 64.

Figure 10:
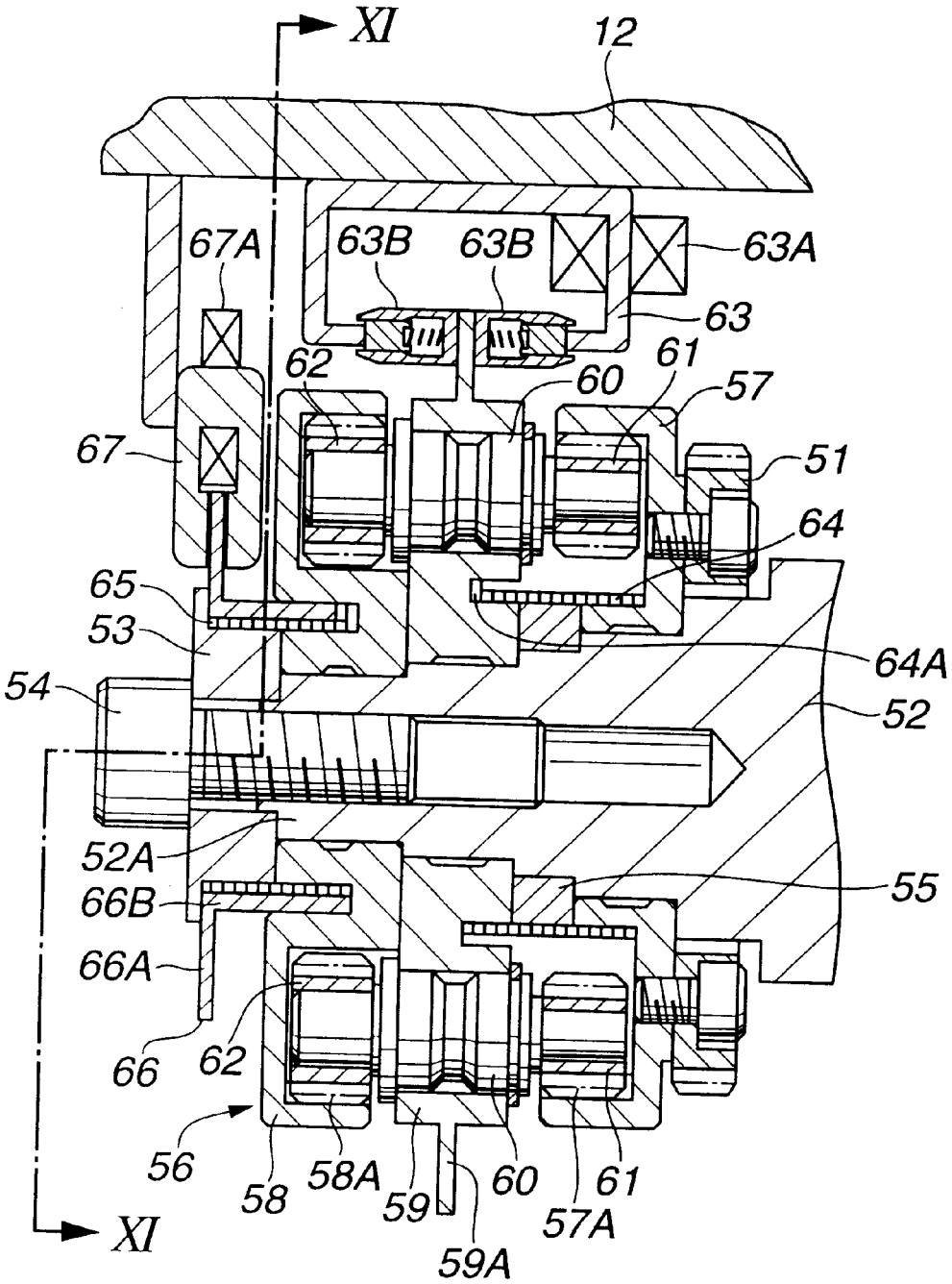
FIG. 10 is a cross section showing the valve timing control system, according to a third embodiment of the present invention.

The carrier 59 is rotatably disposed around the outer periphery of the stepped portion 52A of the camshaft 52. As is seen in FIG. 10, a pair of planet shafts 60 are rotatably installed to the carrier 59. Each of the planet shafts 60 has first and second ends projecting from the carrier 59. The first end of the planet shaft 60 is integrated with the first planet gear 61. The second end of the planet shaft 60 is integrated with the second planet gear 62.

The first planet gears 61 mesh with the internal gear 57A of the input gear member 57, and transmit a rotational torque from the driven sprocket 51 to the planet shaft 60. The second planet gears 62 mesh with the internal gear 58A of the output gear member 58, and transmit the rotational torque from the planet shaft 60 to the output gear member 58.

Moreover, the second planet gears 62 are larger in the number of teeth than the first planet gears 61. The difference in the number of teeth between the first and second planet gears 61 and 62 causes an increased speed as follows: When a solenoid brake 63 brakes the rotation of the carrier 59, the output gear member 58 is allowed to rotate faster than the input gear member 57 (driven sprocket 51) by a speed difference corresponding to the difference in the number of teeth between the first and second planet gears 61 and 62.

The solenoid brake 63 is fixed to the support frame 12, and acts as a rotational speed adjuster. Like the solenoid brake 13 according to the first embodiment, the solenoid brake 63 has a brake control coil 63A and a pair of dampers 63B.

Figure 13:
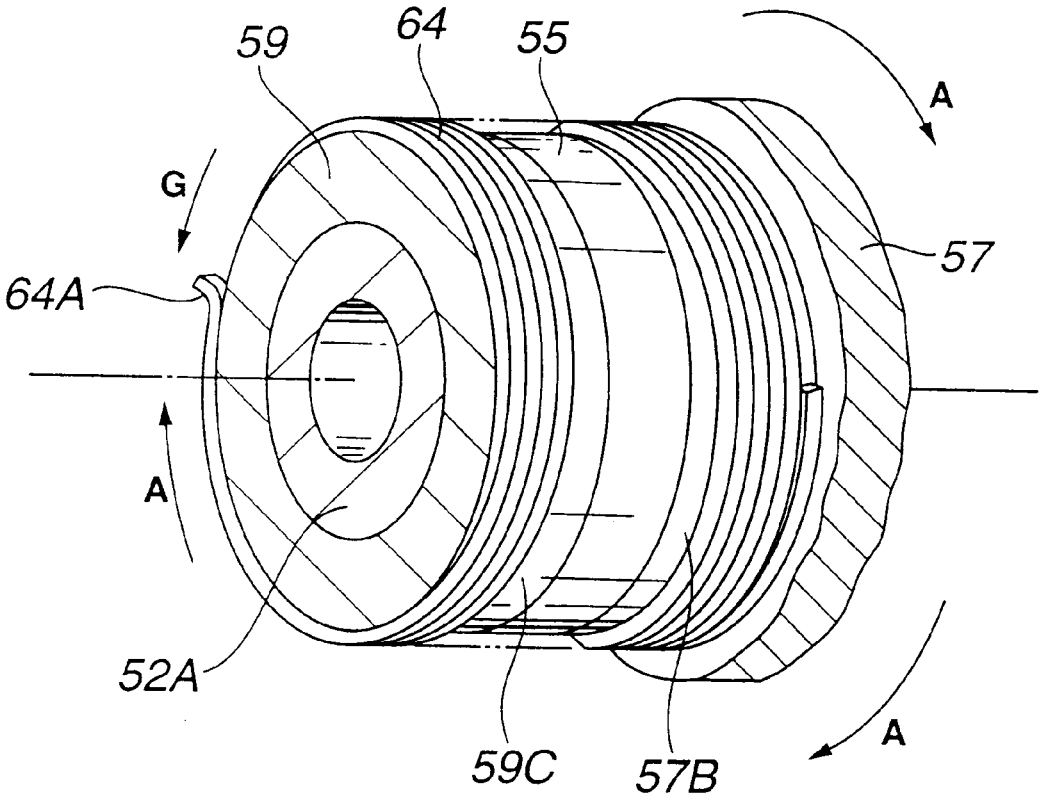
FIG. 13 is a partial perspective view explaining holding and releasing conditions of the spring clutch in FIG. 10.

The first spring clutch 64 is wound around the drum 59C of the carrier 59, the ring drum 55 of the camshaft 52 and the drum 57B of the input gear member 57. As is seen in FIG. 13, the first spring clutch 64 is a left handed coil. The first spring clutch 64 has a first side wound around the outer periphery of the drum 59C of the carrier 59, a middle portion wound around the outer periphery of the ring drum 55 of the camshaft 52, and a second side wound around the outer periphery of the drum 57B of the input gear member 57.

As is seen in FIG. 13, the first spring clutch 64 has a hook 64A projecting radially outwardly on the first side of the first spring clutch 64. The hook 64A is hooked with the carrier 59 in the second clutch groove 59B. When the carrier 59 allows the hook 64A of the first spring clutch 64 to make a movement relative to the other portion of the first spring clutch 64 in a direction G (counter-clockwise) in FIG. 13, the first spring clutch 64 allows the carrier 59 to be released from the ring drum 55 (camshaft 52). As a result, the carrier 59 and the ring drum 55 (camshaft 52) rotate relative to each other.

The first spring clutch 64 is a left handed coil. Therefore, when the input gear member 57 rotates integrally with the driven sprocket 51 in a direction A (clockwise) in FIG. 13, the first spring clutch 64 receives a torsional torque in a direction to increase its coil diameter under a torque condition satisfying the following Expression (7):

$$\text{Angular velocity of driven sprocket } \mathbf{51} > \text{Angular velocity of camshaft } \mathbf{52} \tag{7}$$

The first spring clutch 64 is slightly spaced apart from an outer surface of the drum 57B. With this, the first spring clutch 64 allows the drum 57B of the input gear member 57 to be released from the ring drum 55 of the camshaft 52. As a result, the drum 57B and the ring drum 55 rotate relative to each other.

On the other hand, when the carrier 59 rotates in a direction to be advanced in respect of the rotational phase relative to the ring drum 55 of the camshaft 52, the first spring clutch 64 receives a torsional torque in a direction to reduce its coil diameter under a torque condition satisfying the following Expression (8):

$$\text{Angular velocity of carrier } \mathbf{59} \geqq \text{Angular velocity of ring drum } \mathbf{55} \tag{8}$$

The first spring clutch 64 firmly winds around the drum 59C of the carrier 59 and the ring drum 55, to thereby hold stationary the connection between the drum 59C and the ring drum 55.

That is, the first spring clutch 64 acts as a one-way clutch between the carrier 59 and the camshaft 52. Thereby, the first spring clutch 64 prevents the carrier 59 from making a rotation in a direction A (clockwise) relative to the camshaft 52, and allows the carrier 59 to make a rotation in the direction G (counter-clockwise) relative to the camshaft 52.

The second spring clutch 65 is wound around the drum 58C of the output gear member 58 and the output drum 53. Like the spring clutch 14 according to the first embodiment, the second spring clutch 65 is a right handed coil. The second spring clutch 65 has a first side wound around an outer periphery of the output drum 53, and a second side wound around an outer periphery of the drum 58C in the first clutch groove 58B of the output gear member 58. At an end of the second side of the second spring clutch 65, there is provided a hook 65A projecting radially outwardly.

The second spring clutch 65 is the right handed coil. Therefore, when the input gear member 58 rotates in the direction A (clockwise) in FIG. 11, the second spring clutch 65 receives a torsional torque in a direction to reduce its coil diameter under a torque condition satisfying the following Expression (9):

Angular velocity of output gear member 58≧Angular velocity of camshaft 52 (9)

The second spring clutch 65 firmly winds around the output drum 53 (follower). Thereby, the second spring clutch 65 holds stationary the connection between the drum 58C of the output gear member 58 and the output drum 53.

Contrary to this, when the output drum 53 rotates in a direction to be advanced in respect of the rotational phase relative to the output gear member 58, the second spring clutch 65 receives a torsional torque in a direction to increase its coil diameter under a torque condition satisfying the following Expression (10):

Angular velocity of output drum 53>Angular velocity of output gear member 58 (10)

The second spring clutch 65 is slightly spaced apart from the outer surface of the output drum 53. With this, the second spring clutch 65 allows the output drum 53 to be released from the drum 58C of the output gear member 38. As a result, the output drum 53 and the drum 58C rotate relative to each other.

Figure 11:
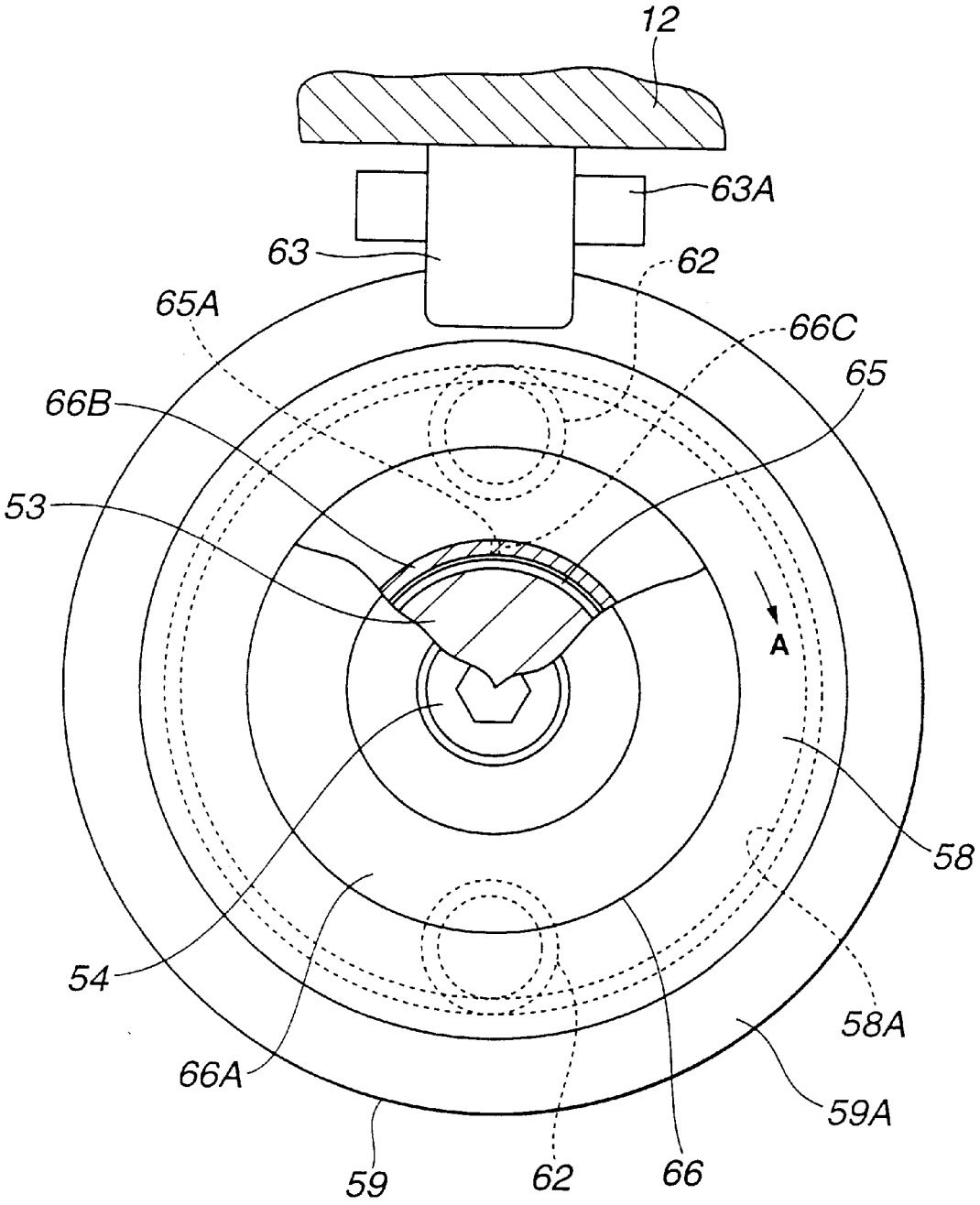
FIG. 11 is a cross sectional view of the valve timing control system taken in the direction of arrows substantially along the line XI—XI in FIG. 10.

The clutch control disk 66 is disposed around the outer periphery of the second spring clutch 65 with a minor gap therebetween. As is seen in FIGS. 11 through 12, the clutch control disk 66 has a circular disk 66A, and a cylinder 66B extending axially from an inner periphery of the disk 66A. The cylinder 66B is mated with the outer periphery of the second spring clutch 65 in such a manner as to have a play therebetween.

The cylinder 66B has an edge formed with a small cutout 66C. As is seen in FIG. 12, the cutout 66C is hooked by the hook 65A of the second spring clutch 65. The clutch control disk 66 rotates integrally with the second spring clutch 65 in the clockwise direction until a braking fore is applied to the clutch control disk 66 by a clutch releasing device 67.

Once the braking force is applied to the clutch control disk 66 by the clutch releasing device 67, the clutch control disk 66 receives a braking torque in the counter-clockwise direction. Thereby, the cutout 66C allows the hook 65A of the second spring clutch 65 to make a movement relative to the other portion of the second spring clutch 65 in the counter-clockwise direction. With this, the second spring clutch 65 on a side of the hook 65A is slightly spaced apart from the outer surface of the drum 58C of the output gear member 58. Therefore, the second spring clutch 65 allows the output drum 53 to be released from the drum 58C of the output gear member 58. As a result, the output drum 53 and the drum 58C rotate relative to each other.

The clutch releasing device 67 is fixed to the support frame 12. The clutch releasing device 67 and the clutch control disk 66 constitute clutch releasing means. Like the clutch releasing device 16 according to the first embodiment, the clutch releasing device 67 has a clutch control coil 67A.

The third embodiment ensures operations and advantages substantially the same as those of the first embodiment. Disclosed below are specifics about the operations and the advantages of the third embodiment of the present invention.

At first, when the brake control coil 63A of the solenoid brake 63 is demagnetized as is seen in Table 3 and when the driven sprocket 51 rotates in the clockwise direction, the rotational force of the driven sprocket 51 is transmitted from the internal gear 57A of the input gear member 57 to the first planet gears 61. With this, the first planet gears 61 rotate on the planet shaft 60 and revolve along the input gear member 57. The revolving force of the first planet gears 61 is transmitted to the carrier 59 as a rotational torque.

In this condition, the first spring clutch 64 receives the torsional torque in the direction to increase its coil diameter under the torque condition satisfying Expression (7). Therefore, the first spring clutch 64 is slightly spaced apart from the outer surface of the drum 57B of the input gear member 57. Thereby, the first spring clutch 64 allows the input gear member 57 and the ring drum 55 (camshaft 52) to rotate relative to each other.

However, when the revolving force from the first planet gear 61 is transmitted to the carrier 59 and when the carrier 59 begins to rotate in the direction A in FIG. 13 (clockwise), the rotation of the carrier 59 is transmitted as the torsional torque in the direction to decrease the coil diameter of the first spring clutch 64 under the torque condition satisfying Expression (8). Therefore, the first spring clutch 64 firmly winds around the ring drum 55 of the camshaft 52, to thereby hold stationary the connection between the carrier 59 and the camshaft 52.

Thereby, the first spring clutch 64 acts as a one-way clutch between the camshaft 52 and the carrier 59. With this, the first spring clutch 64 prevents the carrier 59 from making a rotation in the clockwise direction in FIG. 12 relative to the camshaft 52. Until the camshaft 52 rotates relative to the carrier 59 in the clockwise direction in FIG. 12, the first and second planet gears 61 and 62 make rotations on the planet shafts 60 without making revolutions. With this, the rotational force of the second planet gears 62 is transmitted to the output gear member 58 via the internal gear 58A.

The rotational force of the output gear member 58 is transmitted as the torsional torque in the direction to reduce the coil diameter of the second spring clutch 65 under the torque condition satisfying Expression (9). With this, the second spring clutch 65 firmly winds around the output drum 53 (follower), to thereby hold stationary the connection between the drum 58C of the output gear 58 and the output drum 53.

The second planet gears 62 are larger in the number of teeth than the first planet gears 61. Therefore, the second planet gears 62 rotate the output gear member 58 faster than the first planet gears 61 rotate the input gear member 57 by a speed difference corresponding to the difference in the number of teeth. With this, the camshaft 52 rotates integrally with the output gear member 58 in the clockwise direction. If the rotational speed of the camshaft 52 is even a little faster than that of the driven sprocket 51, the first spring clutch 64 receives the torsional torque in the direction to reduce its coil diameter under the torque condition satisfying the following Expression (11):

Angular velocity of camshaft 52≧Angular velocity of driven sprocket 51 (11)

As a result, the camshaft 52 rotates integrally with the output gear member 58 in the clockwise direction, and the rotational force of the driven sprocket 51 is transmitted to the camshaft 52 via the sun-and-planet gear set 56 and the second spring clutch 65. During this period, the camshaft 52 rotates while keeping the rotational phase thereof relative to the driven sprocket 51 (phase holding control).

TABLE 3

| | Phase holding control | Retarded angle control | Advanced angle control |
|---|---|---|---|
| Solenoid brake 63 | Inoperative (Demagnetized) | Inoperative (Demagnetized) | Operative (Magnetized) |
| Clutch releasing device 67 | Inoperative (Demagnetized) | Operative (Magnetized) | Inoperative (Demagnetized) |
| First spring clutch 64 | Held | Released | Released |
| Second spring clutch 65 | Held | Released | Held |

In this phase holding condition, the internal gear 57A meshes with the first planet gears 61 while the internal gear 58A meshes with the second planet gears 62. Tooth faces of the internal gears 57A and 58A keep contacting, respectively, those of the first and second planet gears 61 and 62, and the first and second spring clutches 64 and 65 are put in a stationary holding condition. Thereby, even if the alternating torque (between positive and negative) shown in FIG. 31 is applied to the camshaft 52, the first and second spring clutches 64 and 65 keep the stationary holding condition. That is, this arrangement preferably prevents problems caused by the backlash, and suppresses any hammering noise between the tooth faces which noise may be caused when the alternating torque is applied.

Next, when the clutch releasing device 67 is operated under this condition as is seen in Table 3 in order to apply a braking torque to the clutch control disk 66 in the counter-clockwise direction in FIG. 11, the cutout 66C allows the hook 65A of the second spring clutch 65 to make a movement relative to the other portion of the second spring clutch 65 in the counter-clockwise direction in FIG. 11. With this, the phase holding condition by the second spring clutch 65 is released. Thereby, the torque is not transmitted between the drum 58C of the output gear member 58 and the output drum 53.

As a result, when the clutch releasing device 67 is in operation, the rotational torque from the driven sprocket 51 is not transmitted to the camshaft 52 via the sun-and-planet gear set 56. And the phase holding condition by the first spring clutch 64 is also released. Thus, the camshaft 52 is retarded in respect of the rotational phase relative to the driven sprocket 51. Therefore, canceling the operation of the clutch releasing device 67 achieves an automatic recovery of the phase holding control.

Next, when the brake control coil 63A of the solenoid brake 63 is magnetized as is seen in Table 3, the carrier 59 receives a rotational toque (barking force) in the counter-clockwise direction in FIG. 11. With this, the hook 64A of the first spring clutch 64 receives the braking force in the direction G in FIG. 13 from the carrier 59. Then, the first spring clutch 64 on the side of the hook 64A is slightly spaced apart from the outer surface of the drum 59C. Consequently, the first spring clutch 64 releases the phase holding condition between the carrier 59, the ring drum 55 (camshaft 52) and the input gear member 57.

Under this condition, the second spring clutch 65 allows the output drum 53 to be held stationary to the output gear member 58. Therefore, the camshaft 52 rotates faster than the input gear member 57 by the speed difference corresponding to the teeth difference between the first planet gears 61 and the second planet gears 62. With this, the camshaft 52 is advanced in respect of the rotational phase relative to the driven sprocket 51. Thereafter, canceling the operation of the solenoid brake 63 achieves the automatic recovery of the phase holding control.

Figure 14:
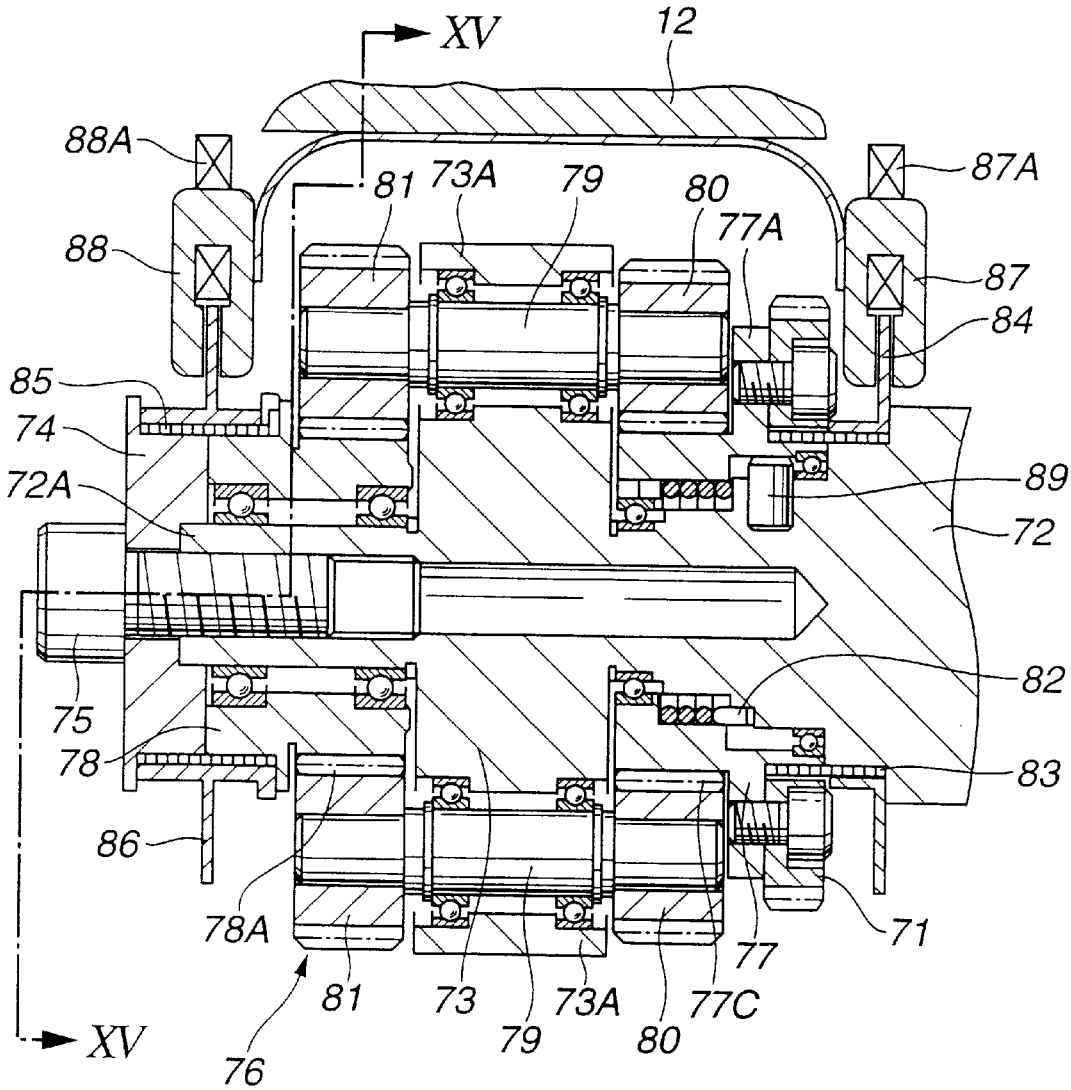
FIG. 14 is a cross section showing the valve timing control system, according to a fourth embodiment of the present invention.
Figure 15:
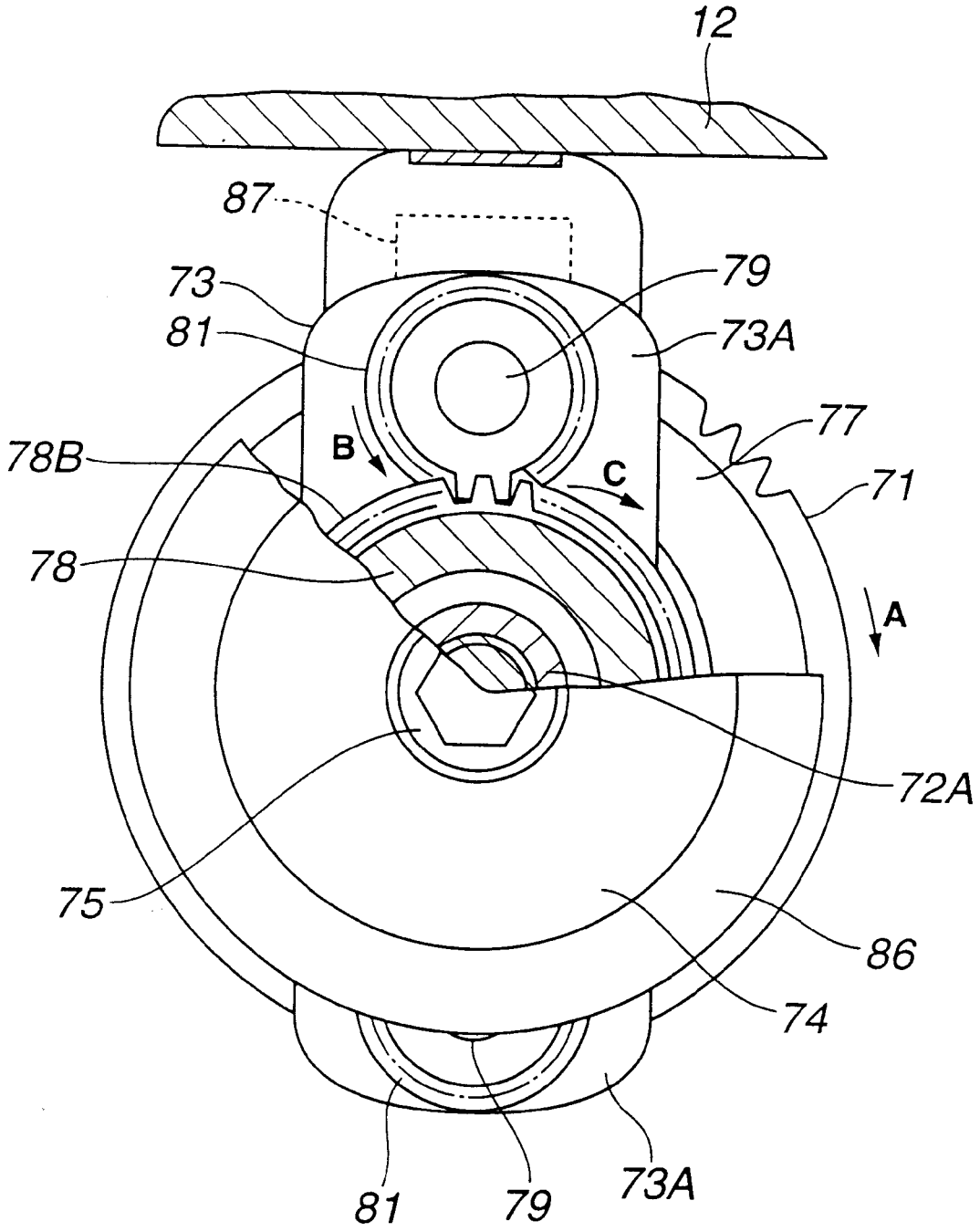
FIG. 15 is a cross sectional view of the valve timing control system taken in the direction of arrows substantially along the line XV—XV in FIG. 14.
Figure 16:
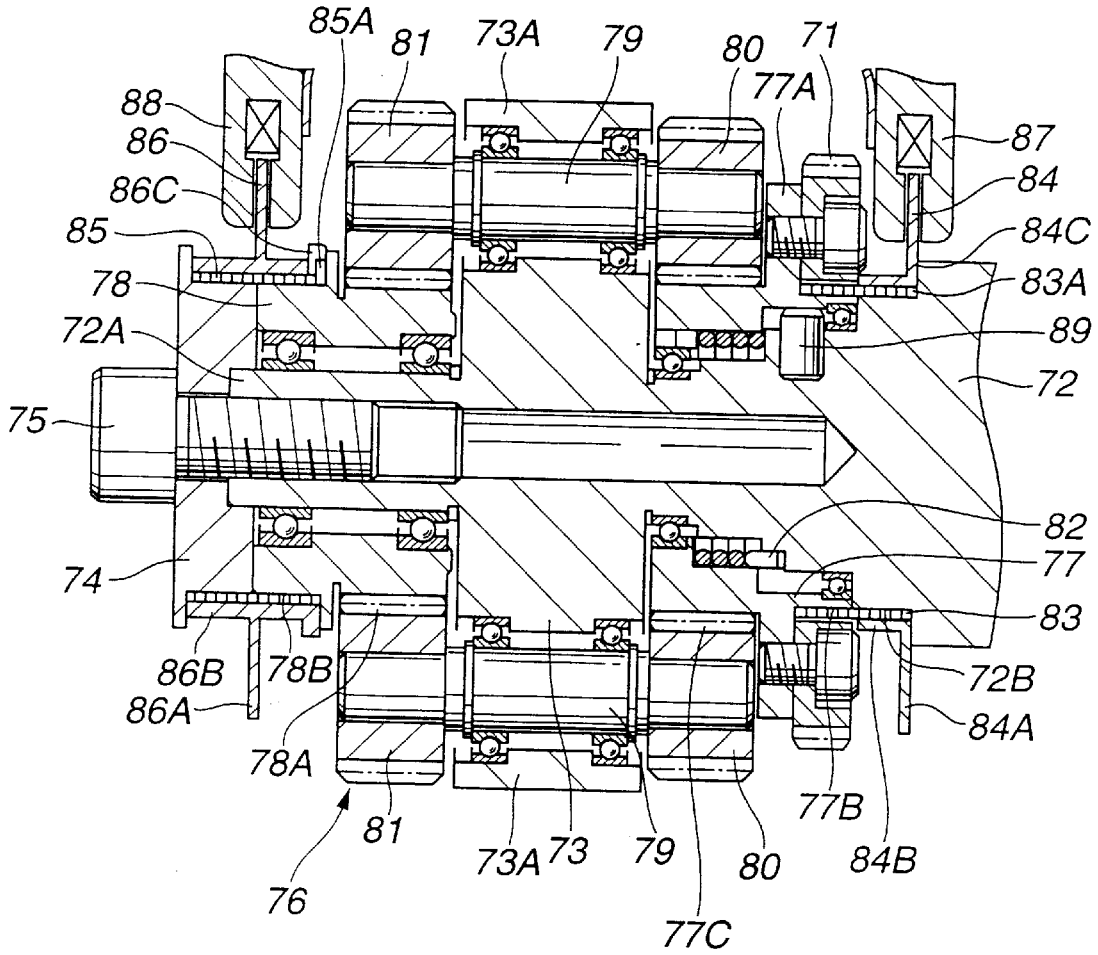
FIG. 16 is an enlarged cross sectional view showing an essential part of the valve timing control system in FIG. 14.

FIGS. 14 through 16 show a fourth embodiment of the present invention. In the fourth embodiment, a plurality of spring clutches are used in order to stabilize the holding condition of the rotational phase. Moreover, a sun-and-planet gear set is used for carrying out an accurate switching control between the phase holding condition, the retarded angle control condition and the advanced angle control condition. In the fourth embodiment, the elements same as those in the first embodiment have the same numerals. Therefore, repeated explanations for the same elements are omitted herein.

A driven sprocket 71 acting as a rotor has the constitution substantially the same as that of the driven sprocket 1 in the first embodiment.

A camshaft 72 has the constitution almost the same as that of the camshaft 2 in the first embodiment, and has a small diameter portion 72A. The camshaft 72 has, at a bottom end of the small diameter portion 72A, a drum 72B circular in shape. The drum 72B has an outer diameter substantially the same as that of a drum 77B of an input gear member 77. A first spring clutch 83 is installed around the drum 72B and the drum 77B, and allows the drum 72B to be held stationary to the drum 77B and released from the drum 77B.

A carrier 73 is integrally disposed at an axially middle portion of the small diameter portion 72A of the cam shaft 72. The carrier 73 rotatably supports a pair of first planet gears 80 and a pair of second planet gears 81 via a pair of planet shafts 79. As is seen in FIG. 15, the carrier 73 is a block substantially rectangular in shape. The carrier 73 has a pair of shaft supports 73A which extend in the direction perpendicular to the axial direction of the cam shaft 72, as shown in FIG. 15. Each of the shaft supports 73A rotatably supports one of the planet shafts 79.

An output drum 74 constitutes a part of the camshaft 72. The output drum 74 is tightened at a head end of the small diameter portion 72A of the camshaft 72 with a bolt 75. Therefore, the output drum 74 rotates integrally with the camshaft 72. The output drum 74 has an outer diameter substantially the same as that of a drum 78B of an output gear member 78. A second spring clutch 85 is disposed around the drum 78B and the output drum 74 to allow the output drum 74 to be held stationary to the drum 78B and released from the drum 78B.

A sun-and-planet gear set 76 is disposed between the driven sprocket 71 and the camshaft 72. The sun-and-planet gear set 76 acts as a rotational phase controller for variably controlling rotational phases. The sun-and-planet gear set 76 also acts as a holding force generator for the first spring clutch 83 and the second spring clutch 85. The sun-and-planet gear set 76 has the input gear member 77, the output gear member 78, the planet shafts 79, the pair of first planet gears 80 and the pair of second planet gears 81.

The input gear member 77 acts as a first rotary member of the sun-and-planet gear set 76. The input gear member 77 is formed into a stepped cylinder. The input gear member 77 is rotatably disposed around an outer periphery of the small diameter portion 72A of the camshaft 72 via bearings. Around an outer periphery of the input gear member 77, there is integrally provided a flange 77A circular in shape. The driven sprocket 71 is fixed to the flange 77A with bolts.

The input gear member 77 rotates integrally with the driven sprocket 71 around the outer periphery of the small diameter portion 72A. Moreover, around the outer periphery of the input gear member 77, there are provided the drum 77B of a circular shape and the external gear 77C acting as a first gear in such a manner as to interpose therebetween the flange 77A in the axial direction.

The output gear member 78 acts as a rotatable transmission or a second rotary member of the sun-and-planet gear set 76. The output gear member 78 is formed into a stepped cylinder. The output gear member 27 is rotatably disposed, around the outer periphery of the small diameter portion 72A of the camshaft 72 via bearings. Around an outer periphery of the output gear member 78, there are integrally provided an external gear 78A and the drum 78B spaced apart from each other in the axial direction. The external gear 78A acts as a second gear, and the drum 78B is circular.

A pair of planet shafts 79 are rotatably disposed at the shaft supports 73A, respectively. Each of the planet shafts 79 has first and second ends projecting from the shaft support 73A. The first end of the planet shaft 79 is integrated with the first planet gear 80. The second end of the planet shaft 79 is integrated with the second planet gear 81.

The first planet gears 80 mesh with the external gear 77C of the input gear member 77, and transmit a rotational torque from the driven sprocket 71 to the planet shaft 79. The second planet gears 81 mesh with the external gear 78A of the output gear member 78, and transmit the rotational torque from the planet shaft 79 to the output gear member 78. Moreover, the second planet gears 81 are larger in the number of teeth than the first planet gears 80. The difference in the number of teeth between the first and second planet gears 80 and 81 causes an increased speed as follows: The output gear member 78 rotates faster than the input gear member 77 (driven sprocket 71) by a speed difference corresponding to the difference in the number of teeth between the first and second planet gears 80 and 81.

A torsional spring 82 is disposed between the small diameter portion 72A of the camshaft 72 and the input gear member 77. The torsional spring 82 acts as a biasing means. That is, when a phase difference is caused between the camshaft 72 and the input gear member 77, the torsional spring 82 stores as a biasing force a spring force corresponding to the phase difference. Then, the torsional spring 82 applies to the camshaft 72 and the input gear member 77 a torque working in a direction to reduce the phase difference.

The first spring clutch 83 is wound around the drum 72B and the drum 77B of the input gear member 77. Like the spring clutch 14 according to the first embodiment, the first spring clutch 83 is a right handed coil. The first spring clutch 83 has a first side wound around the outer periphery of the drum 77B, and a second side wound around an outer periphery of the drum 72B. At an end of the second side of the first spring clutch 83, there is provided a hook 83A projecting radially outwardly. Therefore, when the input gear member 77 rotates integrally with the driven sprocket 71 in the direction A (clockwise) in FIG. 15, the first spring clutch 83 of a right handed coil receives a torsional torque in a direction to increase its coil diameter under a torque condition satisfying the following Expression (12):

$$\text{Angular velocity of driven sprocket } \mathbf{71} > \text{Angular velocity of camshaft } \mathbf{72} \quad (12)$$

With this, the first spring clutch 83 is slightly spaced apart from the outer periphery of the drum 77B, and therefore, the first spring clutch 83 allows the drum 72B of the camshaft 72 to be released from the drum 77B of the input gear member 77. As a result, the drum 72B and the drum 77B rotate relative to each other.

Contrary to this, when the camshaft 72 rotates in a direction to be advanced in respect of the rotational phase relative to the driven sprocket 71 and the input gear member 77, the first spring clutch 83 receives a torsional torque in a direction to reduce its coil diameter under a torque condition satisfying the following Expression (13):

$$\text{Angular velocity of camshaft } \mathbf{72} \geqq \text{Angular velocity of driven sprocket } \mathbf{71} \quad (13)$$

With this, the first spring clutch 83 firmly winds around an area defined between the drum 72B and the drum 77B. Thereby, the first spring clutch 83 holds stationary the connection between the drum 72B and the drum 77B.

A first clutch control disk 84 is disposed around an outer periphery of the first spring clutch 83 with a minor gap therebetween. As is seen in FIG. 16, the first clutch control disk 84 has a circular disk 84A, and a cylinder 84B extending axially from an inner periphery of the disk 84A. The cylinder 84B is mated with the outer periphery of the first spring clutch 83 in such a manner as to have a play therebetween.

The first clutch control disk 84 has a small cutout 84C at an edge (corner) defined between the disk 84A and the cylinder 84B. The cutout 84C has a cross section shaped into a right-angled "U." The cutout 84C is hooked by a hook 83A of the first spring clutch 83. The first clutch control disk 84 rotates integrally with the first spring clutch 83 in the direction A (clockwise) until a braking force is applied to the first clutch control disk 84 by a first clutch releasing device 87.

Once the braking force is applied to the first clutch control disk 84 by the first clutch releasing device 87, the first clutch control disk 84 receives a braking torque in the counterclockwise direction in FIG. 15. Thereby, the cutout 84C of the first clutch control disk 84 allows the hook 83A of the first spring clutch 83 to make a movement relative to the other portion of the first spring clutch 83 in the counterclockwise direction. With this, the first spring clutch 83 on a side of the hook 83A is slightly spaced apart from the outer surface of the drum 72B. The first spring clutch 83, therefore, allows the camshaft 72 to be released from the input gear member 77. As a result, the camshaft 72 and the input gear member 77 can rotate relative to each other.

The second spring clutch 85 is wound around the drum 78B of the output gear member 78 and the output drum 74. The second spring clutch 85 is a right handed coil. The second spring clutch 85 has a first side wound around an outer periphery of the output drum 74, and a second side wound around an outer periphery of the drum 78B of the output gear member 78. At an end of the second side of the second spring clutch 85, there is provided a hook 85A projecting radially outwardly.

Therefore, when the input gear member 78 rotates in the direction A (clockwise) in FIG. 15, the second spring clutch 85 of the right handed coil receives a torsional torque in a direction to decrease its coil diameter under a torque condition satisfying the following Expression (14):

$$\text{Angular velocity of output gear member } \mathbf{78} \geqq \text{Angular velocity of camshaft } \mathbf{72} \quad (14)$$

With this, the second spring clutch 85 firmly winds around the output drum 74 (follower), to thereby hold stationary the area between the drum 78B of the output gear member 78 and the output drum 74.

Contrary to this, when the output drum 74 rotates in a direction to be advanced in respect of the rotational phase relative to the output gear member 78, the second spring clutch 85 receives a torsional torque in a direction to increase its coil diameter under a torque condition satisfying the following Expression (15):

Angular velocity of output drum 74>Angular velocity of output gear member 78 (15)

With this, the second spring clutch 85 is slightly spaced apart from the outer surface of the output drum 74, to thereby allow the output drum 74 to be released from the drum 78B of the output gear member 78. As a result, the output drum 74 and the drum 78B can rotate relative to each other.

A second clutch control disk 86 is disposed around an outer periphery of the second spring clutch 85 with a minor gap therebetween. As is seen in FIG. 16, the second clutch control disk 86 has a cross section shaped into "T." The second clutch control disk 86 has a circular disk 86A, and a cylinder 86B extending axially. The cylinder 86B of the second clutch control disk 86 is mated with the outer periphery of the second spring clutch 85 in such a manner as to have a play therebetween.

The cylinder 86B has, at an edge thereof, a small cutout 86C. As is seen in FIG. 16, the cutout 86C is hooked by a hook 85A of the second spring clutch 85. The second clutch control disk 86 rotates integrally with the second spring clutch 85 in the clockwise direction in FIG. 15 until a braking force is applied to the second control disk 86 by a second clutch releasing device 88.

Once the braking force is applied to the second clutch control disk 86 by the second clutch releasing device 88, the second clutch control disk 86 receives a braking torque in a counter-clockwise direction. Thereby, the cutout 86C allows the hook 85A of the second spring clutch 85 to make a movement relative to the other portion of the second spring clutch 85 in the counter-clockwise direction. With this, the second spring clutch 85 in the vicinity of the hook 85A is slightly spaced apart from the outer surface of the drum 78B of the output gear member 78. Therefore, the second spring clutch 85 allows the output drum 74 to be released from the drum 78B. As a result, the output drum 74 and the drum 78B can rotate relative to each other.

The first and second clutch releasing devices 87 and 88 are fixed to the support frame 12. The first and second clutch releasing devices 87 and 88, respectively with the first and second control disks 84 and 86, constitute first and second clutch releasing means. Like the clutch releasing device 16 according to the first embodiment, the first and second clutch releasing devices 87 and 88 have respectively clutch control coils 87A and 88A.

A stopper pin 89 is fixedly disposed at the small diameter portion 72A of the camshaft 72. The stopper pin 89 projects radially outwardly from the bottom end of the small diameter portion 72A, and is engageable with an inner periphery of the input gear member 77. The stopper pin 89 restricts the rotation of the camshaft 72 relative to the input gear member 77 within a predetermined range of angle, to thereby determine the maximum phase differences of the camshaft 72 for the retarded angle control, and the advanced angle control relative to the driven sprocket 71.

The fourth embodiment ensures operations and advantages substantially the same as those of the first embodiment. Disclosed below are specifics about the operations and the advantages of the fourth embodiment of the present invention.

At first, when a driving force is applied from the internal combustion engine to the driven sprocket 71, the driven sprocket 71 is rotated in the direction A (clockwise) in FIG. 15. The rotational force of the driven sprocket 71 is transmitted from the external gear 77C of the input gear member 77 to the first planet gears 80. The rotational force of the first planet gears 80 is transmitted to the second planet gears 81 via the planet shafts 79. The rotation of the second planet gears 81 transmits to the output gear member 78 the rotational torque in the clockwise direction in FIG. 15.

In this condition, the first spring clutch 83 receives the torsional torque in the direction to increase its coil diameter under the torque condition satisfying Expression 12. With this, the fist spring clutch 83 is slightly spaced apart from the outer surface of the drum 77B, to thereby allow the input gear member 77 and the camshaft 72 to rotate relative to each other. Then, the rotation of the output gear member 78 is transmitted as the torsional torque in the direction to reduce the coil diameter of the second spring clutch 85 under the torque condition satisfying Expression (14). With this, the second spring clutch 85 firmly winds around the output drum 74 (follower), to thereby hold stationary the area between the drum 78B of the output gear member 78 and the output drum 74.

The second planet gears 81 are larger in the number of teeth than the first planet gears 80. Therefore, the second planet gears 81 rotate the output gear member 78 faster than the first planet gears 80 rotate the input gear member 77 by a speed difference corresponding to the difference in the number of teeth. With this, the camshaft 72 rotates integrally with the output gear member 78 in the clockwise direction. If the rotational speed of the camshaft 22 integrally with the output gear member 78 becomes even a little faster than that of the driven sprocket 71, the first spring clutch 83 receives the torsional torque in the direction to reduce its coil diameter under the torque condition satisfying Expression (13). With this, the first spring clutch 83 firmly winds around the drum 72B and the drum 77B, to thereby hold stationary the drum 72B and the drum 77B.

As a result, the camshaft 72 integrally rotates with the output gear 78 in the clockwise direction in FIG. 15, and the rotational force of the driven sprocket 71 is transmitted to the camshaft 72 via the sun-and-planet gear set 76 and the second spring clutch 85. During this period, the camshaft 72 rotates while keeping the rotational phase thereof relative to the driven sprocket 71 (phase holding control).

TABLE 4

| | Phase holding control | Retarded angle control | Advanced angle control |
|---|---|---|---|
| First clutch releasing device 87 | Inoperative (Demagnetized) | Inoperative (Demagnetized) | Operative (Magnetized) |
| Second clutch releasing device 88 | Inoperative (Demagnetized) | Operative (Magnetized) | Inoperative (Demagnetized) |
| First spring clutch 83 | Held | Released | Released |
| Second spring clutch 85 | Held | Released | Held |

In this condition, the external gear 77C meshes with the first planet gears 80 while the external gear 78A meshes with the second planet gears 81. Tooth faces of the external gears 77C and 78A keep contacting, respectively, those of the first and second planet gears 80 and 81, and the first and second spring clutches 83 and 85 hold stationary each other. Thereby, even when the alternating torque (between positive and negative) shown in FIG. 31 is applied to the camshaft 72, the first and second spring clutches 83 and 85 keep holding stationary with each other. This stationary connection via the first and second spring clutches 83 and 85 solves problems due to the backlash, and suppresses any hammering noise between the tooth faces which noise is caused when the alternating torque is applied.

Next, when the second clutch releasing device 88 is operated under this condition as is seen in Table 4 in order to apply the braking torque to the second clutch control disk 86 in the counter-clockwise direction, the cutout 86C allows the hook 85A of the second spring clutch 85 to make a movement relative to the other portion of the second spring clutch 85 in the counter-clockwise direction. With this, the holding condition by the second spring clutch 85 is released. Thereby, the torque is not transmitted between the drum 78B of the output gear member 78 and the output drum 74.

As a result, when the second clutch releasing device 88 is in operation, the rotational torque from the driven sprocket 71 is not transmitted to the camshaft 72 via the sun-and-planet gear set 76. And the holding condition by the first spring clutch 83 is also released. Thus, the camshaft 72 is retarded in respect of the rotational phase relative to the driven sprocket 71.

Under this condition, the torsional spring 82 stores as the torsional torque (biasing force) the spring force corresponding to the phase difference between the driven sprocket 71 and the camshaft 72. Thereafter, canceling the operation of the second clutch releasing device 88 achieves an automatic recovery of the phase holding control in a condition maintaining the phase difference of the advanced angle condition.

Next, when the first clutch releasing device 87 is magnetized while the second clutch releasing device 88 is demagnetized as is seen in Table 4, the first clutch control disk 84 receives a braking torque in the counter-clockwise direction. With this, the first spring clutch 83 in the vicinity of the hook 83A is slightly spaced apart from the outer surface of the drum 72B, to thereby allow the camshaft 72 to be released from the input gear member 77.

Then, the torsional torque stored by the torsional spring 82 allows the camshaft 72 to be advanced in respect of the rotational phase relative to the input gear member 77 from the retarded condition to the neutral condition. Thereafter, canceling the operation of the first clutch releasing device 87 achieves the automatic recovery of the phase holding control condition.

Furthermore, it is certain that the advanced angle control can be achieved in a manner that the camshaft 72 rotates faster than the input gear member 77 by the speed difference corresponding to the teeth difference between the first and second planet gears 80 and 81. With this, the camshaft 72 is advanced in respect of the rotational phase relative to the driven sprocket 71.

Figure 17:
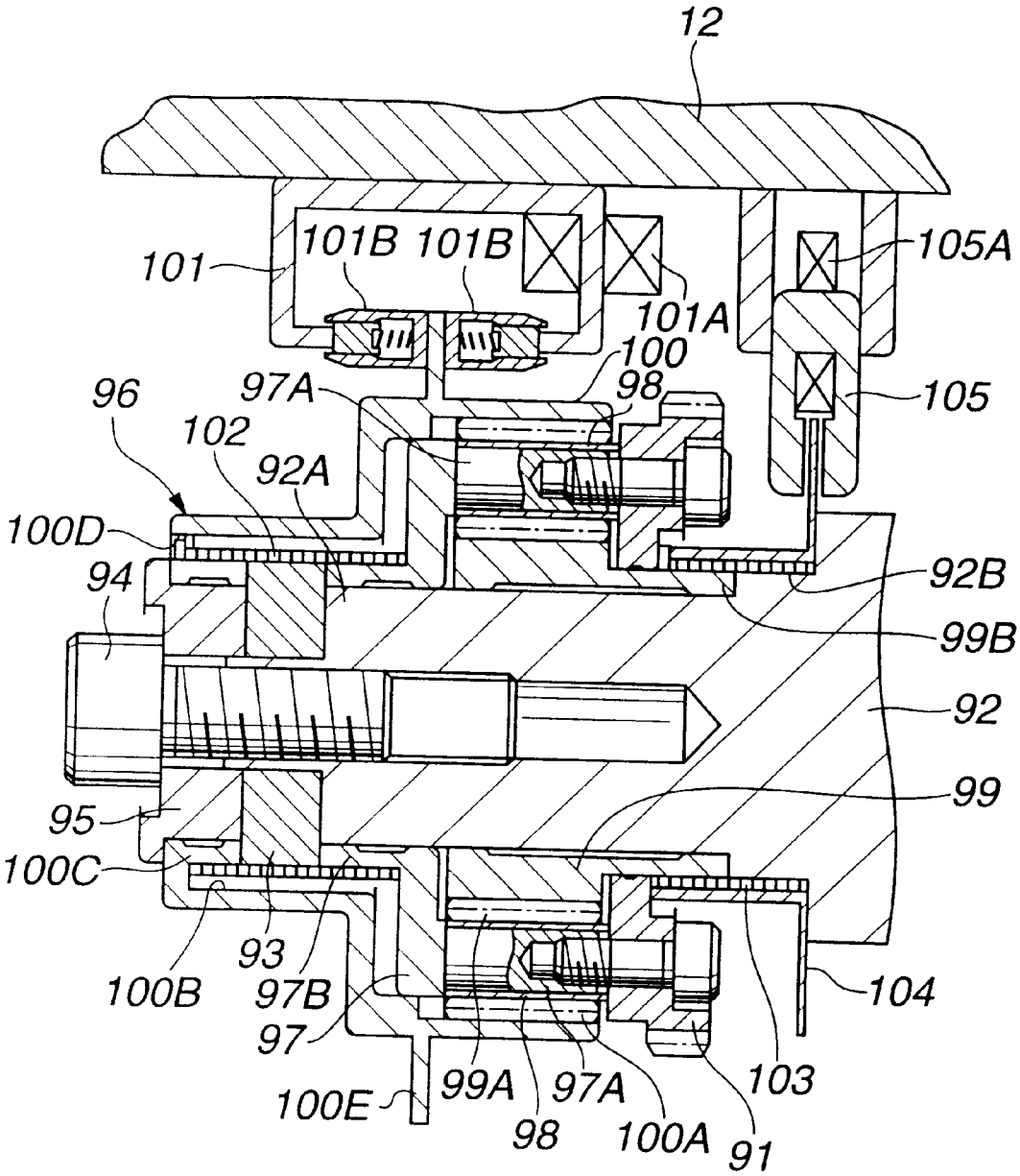
FIG. 17 is a cross sectional view showing the valve timing control system, according to a fifth embodiment of the present invention.
Figure 18:
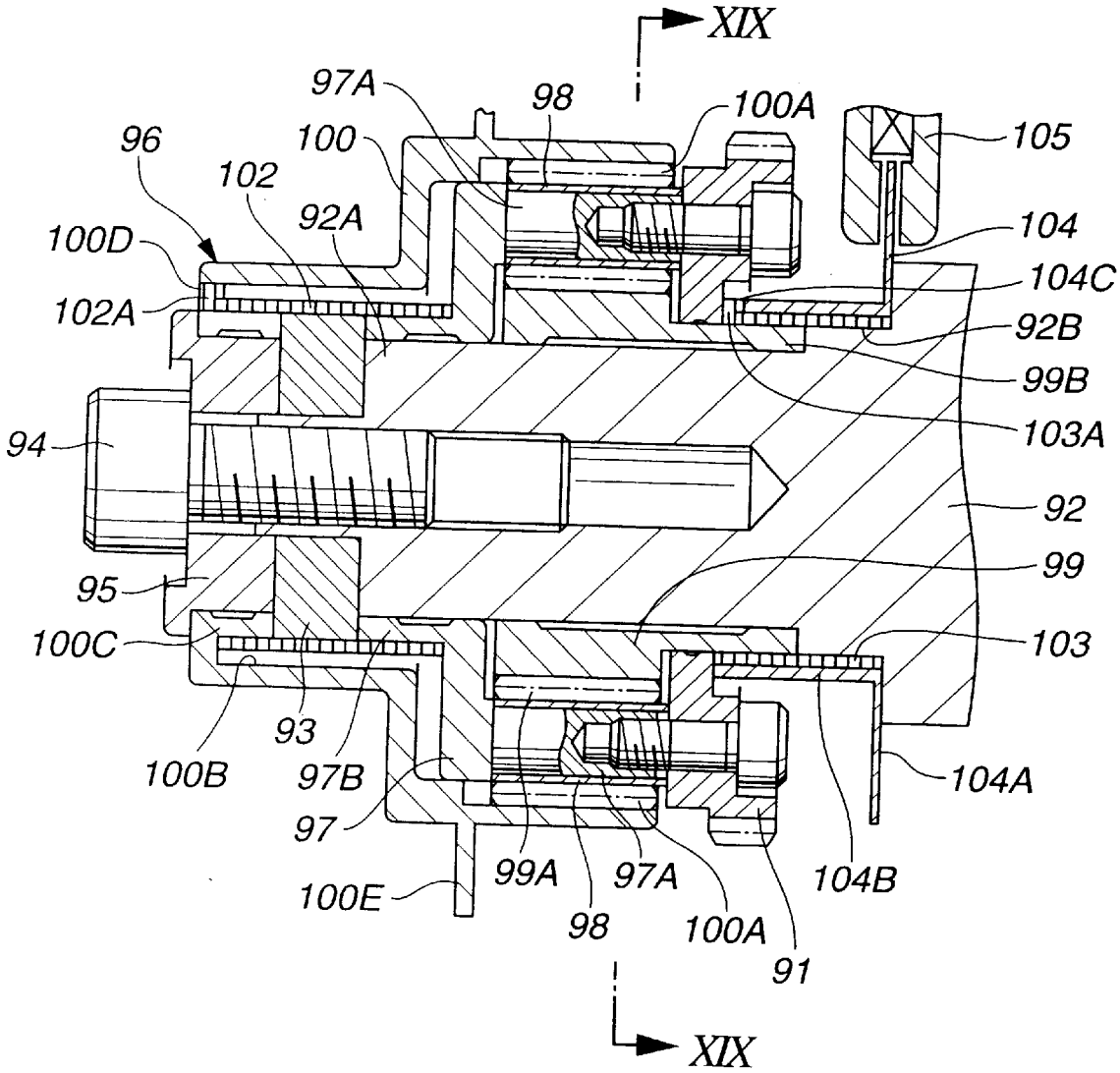
FIG. 18 is an enlarged cross sectional view showing an essential part of the valve timing control system in FIG. 17.
Figure 19:
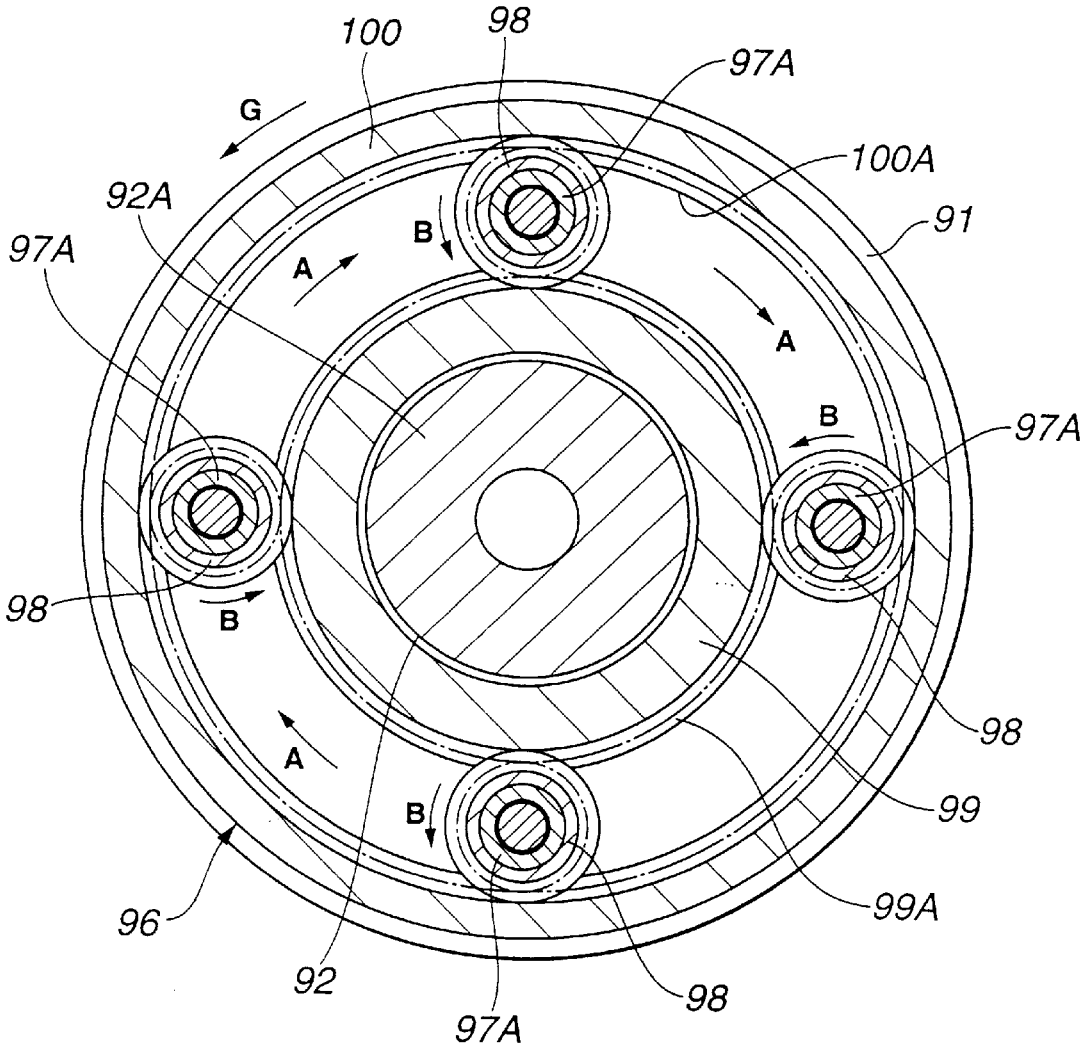
FIG. 19 is a cross section of the valve timing control system taken in the direction of arrows substantially along the line XIX—XIX in FIG. 18.
Figure 20:
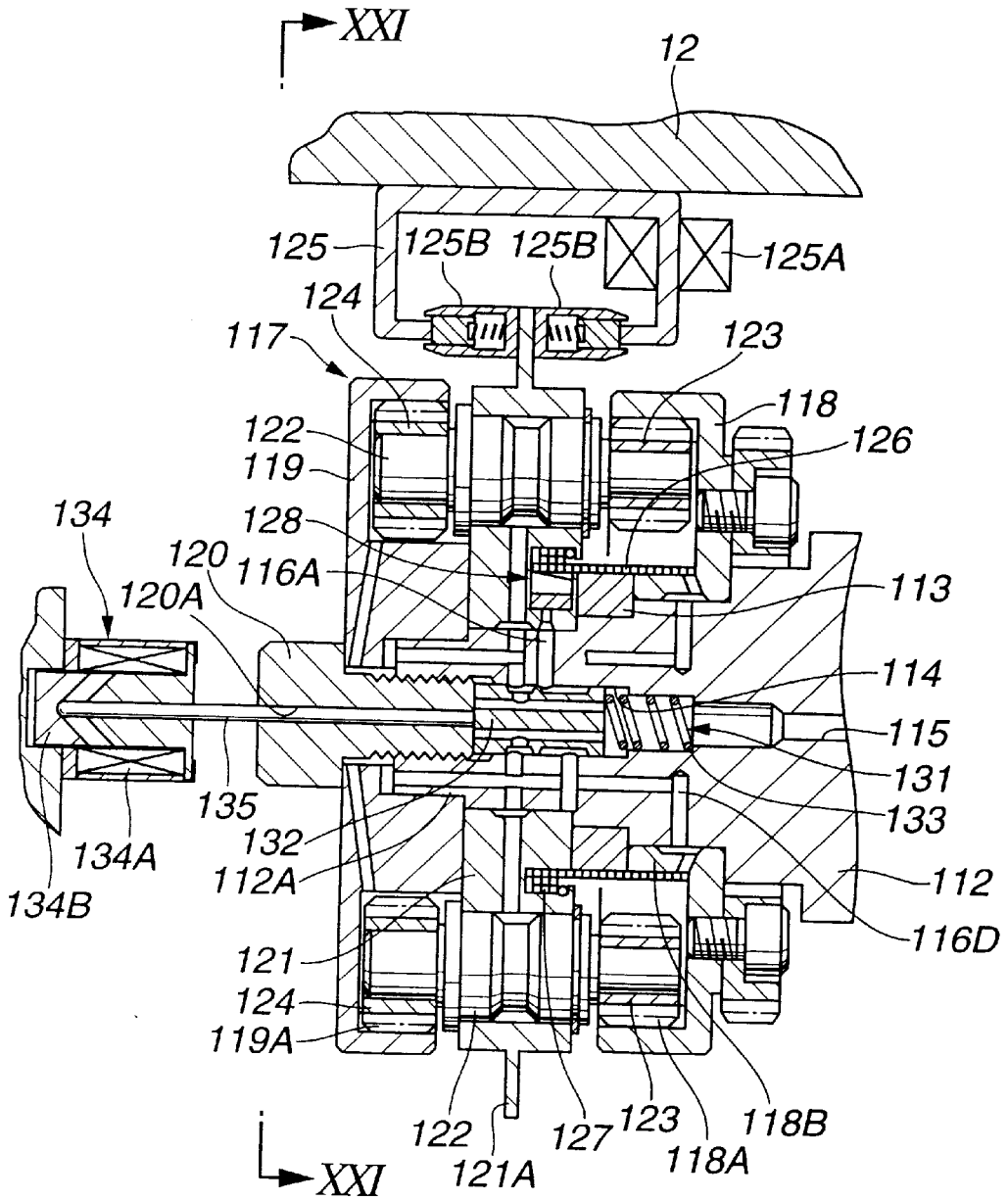
FIG. 20 is a cross sectional view showing the valve timing control system, according to a sixth embodiment of the present invention.

FIGS. 17 through 19 show the valve timing control system, according to a fifth embodiment of the present invention.

In the fifth embodiment, a plurality of spring clutches are used in order to stabilize the holding control of the rotational phase. Moreover, one of the spring clutches is used as a one-way clutch. The valve timing control system of the fifth embodiment is simple in constitution, and enables the switching between the phase holding control, the advanced angle control and the retarded angle control to be accurately carried out. The elements same as those in the first embodiment have the same numerals. Therefore, repeated explanations for the same elements are omitted in the fifth embodiment.

A driven sprocket 91 acting as a rotor has the constitution substantially the same as that of the driven sprocket 1 in the first embodiment.

A camshaft 92 has the constitution almost the same as that of the camshaft 2 in the first embodiment. Furthermore, the camshaft 92 has a stepped portion 92A having a plurality of stepped portions. The diameter of the stepped portion 92A becomes smaller stepwise in a direction toward a head end of the camshaft 92.

A circular drum 92B is integrally disposed at a bottom end of the stepped portion 92A of the camshaft 92. The drum 92B has an outer diameter substantially the same as that of a drum 99B of a sun gear 99. A second spring clutch 103 is installed around the drum 92B and the drum 99B, and allows the drum 92B to be held stationary to the drum 99B and released from the drum 99B.

An output drum 93 constitutes a part of the camshaft 92. The output drum 93 is tightened at the head end of the stepped portion 92A of the camshaft 92 via a support ring 95 by means of a bolt 94. The output drum 93 rotates integrally with the camshaft 92. The output drum 93 has an outer diameter substantially the same as those of a drum 97B of a carrier 97 and a drum 100C of an output gear member 100. A first spring clutch 102 is installed around the output drum 93, the drum 97B and the drum 100C, and allows the output drum 93 to be held stationary to the drums 97B and 100C and released from the drums 97B and 100C.

A sun-and-planet gear set 96 is disposed between the driven sprocket 91 and the camshaft 92. The sun-and-planet gear set 96 acts as a rotational phase controller for variably controlling rotational phases. The sun-and-planet gear set 96 also acts as a holding force generator for the first spring clutch 102 and a second spring clutch 103. The sun-and-planet gear set 96 has the carrier 97, four planet gears 98, the sun gear 99 and the output gear member 100.

The carrier 97 acts as a first rotary member of the sun-and-planet gear set 96. The carrier 97 is formed into a ring shape which has a cross section shaped into "L," and is rotatably disposed around an outer periphery of the stepped portion 92A of the camshaft 92. As is seen in FIG. 19, four shaft supports 97A are integrally disposed on a circular surface of the carrier 97 disposed at substantially ninety degrees. Around an outer periphery of the stepped portion 92A, the four shaft supports 97A rotatably support the four planet gears 98, respectively.

The driven sprocket 91 is fixed to an end of each of the four shaft supports 97A by means of four bolts. With this, the carrier 97 rotates integrally with the driven sprocket 91 around the outer periphery of the stepped portion 92A in a direction A (clockwise) in FIG. 19. Moreover, the carrier 97 has, at a radially inner side thereof, the cylindrical drum 97B projecting axially in the direction opposite to the shaft support 97A. The drum 97B is rotatably disposed around an outer periphery of the stepped portion 92A.

The sun gear 99 acts as a second rotary member of the sun-and-planet gear set 96. The sun gear 99 is positioned between the drum 92B of the camshaft 92 and the drum 97B of the carrier 97, and is disposed around the outer periphery of the stepped portion 92A of the camshaft 92. Moreover, the sun gear 99 has an external gear 99A and the circular drum 99B axially spaced from each other. The external gear 99A acts as a first gear, and meshes with each of the planet gears 98.

The output gear member 100 acts as a third rotary member of the sun-and-planet gear set 96. The output gear member 100 is formed into a ring shape, and has a cross section shaped into a crank. The output gear member 100 is rotatably disposed around outer peripheries of the support ring 95 and the carrier 97. On a further side radially outwardly of the output gear member 100, there is formed an internal gear 100A which acts as a second gear. As is seen in FIG. 19, the internal gear 100A meshes with each of the planet gears 98.

On a nearer side radially outwardly of the output gear member 100, there is provided a clutch groove 100B extending like a ring around an entire inner circumference of the output gear member 100. There is provided the circular drum 100C inside the clutch groove 100B. The first spring clutch 102 is housed in the clutch groove 100B. The first spring clutch 102 is disposed around the drum 97B, the output drum 93 and the drum 100C. Moreover, the output gear member 100 has a cutout 100D between the clutch groove 100B and the drum 100C. The cutout 100D is hooked with a hook 102A of the first spring clutch 102.

On an outer periphery of the output gear member 100, there is integrally formed a circular disk 100E projecting radially outwardly. When a braking force is applied from a solenoid brake 101 to the disk 100E, the disk 100E varies rotational speeds of the output gear member 100 according to the magnitude of the braking force.

The solenoid brake 101 acts as a rotational speed adjuster fixed to a support frame 12. Like the solenoid brake 13 according to the first embodiment, the solenoid brake 101 has a brake control coil 101A and a pair of dampers 101B.

The first spring clutch 102 is wound around between the drum 100C of the output gear member 100, the output drum 93 and the drum 97B of the carrier 97. Like the first spring clutch 64 shown in FIG. 13, the first spring clutch 102 is a left handed coil. In the clutch groove 100B of the output gear member 100, the first spring clutch 102 has a first side wound around the outer periphery of the drum 100C, a middle portion wound around the outer periphery of the output drum 93, and a second side wound around the outer periphery of the drum 97B of the carrier 97. The first spring clutch 102 has, on the first side thereof, the hook 102A projecting radially outwardly. The hook 102A is hooked with the cutout 100D of the output gear member 100.

Therefore, when the carrier 97 rotates in the direction A (clockwise) in FIG. 19, the first spring clutch 102 of a left handed coil receives a torsional torque in a direction to increase its coil diameter under a torque condition satisfying the following Expression 16:

$$\text{Angular velocity of carrier } \mathbf{97} > \text{Angular velocity of camshaft } \mathbf{92} \quad (16)$$

With this, the first spring clutch 102 is slightly spaced apart from the outer surface of the output drum 93, and the first spring clutch 102 allows the drum 97B to be released from the output drum 93. As a result, the drum 97B and the output drum 93 rotate relative to each other.

Contrast to this, when the output gear member 100 rotates in the direction A in FIG. 19, the first spring clutch 102 receives a torsional torque in a direction to reduce its coil diameter under a torque condition satisfying the following Expression 17:

$$\text{Angular velocity of output gear member } \mathbf{100} \geqq \text{Angular velocity of camshaft } \mathbf{92} \quad (17)$$

With this, the first spring clutch 102 firmly winds around the output drum 93. Thereby, the first spring clutch 102 holds stationary the connection between the drum 100C of the output gear member 100 and the output drum 93.

The hook 102A of the first spring clutch 102 is hooked with the cutout 100D of the output gear member 100. Therefore, when the camshaft 92 (output drum 93) rotates in a direction to be advanced in respect of the rotational phase relative to the output gear member 100, the first spring clutch 102 receives a torsional torque in a direction to increase its coil diameter under a torque condition satisfying the following Expression 18:

$$\text{Angular velocity of camshaft } \mathbf{92} > \text{Angular velocity of output gear member } \mathbf{100} \quad (18)$$

With this, the first spring clutch 102 is slightly spaced apart from the outer surface of the output drum 93, to thereby allow the output drum 93 to be released from the drum 100C. As a result, the output drum 93 and the drum 100C can rotate relative to each other.

Therefore, the first spring clutch 102 acts as a one-way clutch between the output gear member 100 and the camshaft 92. Thereby, the first spring clutch 102 prevents the output gear member 100 from making a rotation in the direction A (clockwise) relative to the camshaft 92, and allows the output gear member 100 to make a rotation in the direction G (counter-clockwise) relative to the camshaft 92.

The second spring clutch 103 is wound around the drum 92B of the camshaft 92 and the drum 99B of the sun gear 99. Like the first spring clutch 64 in FIG. 13, the second spring clutch 103 is a left handed coil. The second spring clutch 103 has a first side wound around the outer surface of the drum 99B of the sun gear 99, and a second side wound around the outer surface of the drum 92B of the camshaft 92.

As is seen in FIG. 18, on the first side of the second spring clutch 103, there is provided a hook 103A projecting radially outwardly. The hook 103A is hooked by a cutout 104C of a clutch control disk 104. When the clutch control disk 104 allows the hook 103A to make a movement relative to the other portion of the second spring clutch 103 in the counter-clockwise direction, the second spring clutch 103 allows the drum 92B of the camshaft 92 to be released from the drum 99B of the sun gear 99. As a result, the drum 92B and the drum 99B can rotate relative to each other. Therefore, when the driven sprocket 91 allows the sun gear 99 to rotate in the direction A (clockwise) in FIG. 19, the second spring clutch 103 of a left handed coil receives a torque in a direction to decrease its coil diameter under a torque condition satisfying the following Expression 19:

$$\text{Angular velocity of sun gear } \mathbf{99} \geqq \text{Angular velocity of camshaft } \mathbf{92} \quad (19)$$

With this, the second spring clutch 103 firmly winds around the drum 99B of the sun gear 99 and the drum 92B of the camshaft 92, to thereby hold stationary the connection between the drum 99B and the drum 92B.

The clutch control disk 104 is disposed around an outer periphery of the second spring clutch 103 with a minor gap therebetween. As is seen in FIG. 18, the clutch control disk 104 has a circular disk 104A, and a cylinder 104B extending axially from an inner periphery of the disk 104A. The cylinder 104B is mated with the outer periphery of the second spring clutch 103 in such a manner as to have a play therebetween.

The cylinder 104B has an edge formed with the small cutout 104C. As is seen in FIG. 18, the cutout 104C is hooked by the hook 103A of the second spring clutch 103. The clutch control disk 104 rotates integrally with the second spring clutch 103 in the clockwise direction until a braking fore is applied to the clutch control disk 104 by a clutch releasing device 105.

Once the braking force is applied to the clutch control disk 104 by the clutch releasing device 105, the clutch control disk 104 receives a braking torque in the counter-clockwise direction in FIG. 19. Thereby, the cutout 104C allows the hook 103A of the second spring clutch 103 to make a movement relative to the other portion of the second spring clutch 103 in the counter-clockwise direction. With this, the second spring clutch 103 in the vicinity of the hook 103A is slightly spaced apart from the outer surface of the drum 99B of the sun gear 99. With this, the second spring clutch 103 allows the drum 99B of the sun gear 99 to be released from the drum 92B of the camshaft 92. As a result, the drum 99B and the drum 92B can rotate relative to each other.

The clutch releasing device 105 is fixed to the support frame 12. Like the clutch releasing device 16 according to the first embodiment, the clutch releasing device 105 has a clutch control coil 105A.

The fifth embodiment ensures operations and advantages substantially the same as those of the first embodiment. Disclosed below are specifics about the operations and the advantages of the fifth embodiment of the present invention.

At first, when the brake control coil 101A of the solenoid brake 101 is demagnetized as is seen in Table 5 and when the driven sprocket 91 rotates in the direction A (clockwise) in FIG. 19, the rotational force of the driven sprocket 91 is transmitted from the shaft support 97A of the carrier 97, via each of the planet gears 98, to the sun gear 99 and the output gear member 100.

With this, the sun gear 99 also rotates in the direction A. Thereby, the second spring clutch 103 receives the torsional torque in the direction to reduce its coil diameter under a torque condition satisfying Expression 19. Therefore, the second spring clutch 103 firmly winds around the drum 99B of the sun gear 99, to thereby hold stationary the connection between the sun gear 99 and the camshaft 92.

Under this condition, the output gear member 100 also rotates in the direction A. The rotational force of the output gear member 100 is transmitted as the torsional torque to reduce the coil diameter of the first spring clutch 102 under the torque condition satisfying Expression 17. thereby, the first spring clutch 102 firmly winds around the output drum 93 of the camshaft 92, to thereby hold stationary the connection between the output gear member 100 and the camshaft 92.

As a result, the camshaft 92 rotates integrally with the output gear member 100 in the direction A (clockwise). Therefore, the rotational force of the driven sprocket 91 is transmitted to the camshaft 92 via the sun-and-planet gear set 96 and the first and second spring clutches 102 and 103. During this period, the camshaft 92 rotates while keeping its rotational phase relative to the driven sprocket 91 constant (phase holding control).

TABLE 5

| | Phase holding control | Retarded angle control | Advanced angle control |
|---|---|---|---|
| Solenoid brake 101 | Inoperative (Demagnetized) | Inoperative (Demagnetized) | Operative (Magnetized) |
| Clutch releasing device 105 | Inoperative (Demagnetized) | Operative (Magnetized) | Inoperative (Demagnetized) |
| First spring clutch 102 | Held | Released | Released |
| Second spring clutch 103 | Held | Released | Held |

In this phase holding control condition, the external gear 99A of the sun gear 99 and the internal gear 100A of the output gear member 100 mesh with each of the planet gears 98. Tooth faces of the external gear 99A and the internal gear 100A keep contacting those of the planet gears 98. Also, the first and second spring clutches 102 and 103 are put in the stationary holding conditions, respectively, and act to keep the stationary conditions with each other.

Therefore, even when the alternating torque (between positive and negative) shown in FIG. 31 is applied to the camshaft 92, the first and second spring clutches 102 and 103 are held stationary with each other. That is, this arrangement preferably prevents problems caused by the backlash, and suppresses any hammering noise between the tooth faces which noise may be caused when the alternating torque is applied.

Next, when the clutch releasing device 105 is operated under this condition as is seen in Table 5 in order to apply a braking torque to the clutch control disk 104 in the counter-clockwise direction in FIG. 19, the cutout 104C allows the hook 103A of the second spring clutch 103 to make a movement relative to the second spring clutch 103 in the counter-clockwise direction in FIG. 19. With this, the holding condition by the second spring clutch 103 is released. Thereby, the torque is not transmitted between the drum 99B of the sun gear 99 and the drum 92B of the camshaft 92.

Moreover, by releasing the second spring clutch 103, the rotational load of the sun gear 99 quickly decreases, to thereby allow each of the planet gears 98 to start rotating on each of the shaft supports 97A in the direction B in FIG. 19. With this, the output gear member 100 rotates in the direction G relative to the driven sprocket 91. When the output gear member 100 receives the rotational torque in the direction G, the first spring clutch 102 which has the hook 102A hooked with the cutout 100D of the output gear member 100 receives the torsional torque to increase its coil diameter. With this, the first spring clutch 102 is slightly spaced apart from the outer surface of the output drum 93, to thereby allow the drum 100C of the output gear member 100 to be released from the output drum 93. This enables the drum 100C and the output drum 93 to rotate relative to each other.

As a result, when the clutch releasing device 105 is in operation, the rotational torque from the driven sprocket 91 is not transmitted to the camshaft 92 via the sun-and-planet gear set 96, and the holding condition by the first and second spring clutches 102 and 103 are released. With this, the camshaft 92 is retarded in respect of the rotational phase relative to the driven sprocket 91. Canceling the operation of the clutch releasing device 105 achieves an automatic recovery of the phase control.

Next, when the brake control coil 101A of the solenoid brake 101 is magnetized as is seen in Table 5, a rotational toque (barking force) is applied to the output gear member 100 in the direction G in FIG. 19. With this, the hook 102A of the first spring clutch 102 receives from the output gear member 100 the braking force in the counter-clockwise direction in FIG. 19. With this, the first spring clutch 102 in the vicinity of the hook 102A is slightly spaced apart from the outer surface of the drum 100C, to thereby release the holding condition between the output gear member 100, the output drum 93 (camshaft 92) and the carrier 97.

Moreover, in this condition braking the output gear member 100 allows each of the planet gears 98 to rotate in the direction B in FIG. 19, to thereby allow the sun gear 99 to rotate in the direction A faster than the carrier 97 and the driven sprocket 91. Under this condition, the second spring clutch 103 allows the sun gear 99 to be held stationary to the camshaft 92.

Thus, the rotation and revolution of the planet gears 98 allow the camshaft 92 and the sun gear 99 to rotate faster than the carrier 97. With this, the camshaft 92 is advanced in respect of the rotational phase relative to the driven sprocket 91. Therefore, canceling the operation of the solenoid brake 101 achieves the automatic recovery of the phase holding control.

FIGS. 20 through 25 show a sixth embodiment of the present invention. In the sixth embodiment, a plurality of spring clutches are used in order to stabilize the holding condition of the rotational phase. One of the spring clutches under the holding condition is released by an oil pressure control. The valve timing control system of the sixth embodiment is simple in constitution, and enables the switching between the phase holding control, the advanced angle control and the retarded angle control to be accurately carried out. In the sixth embodiment, the elements same as those in the first embodiment have the same numerals. Therefore, repeated explanations for the same elements are omitted in the sixth embodiment.

A driven sprocket 111 acting as a rotor has the constitution substantially the same as that of the driven sprocket 1 in the first embodiment.

A camshaft 112 has the constitution almost the same as that of the camshaft 2 in the first embodiment. The camshaft 112 has a stepped portion 112A having a plurality of stepped portions. The diameter of the stepped portion 112A becomes smaller stepwise in a direction toward a head end of the camshaft 112.

A ring drum 113 constitutes a part of the camshaft 112. The ring drum 113 is disposed between an input gear member 118 and a carrier 121 in the axial direction. The ring drum 113 is fixed around an outer periphery of the stepped portion 112A. The ring drum 113 has an outer diameter substantially the same as those of a drum 118B and a drum 121C. A first spring clutch 126 is installed around the ring drum 113, the drum 118B and the drum 121C, and allows the ring drum 113 to be held stationary to the drums 118B and 121C and released from the drums 118B and 121C.

A valve cell 114 is provided in the stepped portion 112A of the camshaft 112. The valve cell 114 is positioned in the axial center of the camshaft 112 and extends axially. The valve cell 114 has a large diameter portion. A spool 132 is slidably inserted into the large diameter portion of the valve cell 114. Moreover, there is formed an induction passage 115 for inducing pressure oil to the valve cell 114. The induction passage 115 is connected to a discharge side of the oil pump (not shown) of the internal combustion engine.

Figure 22:
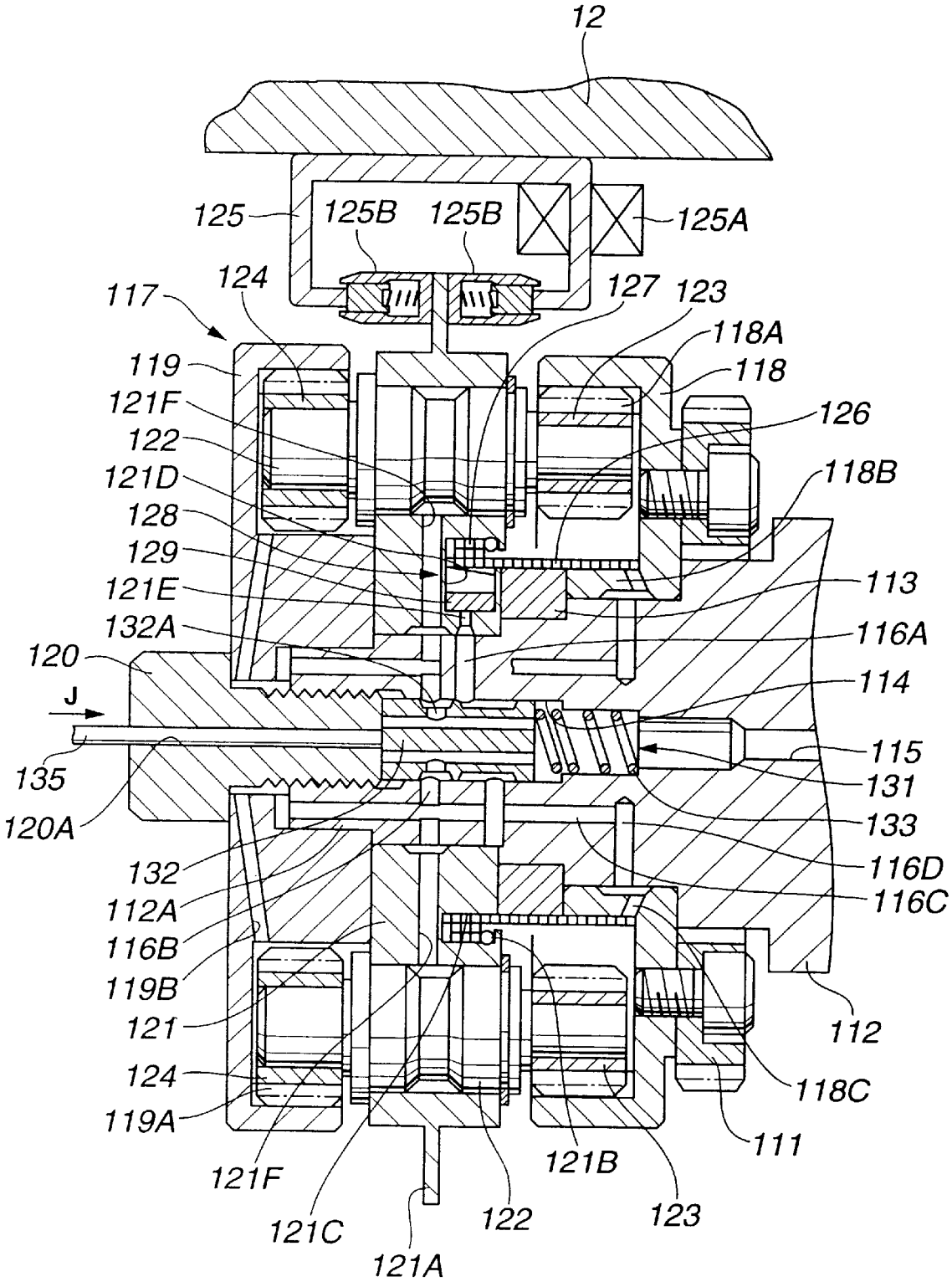
FIG. 22 is an enlarged cross sectional view showing an essential part of the valve timing control system in FIG. 20 in a condition that a spool is in its initial position.
Figure 23:
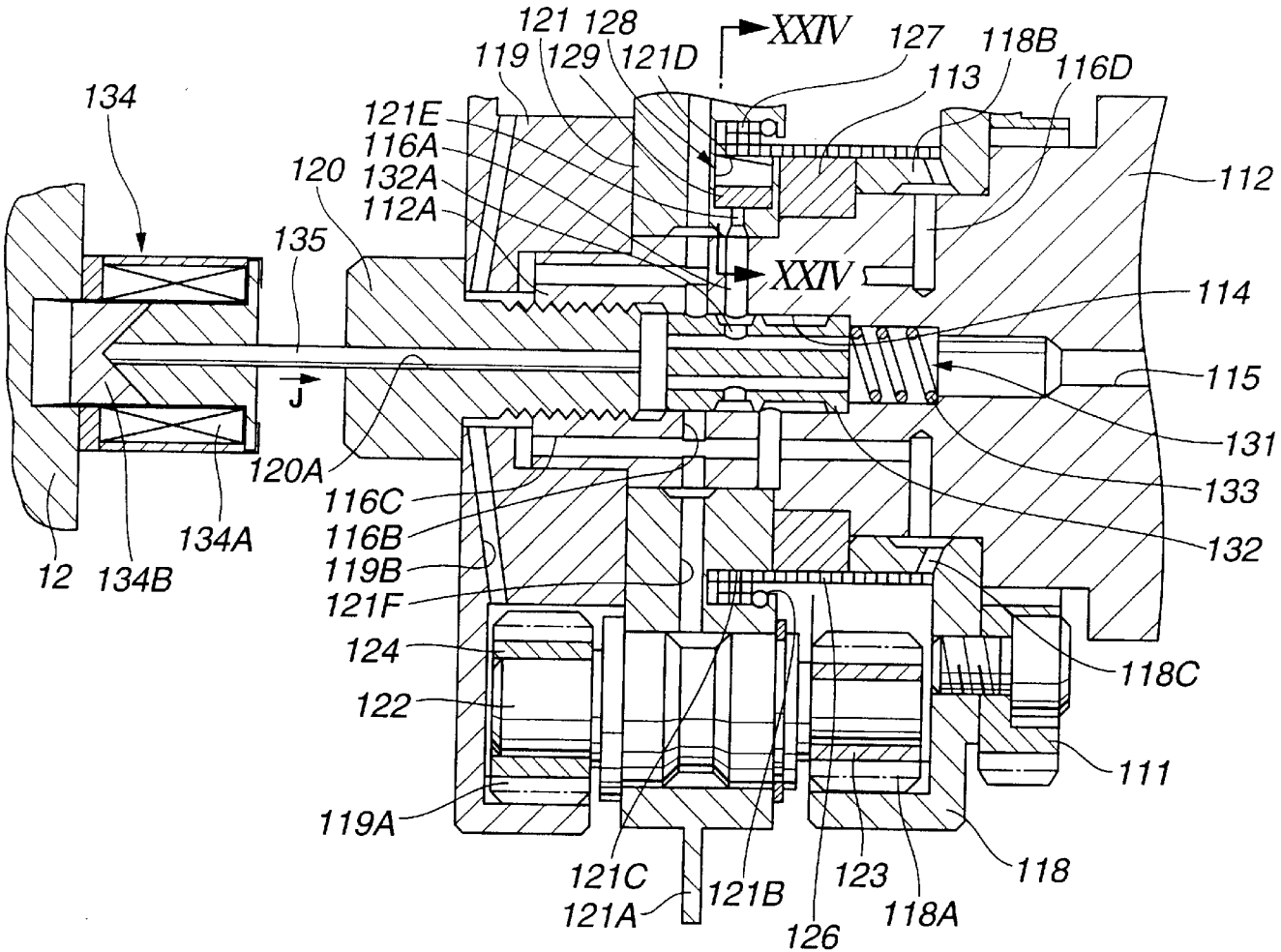
FIG. 23 is an enlarged cross sectional view of an essential part of the valve timing control system in FIG. 20 in a condition that the spool is driven by a solenoid actuator.

The camshaft 112 has oil passages 116A, 116B, 116C and 116D for supplying and discharging the pressure oil. As is seen in FIGS. 22 and 23, the oil passages 116A, 116B and 116D extend radially relative to the camshaft 112, and the oil passage 116C extends axially relative to the cam shaft 112. The oil passage 116A operates independently of the oil passages 116B, 116C and 116D. The oil passage 116A supplies the pressure oil to a clutch releasing cylinder 128 and discharges the pressure oil from the clutch releasing cylinder 128.

The oil passages 116B, 116C and 116D communicate with each other for supplying the pressure oil to sliding faces between the stepped portion 112A of the camshaft 112, the input gear member 118, and the carrier 121. The thus supplied pressure oil is used as lubricant. Then, the pressure oil is collected in an oil pan of the internal combustion engine via other oil passages (not shown).

A sun-and-planet gear set 117 is provided between the driven sprocket 111 and the camshaft 112, and acts as a rotational phase controller for variably controlling rotational phases. The sun-and-planet gear set 117 also acts as a holding force generator for first and second spring clutches 126 and 127. The sun-and-planet gear set 117 has the input gear member 118, an output gear member 119, the carrier 121 and first and second planet gears 123 and 124.

The input gear member 118 acts as a first rotary member of the sun-and-planet gear set 117. The input gear member 118 is formed into a ring shape having a cross section shaped into a right-angled "U," and is rotatably disposed around the outer periphery of the stepped portion 112A of the camshaft 112. The input gear member 118 is fixed to the driven sprocket 111 with bolts, and rotates integrally with the driven sprocket 111 around the outer periphery of the stepped portion 112A of the camshaft 112.

Moreover, the input gear member 118 has an internal gear 118A. The internal gear 118A projecting radially inwardly is disposed on a further side from the stepped portion 112A, and acts as a first gear. The cylindrical drum 118B is disposed around the stepped portion 112A. Moreover, the drum 118B has a plurality of oil passages 118C extending radially diagonally. The oil passages 118C communicate with the oil passages 116B, 116C and 116D of the camshaft 112. Each of the oil passages 118C supplies the oil to a clearance between the drum 118B and the first spring clutch 126.

The output gear member 119 acts as a second rotary member of the sun-and-planet gear set 117. The output gear member 119 is formed into a ring shape having a cross section shaped into a right-angled "U." The output gear member 119 has in the vicinity of the stepped shaft 112A a thick portion that is thicker than the other portion of the output gear member 119. The output gear member 119 is tightened at a head end of the stepped portion 112A of the camshaft 112 using a bolt 120, and rotates integrally with the camshaft 112. Moreover, the output gear member 119 has an internal gear 119A. The internal gear 119A projecting radially inwardly is disposed on a further side from the head end of the stepped portion 112A, and acts as a second gear. The internal gear 119A of the output gear member 119 has the number of teeth substantially the same as that of the internal gear 118A of the input gear member 118.

Moreover, the output gear member 119 has a plurality of oil passages 119B extending radially diagonally from the inside to the outside. The oil passages 119B communicate with the oil passages 116B, 116C and 116D of the camshaft 112. Each of the oil passages 119B supplies the oil to a clearance between the internal gear 119A and the second planetary gear 124.

The bolt 120 is screwed to a threaded portion extending from the valve cell 114, and has therein a rod opening 120A bored in the axial direction. A small diameter rod 135 is sealingly but slidably inserted in the rod opening 120A.

The carrier 121 acts as a third rotary member of the sun-and-planet gear set 117. The carrier 121 has a constitution substantially the same as that of the carrier 8 in the first embodiment. Around an outer periphery of the carrier 121, there is formed a disk 121A integrally with the carrier 121. Moreover, the carrier 121 has a clutch groove 121B having a ring-like shape. The cylindrical drum 121C defines an inner periphery of the clutch groove 121B.

The drum 121C of the carrier 121 has therein a cylinder space 121D extending radially. The cylinder space 121D continuously communicates with the oil passage 116A of the camshaft 112 via an oil opening 121E. Moreover, the carrier 121 has a pair of oil passages 121F axially spaced apart from the cylinder space 121D. The oil passages 121F communicate with the oil passages 116B, 116C and 116D of the camshaft 112, and supply the oil to sliding faces of a pair of planet shafts 122 respectively.

The carrier 121 is rotatably disposed around the outer periphery of the stepped portion 112A of the camshaft 112. As is seen in FIG. 22, the two planet shafts 122 are rotatably installed to the carrier 121, and disposed around the outer periphery of the stepped portion 112A. Each of the planet shafts 122 has first and second ends projecting from the carrier 121. The first end of the planet shaft 122 is integrated with the first planet gears 123. The second end of the planet shaft 122 is integrated with the second planet gears 124.

The first planet gears 123 mesh with the internal gear 118A of the input gear member 118, and transmit a rotational torque from the driven sprocket 111 to the planet shafts 122. The second planet gears 124 mesh with the internal gear 119A of the output gear member 119, and transmit the rotational torque from the planet shaft 122 to the output gear member 119 (camshaft 112).

Moreover, the second planet gears 124 are larger in the number of teeth than the first planet gears 123. The difference in the number of teeth between the first and second planet gears 123 and 124. causes an increased speed as follows: When a solenoid brake 125 brakes the rotation of the carrier 121, the output gear member 119 is allowed to rotate faster than the input gear member 118 (driven sprocket 111) by a speed difference corresponding to the difference in the number of teeth between the first and second planet gears 123 and 124.

The solenoid brake 125 is fixed to the support frame 12, and acts as a rotational speed adjuster. Like the solenoid brake 13 according to the first embodiment, the solenoid brake 125 has a brake control coil 125A and a pair of dampers 125B.

The first spring clutch 126 is wound around the drum 121C of the carrier 121, the ring drum 113 of the camshaft 112 and the drum 118B of the input gear member 118. Like the first spring clutch 64 in FIG. 13, the first spring clutch 126 is a left handed coil. The first spring clutch 126 has a first side wound around the outer periphery of the drum 121C of the carrier 121, a middle portion wound around the outer periphery of the ring drum 113 of the camshaft 112, and a second side wound around the outer periphery of the drum 118B of the input gear member 118.

Figure 24:
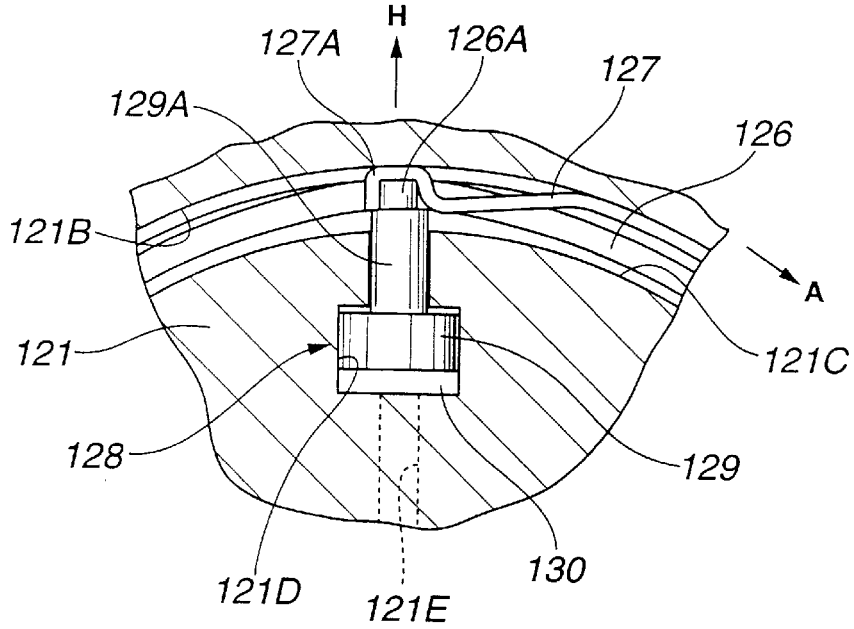
FIG. 24 is an enlarged cross sectional view taken in the direction of arrows substantially along the line XXIV—XXIV in FIG. 23 in a condition that a clutch releasing cylinder has released the spring clutch.
Figure 25:
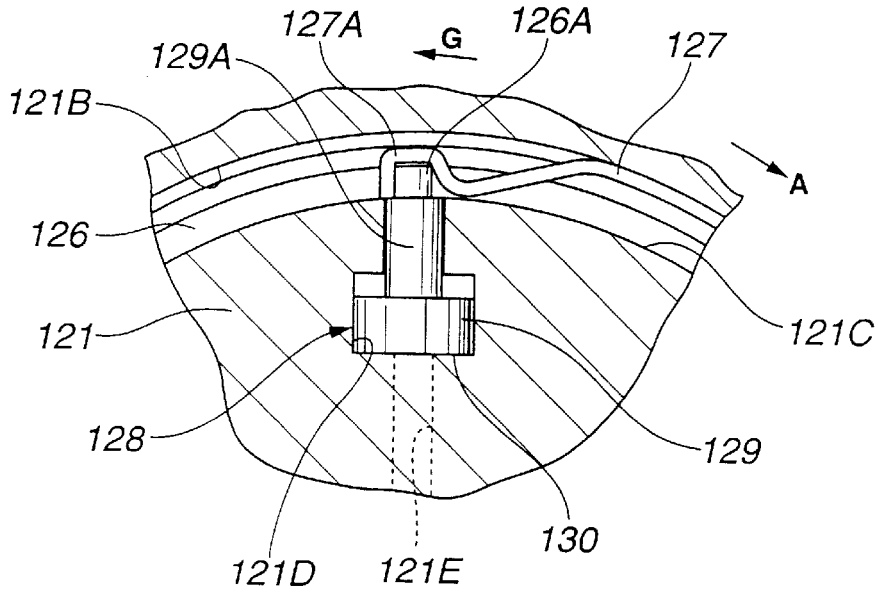
FIG. 25 is an enlarged cross sectional view taken in the direction of arrows substantially along the line XXIV—XXIV in FIG. 23 a condition before the clutch releasing cylinder releases the spring clutch.

As is seen in FIGS. 24 and 25, the first spring clutch 126 has, on the first side thereof, a hook 126A projecting axially. The hook 126A abuts on a head end of a clutch releasing piston 129 in the clutch groove 121B of the carrier 121, and engages with a curved portion 127A of the second spring clutch 127. When the clutch releasing piston 129 of the clutch releasing cylinder 128 moves in a direction H in FIG. 24, the hook 126A of the first spring clutch 126 is pushed radially outwardly, to thereby increase the coil diameter of the first spring clutch 126. With this, the first spring clutch 126 allows the carrier 121 to be released from the ring drum 113 (camshaft 112). As a result, the carrier 121 and the ring drum 113 can rotate relative to each other.

When the input gear member 118 rotates integrally with the driven sprocket 111 in the clockwise direction in FIG. 24, the first spring clutch 126 of the left handed coil receives a torsional torque in a direction to increase its coil diameter under a torque condition satisfying the following Expression (20):

$$\text{Angular velocity of driven sprocket } \mathbf{111} > \text{Angular velocity of camshaft } \mathbf{112} \quad (20)$$

The first spring clutch 126 is, therefore, slightly spaced apart from an outer surface of the drum 118B. With this, the first spring clutch 126 allows the drum 118B of the input gear member 118 to be released from the ring drum 113 of the camshaft 112. As a result, the drum 118B and the ring drum 113 can rotate relative to each other.

Contrary to this, when the carrier 121 rotates in a direction to be advanced in respect of the rotational phase relative to the ring drum 113 of the camshaft 112, the first spring clutch 126 receives a torsional torque in a direction to reduce its coil diameter under a torque condition satisfying the following Expression (21):

$$\text{Angular velocity of carrier } \mathbf{121} \geqq \text{Angular velocity of ring drum } \mathbf{113} \quad (21)$$

With this, the first spring clutch 126 firmly winds around an area between the drum 121C of the carrier 121 and the ring drum 113, to thereby hold stationary the connection between the drum 121C and the ring drum 113.

That is, the first spring clutch 126 acts as a one-way clutch between the carrier 121 and the camshaft 112. Thereby, the first spring clutch 126 prevents the carrier 121 from making a rotation in the clockwise direction in FIG. 24 relative to the camshaft 112, and allows the carrier 121 to make a rotation in the counter-clockwise direction in FIG. 24 relative to the camshaft 112.

The second spring clutch 127 is disposed in the clutch groove 121B of the carrier 121. As is seen in FIGS. 24 and 25, the second spring clutch 127 has, on a first side thereof, the curved portion 127A curved like a crank. The curved portion 127A engages with the hook 126A of the first spring clutch 126. The second spring clutch 127 is positioned around an outer periphery of the first spring clutch 127. In the clutch groove 121B, the second spring clutch 127 is, on a second side thereof, hooked with the carrier 121.

The second spring clutch 127 is a right handed coil, and is wound around the outer periphery of the first spring clutch 126 interposing therebetween a small gap in the clutch groove 121B of the carrier 121. When the second spring clutch 127 receives the torsional torque in the direction to increase its coil diameter, the second spring clutch 127 is pushed toward the outer periphery of the clutch groove 121B by the first spring clutch 126.

Therefore, the second spring clutch 127 acts as a releasing means for the first spring clutch 126. That is, when the solenoid brake 125 applies a braking force to the carrier 121, the rotational speed of the carrier 121 becomes lower than that of the ring drum 113 so as to rotate the carrier 121 in the counter-clockwise direction (direction G) in FIG. 21 relative to the ring drum 113. Since the second end of the second spring clutch 127 is hooked with the carrier 121, the curved portion 127A of the second spring clutch 127 allows the hook 126A to move in the direction G in FIG. 25 according to the inverse rotation of the carrier 121 relative to the ring drum 113, to thereby release the holding condition by the first spring clutch 126 between the drum 121C of the carrier 121, the ring drum 113 of the camshaft 112 and the drum 118B of the input gear member 118.

The clutch releasing cylinder 128 is disposed radially inside the first spring clutch 126 in the carrier 121. As is seen in FIGS. 22 through 25, the clutch releasing cylinder 128 has the clutch releasing piston 129 and an oil chamber 130. The clutch releasing piston 129 is slidably inserted in the cylinder space 121D of the carrier 121. The oil chamber 130 is defined by the clutch releasing piston 129 and the cylinder space 121D.

The clutch releasing cylinder 128 and an oil control valve 131 constitute clutch releasing means. The pressure oil is supplied to and discharged from the oil chamber 130 via the oil control valve 131, to thereby allow the clutch releasing piston 129 to be slidably displaced in the cylinder space 121D. Therefore, the hook 126A of the first spring clutch 126 is moved in a direction to be released from the holding condition according to the pushing slide of the clutch releasing piston 129.

As is seen in FIGS. 22 through 23, the clutch releasing piston 129 has a projection 129A substantially trapezoidal. The projection 129A abuts on the inner periphery of the first spring clutch 126. As is seen in FIG. 23, a head end of the projection 129A is slightly slanting downwardly from the first side toward the second side of the first spring clutch 126. Thus, it is only on the hook 126A of the first spring clutch 126 that the head end of the projection 129A continuously abuts. Other than on the hook 126A, the head end of the projection 129A is slightly spaced apart from the first spring clutch 126.

When the clutch releasing piston 129 is moved in a direction H in FIG. 24, the clutch releasing piston 129 allows the head end of the projection 129A to push the hook 126A of the first spring clutch 126 radially outwardly. Therefore, a coil portion of the first spring clutch 126 following the hook 126A is, gradually, pushed radially outwardly. Therefore, the first spring clutch 126 gradually releases the holding condition between the carrier 121 and the camshaft 112 from the hook 126A toward the second end of the first spring clutch 126.

The oil control valve 131 constitutes the clutch releasing means together with the clutch releasing cylinder 128. The oil control valve 131 generally has the spool 132, a spring 133 and a solenoid actuator 134. The spool 132 is slidably inserted in the valve groove 114 of the camshaft 112. The spring 133 continuously biases the spool 132 toward an end of the bolt 120.

When the spring 133 biases the spool 132 of the oil control valve 131 at an initial position of the spool 132 in FIG. 22, the spool 132 allows an oil opening 132A to communicate with the oil passages 116B, 116C and 116D and with the oil passage 121F of the carrier 121, to thereby supply the pressure oil as lubricant from the induction passage 115 to the sliding faces of the sun-and-planet gear set 117.

When the spring 133 allows the spool 132 to slidably move to a clutch releasing position in FIG. 23 against the spring force of the spring 133, the oil control valve 131 allows the oil opening 132A to communicate with the oil chamber 130 via the oil passage 116A of the camshaft 112 and via the oil opening 121E of the carrier 121, to thereby supply the pressure oil from the induction passage 115 into the oil chamber 130. With this, the clutch releasing piston 129 of the clutch releasing cylinder 128 is moved in the direction H in FIG. 24, to thereby release compulsively the holding condition of the first spring clutch 126.

The solenoid actuator 134 is disposed at a position axially spaced apart from the camshaft 112. The solenoid actuator 134 is fixed to the support frame 12, and has therein a control coil 134A. The solenoid actuator 134 has a movable iron core 134B which is moved in the axial direction when the control coil 134A is magnetized. There is provided the small diameter rod 135 between the movable iron core 134B and the spool 132 of the oil control valve 131.

The rod 135 is inserted in the rod opening 120A of the bolt 120. The rod 135 has an end abutting on the spool 132 in the valve cell 114. When an external signal is applied to magnetize the control coil 134A, the solenoid actuator 134 allows the movable iron core 134B to move the rod 135 in the direction J in FIGS. 22 and 23. With this, the spool 132 in the valve cell 114 is slidably shifted to the clutch releasing position in FIG. 23, against the biasing force of the spring 133.

Contrary to this, when the external signal is canceled to demagnetize the control coil 134A, the solenoid actuator 134 allows the rod 135 together with the movable iron core 134B to move in the direction opposite to the direction J in FIG. 22. And, the spool 132 in the valve cell 114 is biased by the spring 133 to such an extent that the spool 132 abuts on the end of the bolt 120. Thereby, the spool 132 returns to its initial position in FIGS. 20 and 22.

The sixth embodiment ensures operations and advantages substantially the same as those of the first embodiment. Disclosed below are specifics about the operations and the advantages of the sixth embodiment of the present invention.

Figure 21:
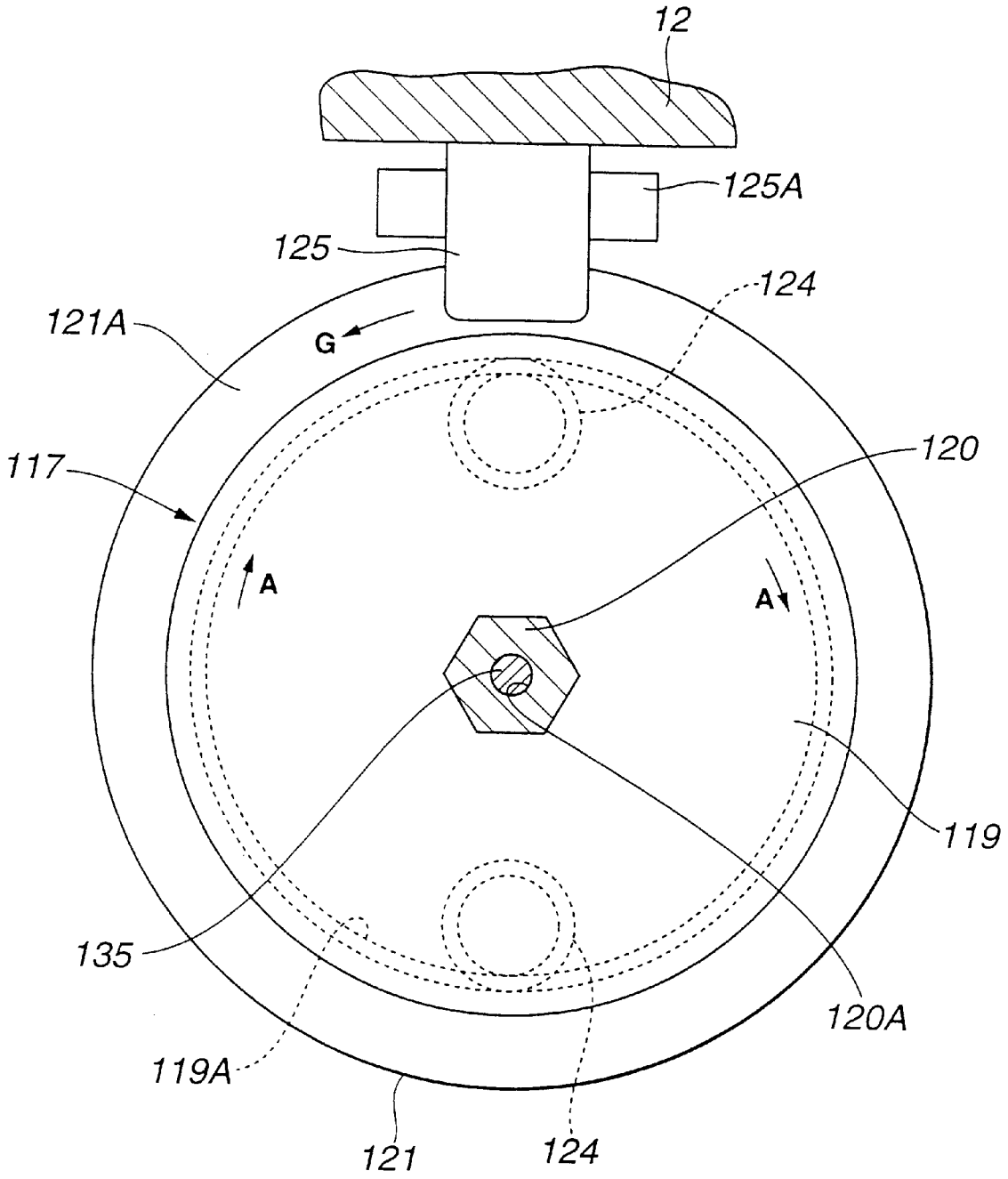
FIG. 21 is a cross sectional view of the valve timing control system taken in the direction of arrows substantially along lines XXI—XXI in FIG. 20.

At first, when the brake control coil 125A of the solenoid brake 125 is demagnetized as is seen in Table 6 and when the driven sprocket 111 rotates in the clockwise direction in FIG. 21, the rotational force of the driven sprocket 111 is transmitted from the internal gear 118A of the input gear member 118 to the first planet gear 123. Therefore, the first planet gears 123 rotate on the planet shafts 122, and revolves around the cam shaft 112. The revolving force of the first planet gears 123 is transmitted to the carrier 121 as a rotational torque.

In this condition, the first spring clutch 126 receives the torsional torque in the direction to increase its coil diameter under the torque condition satisfying Expression (20). The first spring clutch 126 is, therefore, slightly spaced apart from the outer surface of the drum 118B of the input gear member 118. Thereby, the first spring clutch 126 allows the input gear member 118 and the ring drum 113 (camshaft 112) to rotate relative to each other.

However, when the revolving force from the first planet gears 123 is transmitted to the carrier 121, the carrier 121 begins to rotate in the direction A in FIG. 25 (clockwise). Then, the rotational force of the carrier 121 is transmitted to the first spring clutch 126 as the torsional torque in the direction to decrease the coil diameter of the first spring clutch 126 under the torque condition satisfying Expression (21). With this, the first spring clutch 126 firmly winds around the ring drum 113 of the camshaft 112, to thereby hold stationary the area between the carrier 121 and the camshaft 112.

The first spring clutch 126 acts as a one-way clutch between the camshaft 112 and the carrier 121. With this, the first spring clutch 126 prevents the carrier 121 from making a rotation in the clockwise direction in FIG. 21 relative to the camshaft 112. Until the camshaft 112 rotates, the first and second planet gears 123 and 124 make rotations on the planet shafts 122 only without making revolutions around the camshaft 112. Therefore, the rotational force of the second planet gear 124 is transmitted to the output gear member 119 via the internal gear 119A.

The second planet gears 124 are larger in the number of teeth than the first planet gears 123. Therefore, the second planet gears 124 rotate the output gear member 119 faster than the first planet gears 123 rotate the input gear member 118 by a speed difference corresponding to the difference in the number of teeth. With this, the camshaft 112 rotates integrally with the output gear member 119 in the clockwise direction due to the first spring clutch 126. If the rotation of the camshaft 112 is even a little faster than that of the driven sprocket 111, the first spring clutch 126 receives the torsional torque in the direction to reduce its coil diameter under the torque condition satisfying the following Expression (22):

$$\text{Angular velocity of camshaft } \mathbf{112} \geqq \text{Angular velocity of driven sprocket } \mathbf{111} \quad (22)$$

With this, the first spring clutch 126 firmly winds around the ring drum 113 and the drum 118B, to thereby hold stationary the ring drum 113 and the drum 118B.

As a result, the rotational force of the driven sprocket 111 is transmitted to the camshaft 112 via the sun-and-planet gear set 117 and the first spring clutch 126. During this period, the camshaft 112 rotates while keeping its rotational phase relative to the driven sprocket 111 (phase holding control).

In this condition, the internal gear 118A meshes with the first planet gears 123 while the internal gear 119A meshes with the second planet gears 124. Tooth faces of the internal gears 118A and 119A keep contacting, respectively, those of the first and second planet gears 123 and 124. Also, the first spring clutch 126 keeps the stationary holding condition. Thereby, even when the alternating torque (between positive and negative) shown in FIG. 31 is applied to the camshaft 112, the first spring clutch 126 keeps the stationary holding condition. That is, this arrangement preferably prevents problems caused by the backlash, and suppresses any hammering noise between the tooth faces which noise may be caused when the alternating torque is applied.

TABLE 6

| | Phase holding control | Retarded angle control | Advanced angle control |
|---|---|---|---|
| Solenoid brake 125 | Inoperative (Demagnetized) | Inoperative (Demagnetized) | Operative (Magnetized) |
| Solenoid actuator 134 | Inoperative (Demagnetized) | Operative (Magnetized) | Inoperative (Demagnetized) |
| First spring clutch 126 | Held | Released | Released |
| Second spring clutch 127 | Held | Released | Held |

Then, under this condition, when the control coil 134A of the solenoid actuator 134 is magnetized, as is seen in Table 6, the movable iron core 134B moves the rod 135 in the direction J, to thereby allow the spool 132 of the oil control valve 131 to be slidably shifted to the clutch releasing position in FIG. 23, against the biasing force by the spring 133. Therefore, the oil opening 132A of the spool 132 communicates with the oil chamber 130 of the clutch releasing cylinder 128 via the oil passage 116A of the camshaft 112 and the oil opening 121E of the carrier 121.

By applying the pressure oil from the induction passage 115 into the oil chamber 130 under this condition, the clutch releasing cylinder 128 moves the clutch releasing piston 129 radially outwardly (direction H in FIG. 24) in the carrier 121. Therefore, the holding condition of the first spring clutch 126 is compulsively released, to thereby shut off the torque transmission between the drum 121C of the carrier 121, the ring drum 113 and the drum 118B of the input gear member 118.

As a result, the carrier 121 rotates freely in the clockwise direction in FIG. 21. The first planet gears 123 rotate on the planet shafts 122, and revolve along the internal gear 118A of the input gear member 118. Also, the second planet gears 124 rotate on the planet shafts 122, and revolve along the internal gear 119A of the output gear member 119. The second spring clutch 127 in the clutch groove 121B of the carrier 121 is a right handed coil. Therefore, as the carrier 121 rotates in the clockwise direction in FIG. 21, the second spring clutch 127 reduces its coil diameter. With this, the second spring clutch 127 is spaced apart from the outer periphery of the clutch groove 121B. However, the second spring clutch 127 does not cause any holding forces.

Therefore, when the solenoid actuator 134 (clutch releasing cylinder 128) is in operation, the rotational torque from the driven sprocket 111 is not transmitted to the camshaft 112 via the sun-and-planet gear set 117, and via the first and second spring clutches 126 and 127. As a result, the camshaft 112 is retarded in respect of the rotational phase relative to the driven sprocket 111.

When the solenoid actuator 134 is demagnetized to stop the clutch releasing cylinder 128, the hook 126A of the first spring clutch 126 allows the clutch releasing piston 129 to be pushed back to its initial position in FIG. 25. Therefore, the first spring clutch 126 holds stationary the drum 121C of the carrier 121, the ring drum 113 and the drum 118B of the input gear member 118.

As a result, the torque transmission is recovered between the drum 121C of the carrier 121, the ring drum 113 and the drum 118B of the input gear member 118, to thereby achieve the automatic recovery of the phase holding control.

Next, when a rotational torque (braking force) is applied to the carrier 121 in the counter-clockwise direction in a condition that the brake control coil 125A of the solenoid brake 125 is magnetized, as is seen in Table 6, the second spring clutch 127 receives a torque in a direction to increase its coil diameter. Thereby, the curved portion 127A of the second spring clutch 127 moves the hook 126A of the first spring clutch 126 in the direction G in FIG. 25. The hook 126A of the first spring clutch 126 is, therefore, slightly spaced apart from the outer periphery of the drum 121C of the carrier 121. As a result, the first spring clutch 126 releases the holding condition between the drum 121C of the carrier 121, the ring drum 113 (camshaft 112) and the input gear member 118.

Moreover, when the solenoid brake 125 applies a braking force to the carrier 121, the rotational speed of the carrier 121 becomes lower than that of the camshaft 112 so as to rotate the carrier 121 in the counter-clockwise direction G in FIG. 21 relative to the camshaft 112. With this, the output gear member 119 (camshaft 112) rotates faster than the input gear member 118 by the speed difference corresponding to the teeth difference between the first and second planet gears 123 and 124. Therefore, the camshaft 112 is advanced in respect of the rotational phase relative to the driven sprocket 111. Thereafter, canceling the operation of the solenoid brake 125 achieves an automatic recovery of the phase holding control.

In this sixth embodiment, in order to execute the switching between the holding condition and the released condition of the first spring clutch 126, the solenoid actuator 134 controls the spool 132 of the oil control valve 131 disposed in the rotational center of the camshaft 112, to thereby supply the pressure oil to and discharge the pressure oil from the clutch releasing cylinder 128 in the carrier 121. With this arrangement, the first spring clutch 126 is smoothly controlled. Thereby, any lowered response is preferably prevented which may be caused by oil leak.

Furthermore, disposing the spool 132 in the camshaft 112 and disposing the clutch releasing cylinder 128 in the carrier 121 achieve a small sized valve timing control system. Also, the solenoid actuator 134 controls the spool 132 at high response, to thereby smoothen and stabilize the valve timing control.

FIG. 26 through 29 show a seventh embodiment of the present invention. In the seventh embodiment, a plurality of spring clutches are used in order to stabilize the holding condition of the rotational phase. For releasing the holding condition with the spring clutches, an external signal and a plurality of gear members are used. The valve timing control system of the seventh embodiment is simple in constitution, and enables the switching between the phase holding control, the advanced angle control and the retarded angle control to be accurately carried out. In the seventh embodiment, the elements same as those in the first embodiment have the same numerals. Therefore, repeated explanations for the same elements are omitted in the seventh embodiment.

A driven sprocket 141 acting as a rotor has the constitution substantially the same as that of the driven sprocket 1 in the first embodiment.

A camshaft 142 has the constitution almost the same as that of the camshaft 2 in the first embodiment. The camshaft 142 has a stepped portion 142A having a plurality of stepped portions. The diameter of the stepped portion 142A becomes smaller stepwise in a direction toward a head end of the camshaft 142.

A ring drum 143 constitutes a part of the camshaft 142. The ring drum 143 is disposed between an input gear member 148 and a carrier 151 in the axial direction. The ring drum 143 is fixed around an outer periphery of the stepped portion 142A. The ring drum 143 has an outer diameter substantially the same as those of a drum 148B and a drum 151C. A first spring clutch 156 is installed around the ring drum 143, the drum 148B and the drum 151C, and allows the ring drum 143 to be held stationary to the drums 148B and 151C and released from the drums 148B and 151C.

An oil opening 144 is provided in the stepped portion 142A of the camshaft 142. The oil opening 144 is positioned in the axial center of the camshaft 142 and extends axially. The oil opening 144 has a first end blocked by a bolt 150. Moreover, there is formed an induction passage 145 for inducing the pressure oil to the oil opening 144. The induction passage 145 is connected to a discharge side of the oil pump (not shown) of the internal combustion engine.

Figure 26:
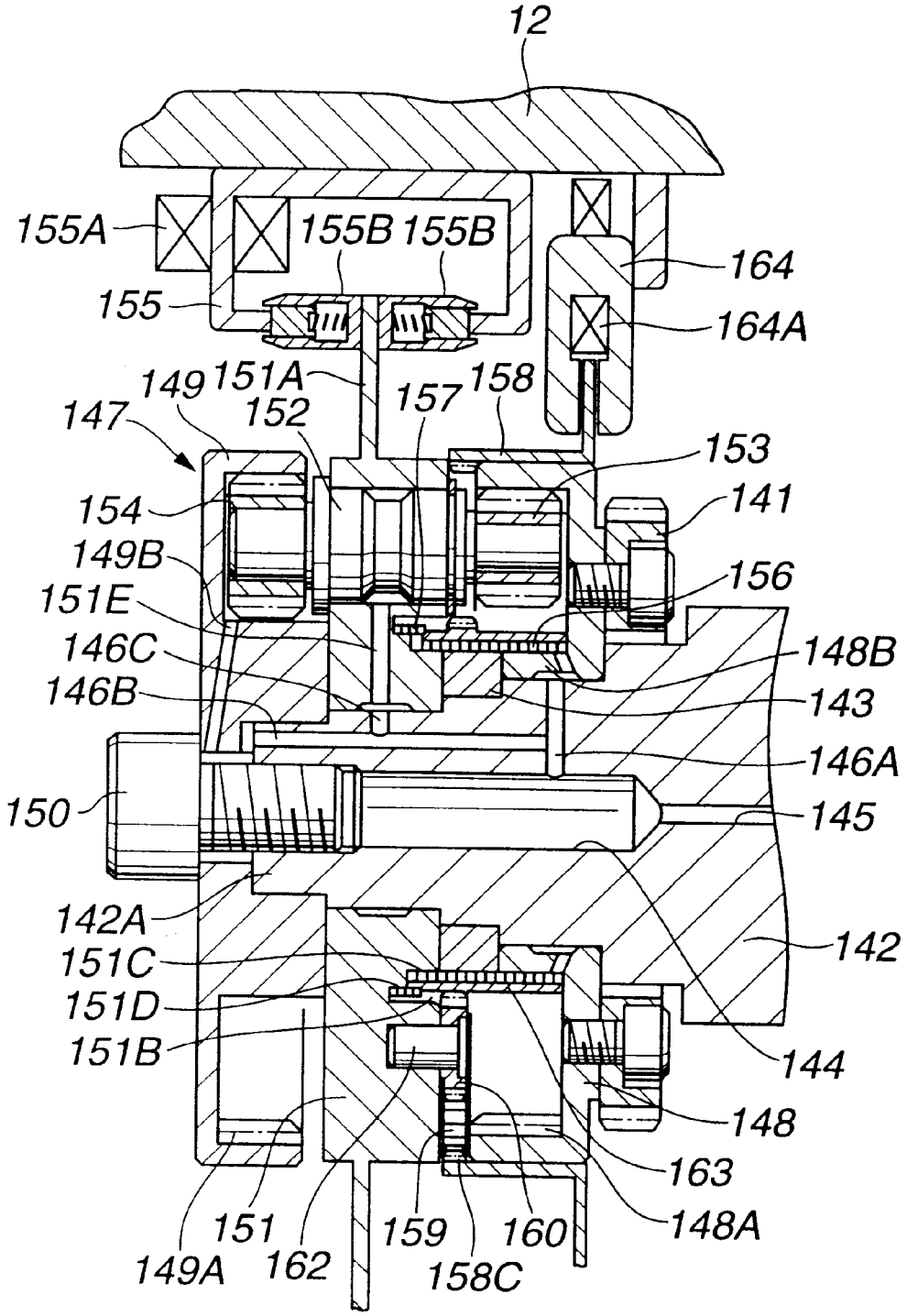
FIG. 26 is a cross sectional view of the valve timing control system taken in the direction of arrows substantially along the line XXVI—XXVI in FIG. 27, according to a seventh embodiment of the present invention.
Figure 28:
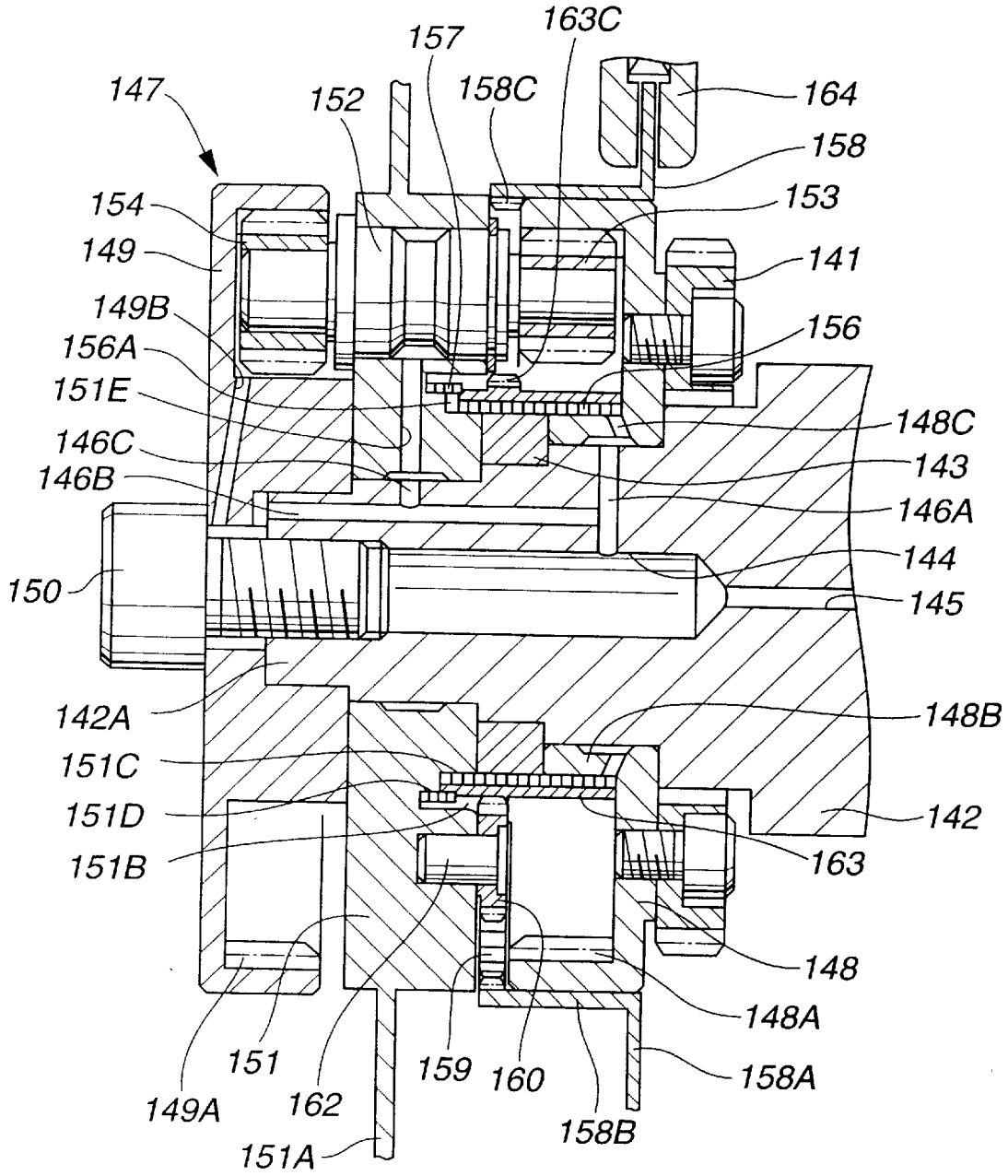
FIG. 28 is an enlarged view showing an essential part of the valve timing control system in FIG. 26.

The camshaft 142 has oil passages 146A, 146B and 146C for supplying and discharging the pressure oil. As is seen in FIGS. 26 and 28, the oil passages 146A and 146C extend radially relative to the camshaft 142 and the oil passage 146B extends axially relative to the camshaft 142 to communicate with the oil opening 144. The oil passages 146A, 146B and 146C communicate with each other for supplying the pressure oil to sliding faces between the stepped portion 142A of the camshaft 142, the input gear member 148 and the carrier 151. The thus supplied pressure oil is used as lubricant. Then, the pressure oil is collected in an oil pan of the internal combustion engine via other oil passages (not shown).

A sun-and-planet gear set 147 is provided between the driven sprocket 141 and the camshaft 142, and acts as a rotational phase controller for variably controlling rotational phases. The sun-and-planet gear set 147 also acts as a holding force generator for first and second spring clutches 156 and 157. The sun-and-planet gear set 147 has the input gear member 148, an output gear member 149, the carrier 151 and first and second planet gears 153 and 154.

The input gear member 148 acts as a first rotary member of the sun-and-planet gear set 147. The input gear member 148 is formed into a ring shape having a cross section shaped into a right-angled "U." and is rotatably disposed around the outer periphery of the stepped portion 142A of the camshaft 142. The input gear member 148 is fixed to the driven sprocket 141 with bolts, and rotates integrally with the driven sprocket 141 around the outer periphery of the stepped portion 142A of the camshaft 142.

Moreover, the input gear member 148 has an internal gear 148A. The internal gear 148A projecting radially inwardly is disposed on a further side from the stepped portion 142A, and acts as a first gear. The cylindrical drum 148B is disposed around the stepped portion 142A. Moreover, the drum 148B has a plurality of oil passages 148C extending radially diagonally. The oil passages 148C communicate with the oil passages 146A, 146B and 146C of the camshaft 142. Each of the oil passages 148C supplies the oil to a clearance between the drum 148B and the first spring clutch 156.

The output gear member 149 acts as a second rotary member of the sun-and-planet gear set 147. The output gear member 149 is formed into a ring shape having a cross section shaped into a right-angled "U." The output gear member 149 has in the vicinity of the stepped shaft 142A a thick portion that is thicker than the other portion of the output gear member 149. The output gear member 149 is tightened, using a bolt 150, at a head end of the stepped portion 142A of the camshaft 142, and rotates integrally with the camshaft 142. Moreover, the output gear member 149 has an internal gear 149A. The internal gear 149A facing radially inwardly is disposed on a further side from the head end of the stepped portion 142A, and acts as a second gear. The internal gear 149A of the output gear member 149 has substantially the same number of teeth as that of the internal gear 148A of the input gear member 148.

Moreover, the output gear member 149 has a plurality of oil passages 149B extending radially diagonally from the inside to the outside. The oil passages 149B communicate with the oil passages 146A, 146B and 146C of the camshaft 142. Each of the oil passages 149B supplies the oil from the oil passages 146A, 146B and 146C to an clearance between the internal gear 149A and the second planet gear 154.

The carrier 151 acts as a third rotary member of the sun-and-planet gear set 147. The carrier 151 has a constitution substantially the same as that of the carrier 8 in the first embodiment. Around an outer periphery of the carrier 151, there is formed a disk 151A integrally with the carrier 151. Moreover, the carrier 151 has a clutch groove 151B having a ring-like shape. Stepped cylindrical drums 151C and 151D define an inner periphery of the clutch groove 151B.

The drum 151C has smaller diameter than that of the drum 151D. The first spring clutch 156 is wound around the drum 151C, while the second spring clutch 157 is wound around the drum 151D. Moreover, the carrier 151 has a pair of oil passages 151E extending radially. The oil passages 151E communicate with the oil passages 146A, 146B and 146C of the camshaft 142, and supply the oil to sliding faces of a pair of planet shafts 152 respectively.

The carrier 151 is rotatably disposed around the outer periphery of the stepped portion 142A of the camshaft 142. As is seen in FIGS. 26 and 28, the pair of planet shafts 152 are rotatably installed to the carrier 151, and disposed around the outer periphery of the stepped portion 142A. Each of the planet shafts 152 has first and second ends projecting from the carrier 151. The first end of the planet shaft 152 is integrated with the first planet gears 153. The second end of the planet shaft 152 is integrated with the second planet gears 154.

The first planet gears 153 mesh with the internal gear 148A of the input gear member 148, and transmit a rotational torque from the driven sprocket 141 to the planet shafts 152. The second planet gears 154 mesh with the internal gear 149A of the output gear member 149, and transmit the rotational torque from the planet shaft 152 to the output gear member 149 (camshaft 142).

Moreover, the second planet gears 154 are larger in the number of teeth than the first planet gears 153. The difference in the number of teeth between the first and second planet gears 153 and 154 causes an increased speed as follows: When a solenoid brake 155 brakes the rotation of the carrier 151, the output gear member 149 is allowed to rotate faster than the input gear member 148 (driven sprocket 141) by speed difference corresponding to the difference in the number of teeth between the first and second planet gears 153 and 154.

The solenoid brake 155 is fixed to the support frame 12, and acts as a rotational speed adjuster. Like the solenoid brake 13 according to the first embodiment, the solenoid brake 155 has a brake control coil 155A and a pair of dampers 155B.

Figure 29:
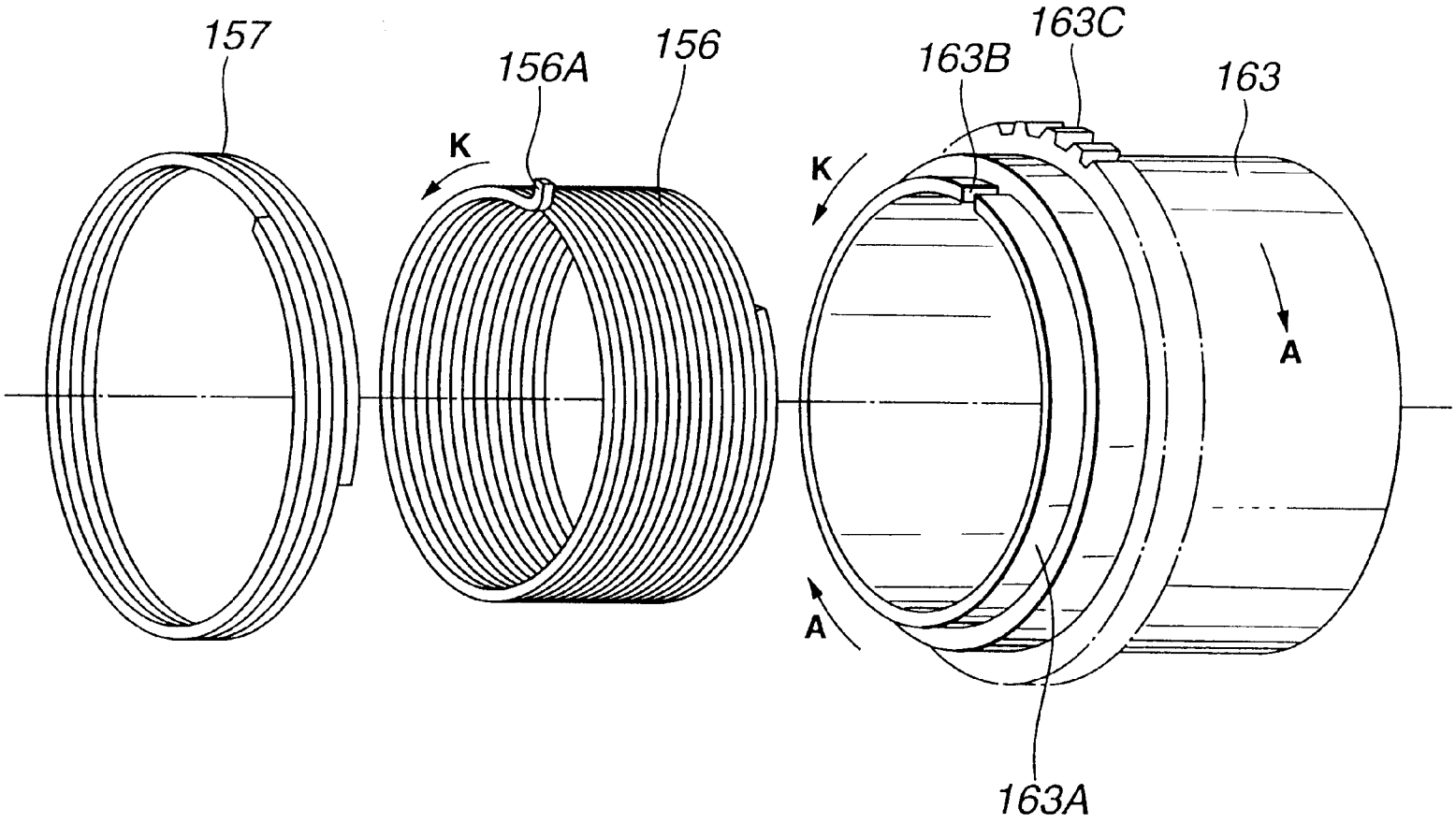
FIG. 29 is an exploded perspective view of first and second spring clutches and an inner cylinder in FIG. 26.
Figure 30:
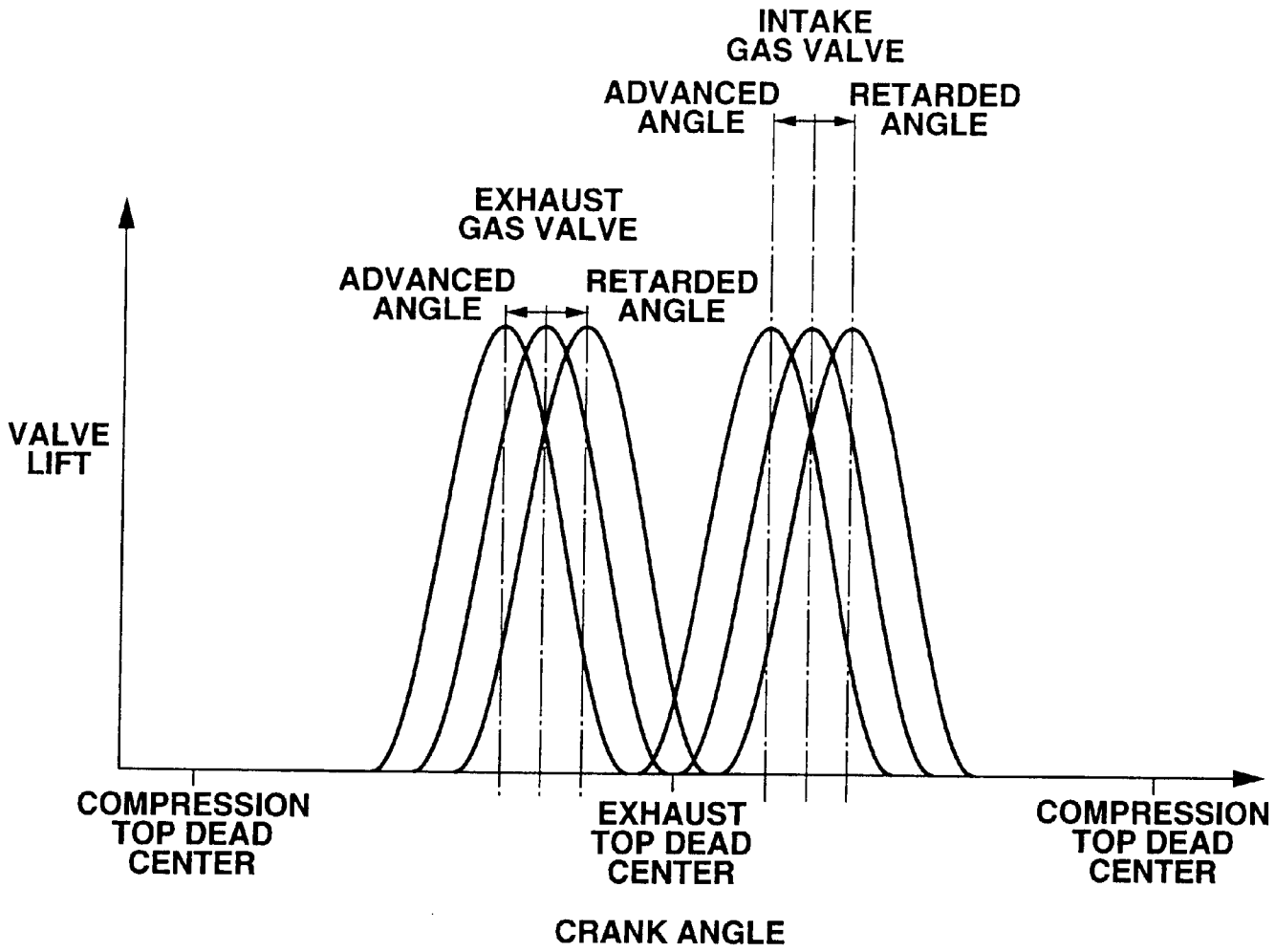
FIG. 30 is a graph showing characteristic curves of an exhaust valve and an intake valve in opening and closed conditions.

The first spring clutch 156 is wound around the drum 151C of the carrier 151, the ring drum 143 of the camshaft 142 and the drum 148B of the input gear member 148. As is seen in FIG. 29, the first spring clutch 156 is a left handed coil. The first spring clutch 156 has a first side wound around the outer periphery of the drum 151C of the carrier 151, a middle portion wound around the outer periphery of the ring drum 143 of the camshaft 142, and a second side wound around the outer periphery of the drum 148B of the input gear member 148.

As is seen in FIGS. 28 and 29, the first spring clutch 156 has, on the first side thereof, a hook 156A projecting radially outwardly. The hook 156A is hooked by a cutout 163B of an inner cylinder 163 in the clutch groove 151B of the carrier 151. When the inner cylinder 163 rotates in a direction K in FIG. 29, the hook 156A of the first spring clutch 156 is pushed in the direction K, to thereby increase the coil diameter of the first spring clutch 156. With this, the first spring clutch 156 allows the carrier 151 to be released from the ring drum 143 (camshaft 142). As a result, the carrier 151 and the ring drum 143 can rotate relative to each other.

Figure 27:
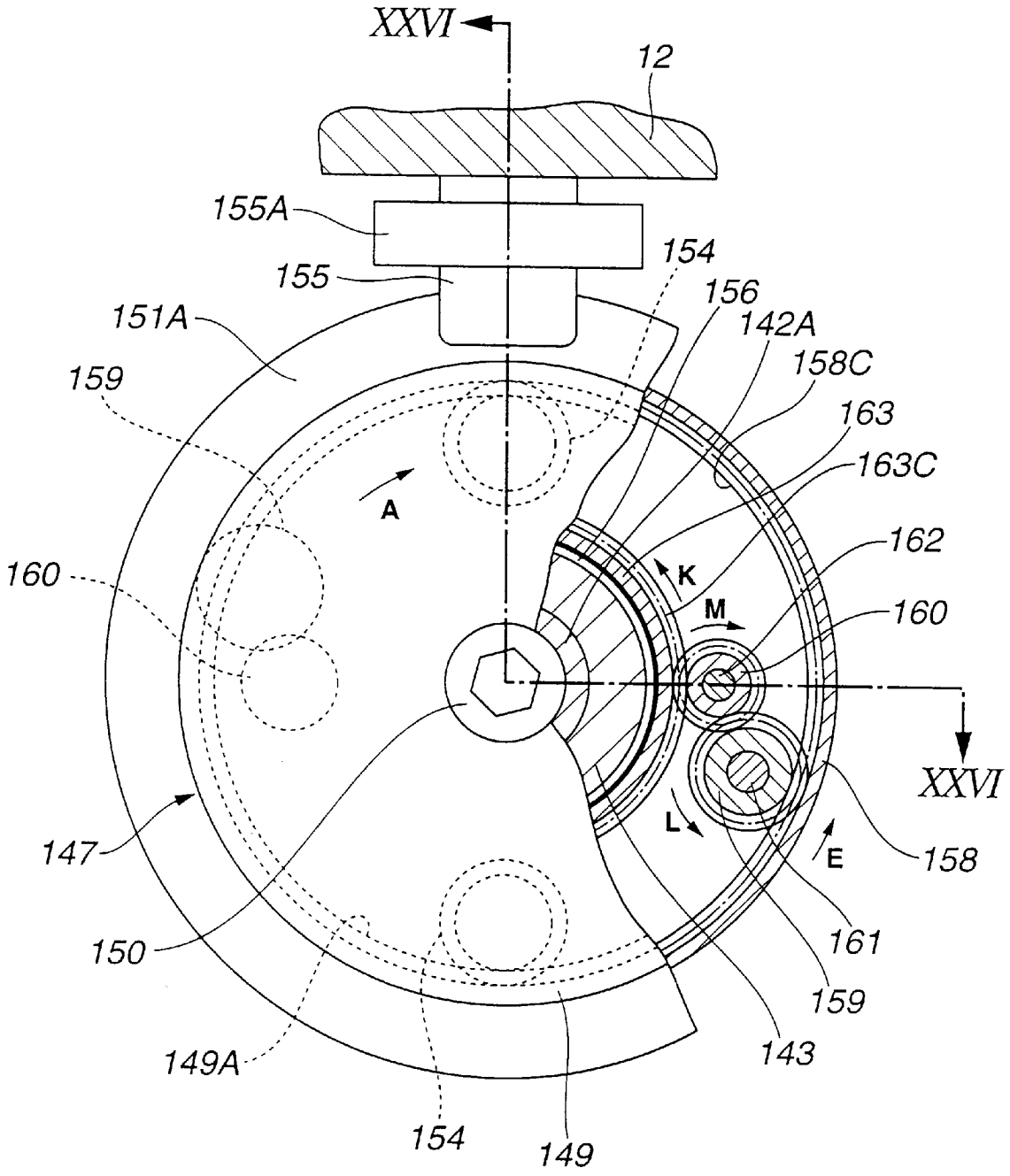
FIG. 27 is a partly cross-sectional side view of the valve timing control system in FIG. 26.

When the input gear member 148 rotates integrally with the driven sprocket 141 in the clockwise direction in FIG. 27, the first spring clutch 156 of the left handed coil receives a torsional torque in a direction to increase its coil diameter under a torque condition satisfying the following Expression (23):

$$\text{Angular velocity of driven sprocket } \mathbf{141} > \text{Angular velocity of camshaft } \mathbf{142} \quad (23)$$

The first spring clutch 156 is, therefore, slightly spaced apart from an outer surface of the drum 148B, to thereby allow the drum 148B of the input gear member 148 to be released from the ring drum 143 of the camshaft 142. As a result, the drum 148B and the ring drum 143 rotate relative to each other.

Contrary to this, when the carrier 151 rotates in a direction to be advanced in respect of the rotational phase relative to the ring drum 143 of the camshaft 142, the first spring clutch 156 receives a torsional torque in a direction to reduce its coil diameter under a torque condition satisfying the following Expression (24):

$$\text{Angular velocity of carrier } \mathbf{151} \geqq \text{Angular velocity of ring drum } \mathbf{143} \quad (24)$$

With this, the first spring clutch 156 firmly winds around an area between the drum 151C of the carrier 151 and the ring drum 143, to thereby hold stationary the connection between the drum 151C and the ring drum 143.

That is, the first spring clutch 156 acts as a one-way clutch between the carrier 151 and the camshaft 142. Thereby, the first spring clutch 156 prevents the carrier 151 from making a rotation in the clockwise direction in FIG. 27 relative to the camshaft 142, and allows the carrier to make a rotation in the counter-clockwise direction in FIG. 27 relative to the camshaft 142.

The second spring clutch 157 is disposed in the clutch groove 151B of the carrier 151. The second spring clutch 157 has a first side wound around an outer periphery of the drum 151D of the carrier 151, and a second side wound around a reduced diameter drum 163A of the inner cylinder 163.

The second spring clutch 157 is a right handed coil, and acts as a releasing means for releasing the first spring clutch 156. That is, when the solenoid brake 155 applies a braking force to the carrier 151, the rotational speed of the carrier 151 becomes lower than that of the camshaft 142 so as to rotate the carrier 151 in the counter-clockwise direction (direction E) in FIG. 27 relative to the camshaft 142. With this, the second spring clutch 157 receives a torsional torque in a direction to increase its coil diameter under a torque condition satisfying the following Expression (25 ):

$$\text{Angular velocity of inner cylinder } \mathbf{163} \geqq \text{Angular velocity of carrier } \mathbf{151} \quad (25)$$

With this, the second spring clutch 157 winds around the drum 151D of the carrier 151 and the inner cylinder 163, to thereby hold stationary the drum 151D and the inner cylinder 163.

Thereby, the inner cylinder 163 rotates in the direction same as that of the carrier 151 (direction K in FIG. 29) via the second spring clutch 157. With this, the hook 156A of the first spring clutch 156 is pushed toward the direction K, and therefore, the first spring clutch 156 releases the holding condition between the carrier 151 and the ring drum 143 (camshaft 142).

An outer cylinder 158 is a first gear member rotatably disposed around an outer periphery of the input gear member 148. The outer cylinder 158, a pair of first intermediate gears 159, a pair of second intermediate gears 160, the inner cylinder 163 and a clutch releasing device 164 constitute clutch releasing means.

Like the clutch control disk 15 according to the first embodiment, the outer cylinder 158 has a circular disk 158A, and a cylinder 158B extending axially from the inner periphery of the disk 158A. The cylinder 158B is mated with an outer periphery of the input gear member 148 in such a manner as to have a play therebetween. Around an inner periphery at an end of the cylinder 158B, there is provided an internal gear 158C between the input gear member 148 and the carrier 151. As is seen in FIG. 27, the internal gear 158C meshes with the first intermediate gear 159.

The first and second intermediate gears 159 and 160 are disposed between the outer cylinder 158 and the inner cylinder 163. As is seen in FIGS. 27 and 28, the first and second intermediate gears 159 and 160 are rotatably mounted on the carrier 151 via first and second support pins 161 and 162 respectively. The first and second intermediate gears 159 and 160 mesh each other. The first intermediate gears 159 mesh with the internal gear 158C of the outer cylinder 158 while the second intermediate gears 160 mesh with an external gear 163C of the inner cylinder 163.

The inner cylinder 163 is a second gear member rotatably mounted around the outer periphery of the first spring clutch 156. The inner cylinder 163 forms a cylindrical body with a thin wall, and has a diameter a little larger than that of the first spring clutch 156. The inner cylinder 163 acts as a retarded angle control drum for controlling the holding operation of the first spring clutch 156. As is seen in FIG. 29, the inner cylinder 163 has, on a first side thereof, the drum 163A having a cutout 163B to be hooked by the hook 156A of the first spring clutch 156.

The second spring clutch 157 is wound around the outer periphery of the drum 163A of the inner cylinder 163 and the drum 151D of the carrier 151. The second spring clutch 157 allows the inner cylinder 163 to be held stationary to the drum 151D of the carrier 151 and released from the drum 151D. Moreover, around an outer periphery of the inner cylinder 163, there is provided the external gear 163C meshing with the second intermediate gears 160. The inner cylinder 163 and the outer cylinder 158 rotate in the same direction via the first and second intermediate gears 159 and 60.

To be more specific, when the clutch releasing device 164 does not apply a braking force to the outer cylinder 158 and when the rotational phase holding condition is maintained, the inner cylinder 163 rotates integrally with the first spring clutch 156 via the hook 156A in the clockwise direction in FIG. 27. The rotation of the inner cylinder 163 is transmitted to the outer cylinder 158 via the second and first intermediate gears 160 and 159. As a result, the outer cylinder 158 also rotates in the clockwise direction (direction A in FIG. 27).

Once the clutch releasing device 164 applies the braking force to the outer cylinder 158, the outer cylinder 158 receives a torque in the counter-clockwise direction in FIG. 27. With this, the outer cylinder 158 makes a rotation relative to the carrier 151 in the direction E in FIG. 27. With this, the first intermediate gear 159 rotates on the first support pin 161 in a direction L, to thereby rotate the second intermediate gear 160 on the second support pin 162 in a direction M. As a result, the rotational force of the second intermediate gear 160 is transmitted to the inner cylinder 163 as a rotational force in the direction K.

Thereby, the cutout 163B of the inner cylinder 163 allows the hook 156A of the first spring clutch 156 to make a movement relative to the other portion of the first spring clutch 156 in the counter-clockwise direction (direction K in FIG. 29). With this, the first spring clutch 156 in the vicinity of the hook 156A is slightly spaced apart from the outer surface of the drum 151C of the carrier 151, to thereby allow the drum 151C to be released from the ring drum 143. As a result, the carrier 151 can rotate independently of the ring drum 143, to thereby achieve the retarded angle control.

The clutch releasing device 164 is fixed to the support frame 12. The clutch releasing device 164, the outer cylinder 158, the first and second intermediate gears 159 and 160, and the inner cylinder 163 constitute clutch releasing means. Like the clutch releasing device 16 according to the first embodiment, the clutch releasing device 67 has a clutch control coil 164A.

The seventh embodiment ensures operations and advantages substantially the same as those of the first embodiment. Disclosed below are specifics about the operations and the advantages of the seventh embodiment of the present invention.

At first, when the brake control coil 155A of the solenoid brake 155 is demagnetized as is seen in Table 7, and when the driven sprocket 141 rotates in the clockwise direction in FIG. 27, the rotational force of the driven sprocket 141 is transmitted from the internal gear 148A of the input gear member 148 to the first planet gear 153. Therefore, the first planet gears 153 rotate on the planet shafts 152 and revolve around the cam shaft 142. The revolving force of the first planet gear 153 is transmitted to the carrier 151 as a rotational torque.

In this condition, the first spring clutch 156 receives the torsional torque in the direction to increase its coil diameter under the torque condition satisfying Expression (23). The first spring clutch 156 is, therefore, slightly spaced apart from the outer surface of the drum 148B of the input gear member 148. Thereby, the first spring clutch 156 allows the input gear member 148 and the ring drum 143 (camshaft 142) to rotate relative to each other.

However, when the revolving force from the first planet gear 153 is transmitted to the carrier 151, the carrier 151 begins to rotate in the clockwise direction in FIG. 27. Then, the rotational force of the carrier 151 is transmitted to the first spring clutch 156 as the torsional torque in the direction to decrease the coil diameter of the first spring clutch 156 under the torque condition satisfying Expression (24). With this, the first spring clutch 156 firmly winds around the ring drum 143 of the camshaft 142, to thereby hold stationary the area between the carrier 151 and the camshaft 142.

The first spring clutch 156 acts as a one-way clutch between the camshaft 142 and the carrier 151. With this, the first spring clutch 156 prevents the carrier 151 from making a rotation in the clockwise direction in FIG. 27 relative to the camshaft 142. Until the camshaft 142 starts rotating, the first and second planet gears 153 and 154 make rotations only on the planet shafts 152 without making revolutions around the camshaft 142. Therefore, the rotational force of the second planet gear 154 is transmitted to the output gear member 149 via the internal gear 149A.

The second planet gears 154 are larger in the number of teeth than the first planet gear 153. Therefore, the second planet gears 154 rotates the output gear member 149 faster than the first planet gears 153 rotate the input gear member 148 by a speed difference corresponding to the difference in the number of teeth. With this, the camshaft 142 rotates integrally with the output gear member 149 in the clockwise direction due to the first spring clutch 156. If the rotation of the camshaft 142 is even a little faster than that of the driven sprocket 141, the first spring clutch 156 receives the torsional torque in the direction to reduce its coil diameter under the torque condition satisfying the following Expression (26):

$$\text{Angular velocity of camshaft } \mathbf{142} \geqq \text{Angular velocity of driven sprocket } \mathbf{141} \quad (26)$$

With this, the first spring clutch 156 firmly winds around the ring drum 143 and the drum 148B, to thereby hold stationary the ring drum 143 and the drum 148B. As a result, the rotational force of the driven sprocket 141 is transmitted to the camshaft 142 via the sun-and-planet gear set 147 and the first spring clutch 156. During this period, the camshaft 142 rotates while keeping its rotational phase relative to the driven sprocket 141 (phase holding control).

TABLE 7

| | Phase holding control | Retarded angle control | Advanced angle control |
|---|---|---|---|
| Solenoid brake 155 | Inoperative (Demagnctized) | Inoperative (Demagnetized) | Operative (Magnetized) |
| Clutch releasing device 164 | Inoperative (Demagnetized) | Operative (Magnetized) | Inoperative (Demagnetized) |
| First spring clutch 156 | Held | Released | Released |
| Second spring clutch 157 | Held | Released | Held |

In this condition, the internal gear 148A mesh with the first planet gears 153 while the internal gear 149A mesh with the second planet gears 154. Tooth faces of the internal gear 148A and 149A keep contacting, respectively, those of the first and second planet gears 153 and 154. Also the first spring clutch 156 keeps the stationary holding condition Thereby, even when the alternating torque (between positive and negative) shown in FIG. 31 is applied to the camshaft 142, the first spring clutch 156 keeps the stationary holding condition. That is, this arrangement preferably prevents problems caused by the backlash, and suppresses any hammering noise between the tooth faces which noise may be caused when the alternating torque is applied.

Next, when the clutch control coil 164A of the clutch releasing device 164 is operated as is seen in Table 7 under this phase holding condition in order to apply a braking force to the disk 158A of the outer cylinder 158, the outer cylinder 158 receives a braking torque in the counter-clockwise direction in FIG. 27, to thereby make a movement relative to the carrier 151 in the direction E in FIG. 27. With this, the first intermediate gear 159 rotates in the direction L while the second intermediate gear 160 rotates in the direction M. As a result, the inner cylinder 163 makes a movement relative to the carrier 151 in the direction K (counter-clockwise).

With this, the cutout 163B of the inner cylinder 163 allows the hook 156A of the first spring clutch 156 to make a movement relative to the other portion of the first spring clutch 156 in the counter-clockwise direction (direction K in FIG. 29). The first spring clutch 156 in the vicinity of the hook 156A is, therefore, slightly spaced apart from the outer surface of the drum 151C of the carrier 151.

Accordingly, the first spring clutch 156 allows the drum 151C of the carrier 151 to be released from the ring drum 143. As a result, the drum 151C and the ring drum 143 can rotate relative to each other. This enables the torque transmission to be shut off between the drum 151C of the carrier 151, the ring drum 143 and the drum 148B of the input gear member 148.

As a result, the carrier 151 rotates freely in the clockwise direction due to the rotational force of the driven sprocket 141. The first planet gears 153 rotate on the planet shafts 152, and revolve along the internal gear 148A of the input gear member 148. The second planet gears 154 rotate, and revolve along the internal gear 149A of the output gear member 149. The second spring clutch 157 in the clutch groove 151B of the carrier 121 is a right handed coil. Therefore, as the carrier 151 rotates in the clockwise direction in FIG. 27 relative to the camshaft 142, the second spring clutch 157 increases its coil diameter. With this, the second spring clutch 157 is spaced apart from the outer periphery of the drum 151D, thus causing no holding forces between the driven sprocket 141 and the camshaft 142 (ring drum 143).

With this, when the clutch releasing device 164 is put in an operative state, the rotational torque from the driven sprocket 141 is not transmitted to the camshaft 142 via the sun-and-planet gear set 147, and via the first and second spring clutches 156 and 157. With this, the camshaft 142 is retarded in respect of the rotational phase relative to the driven sprocket 141. That is, the clutch releasing device 164 firmly executes the releasing of the first spring clutch 156 regardless of the engine speed.

Next, when the clutch releasing device 164 is put in an inoperative state, the braking force is not applied to the outer cylinder 158, to thereby allow the inner cylinder 163 to rotate in the clockwise direction in FIG. 27. With this, the first spring clutch 156 winds around the outer surface of the drum 151C in accordance with the rotation of the carrier 151 in the clockwise direction, to thereby hold stationary again the connection between the carrier 151, the ring drum 143 and the input gear member 148. With this, there occurs a recovery of torque transmission between the carrier 151, the ring drum 143 and the input gear member 148, to thereby achieve the automatic recovery of the phase holding control.

Next, when the brake control coil 155A of the solenoid brake 155 is magnetized as is seen in Table 7 to thereby apply the rotational torque (braking force) to the carrier 151 in the counter-clockwise direction in FIG. 27, the second spring clutch 157 receives a torque in the direction to reduce its coil diameter under the torque condition satisfying Expression (25). Therefore, the second spring clutch 157 winds around the drum 151D of the carrier 151 and the inner cylinder 163.

In this condition, when the inner cylinder 163 rotates in the direction of the carrier 151 (direction K in FIG. 29) via the second spring clutch 157, the hook 156A is pushed toward the direction K, to thereby allow the first spring clutch 156 to rotate in a direction to increase its coil diameter. Therefore, the holding condition is released between the carrier 151, the ring drum 143 (camshaft 142) and the first spring clutch 156.

When the braking force is applied to the carrier 151 from the solenoid brake 155, the carrier 151 decreases its rotational speed as compared with that of the input gear member 148 as if the carrier 151 rotates in the counter-clockwise direction in FIG. 27 relative to the input gear member 148. The second planet gears 154 are larger in the number of teeth than the first planet gears 153. Therefore, the output gear member 149 (camshaft 142) rotates faster than the input gear member 148 by the speed difference corresponding to the tooth difference between the first and second planet gears 153 and 154. With this, the camshaft 142 is advanced in respect of the rotational phase relative to the driven sprocket 141. Therefore, canceling the operation of the solenoid brake 155 achieves the automatic recovery of the phase holding control.

Although the third embodiment according to the present invention has been shown and described such that the input gear member 57 and the output gear member 58, respectively, have the internal gears 57A and 58A, the present invention is not limited to this, and may be arranged to employ an external gear as is similar to that in the first, second and fourth embodiments. This also may be applied to the sixth and seventh embodiments. Further, the external gears employed in the first, second and fourth embodiments may be replaced with the internal gears.

Although the fifth embodiment according to the present invention has been shown and described such that the external gear 99A is disposed on the sun gear 99 which is the second rotary member of the sun-and-planet gear set 96 while the internal gear 100A is disposed on the output gear member 100 which is the third rotary member of the sun-and-planet gear set 96, the present invention is not limited to this, and may be arranged to employ an internal gear to be disposed on the second rotary member and an external gear to be disposed on the third rotary member.

The entire contents of basic Japanese Patent Application No. 11(1999)-286123, filed Oct. 6, 1999 of which the priority is claimed are herein incorporated by reference.

What is claimed is:

1. A valve timing control system for an internal combustion engine, comprising:

a rotor rotated by a crankshaft of the internal combustion engine;

a camshaft rotated according to the rotation of the rotor to open and close an intake valve and an exhaust valve of the internal combustion engine; and a rotational phase controller for variably controlling a rotational phase of the camshaft relative to the rotor, the rotational phase controller being disposed between the rotor and the camshaft, the rotational phase controller comprising:

a clutch selectably put in one of a holding state for forbidding a relative rotation between the rotor and the camshaft in at least one of rotational directions and a releasing state for allowing the relative rotation; and a generator for generating a holding torque directing to the rotational direction forbidden by the clutch and applying the holding torque to the clutch when the clutch is put in the holding state.

2. The valve timing control system as claimed in claim 1, in which the holding torque generated by the generator is greater than a rotational reactive torque applied from the intake and exhaust valves to the camshaft.

3. The valve timing control system as claimed in claim 1, in which the clutch includes a spring clutch wound around the rotor and the camshaft.

4. The valve timing control system as claimed in claim 1, in which the generator includes a speed change gear disposed between the rotor and the camshaft.

5. The valve timing control system as claimed in claim 4, in which the speed change gear includes a sun-and-planet gear set.

6. The valve timing control system as claimed in claim 5, in which the sun-and-planet gear set comprises:

a first rotary member rotatable integrally with the rotor;

a first gear disposed on the first rotary member;

a second rotary member disposed on the camshaft, and rotatable integrally with the camshaft;

a second gear disposed on the camshaft, and rotatable integrally with the second rotary member;

a planet shaft having a first end and a second end;

a first planet gear disposed at the first end of the planet shaft, and meshing with the first gear of the first rotary member;

a second planet gear disposed at the second end of the planet shaft, and meshing with the second gear of the camshaft;

a third rotary member disposed between the first planet gear and the second planet gear in such a manner as to rotatably support the first planet gear and the second planet gear via the planet shaft, the third rotary member rotating relative to the first rotary member and the second rotary member; and a rotational speed adjuster for adjusting a rotational speed of the third rotary member so as to variably control a rotational phase of the camshaft relative to the rotor for an increased rotational speed and a decreased rotational speed, and in which the clutch is disposed around the first rotary member and the second rotary member such that the clutch receives, as the holding torque, an accelerating force and a decelerating force caused between the first rotary member and the second rotary member.

7. The valve timing control system as claimed in claim 6, in which the second planet gear is larger in the number of teeth than the first planet gear, and in which the second rotary member rotates at the decreased rotational speed relative to the first rotary member in a same direction as the first rotary member when the third rotary member rotates substantially free of a load from the rotational speed adjuster, and the second rotary member is held to the first rotary member or rotates at the increased rotational speed relative to the first rotary member in the same direction as the first rotary member when the clutch is put in the releasing state and when the third rotary member receives the load from the rotational speed adjuster.

8. The valve timing control system as claimed in claim 4, in which the speed change gear has a plurality of gears having the different number of teeth, and in which the clutch receives as the holding torque a tightening torque caused by the difference in the number of teeth between each of the gears.

9. The valve timing control system as claimed in claim 8, in which a rotation transmitting section including a plurality of gears is provided between the rotor and the camshaft and transmits the rotational torque from the rotor to the camshaft, the clutch including a first spring clutch wound around the rotor and the camshaft and a second spring clutch wound around a rotation transmitting section and the camshaft, the first spring clutch and the second spring clutch being released, independent of each other, from the holding state.

10. The valve timing control system as claimed in claim 8, in which a biasing means is provided between the rotor and the camshaft and causes a biasing force in a direction to reduce a difference in the rotational phases between the rotor and the camshaft.

11. The valve timing control system as claimed in claim 5, in which the sun-and-planet gear set comprises:

a first rotary member having the first gear, and rotatable integrally with the rotor;

a second rotary member having the second gear, and rotatable relative to the camshaft;

a planet shaft having the first end and the second end;

a first planet gear disposed at the first end of the planet shaft, and meshing with the first gear;

a second planet gear disposed at the second end of the planet shaft, and meshing with the second gear;

a third rotary member disposed between the first planet gear and the second planet gear in such a manner as to rotatably support the first planet gear and the second planet gear via the planet shaft, the third rotary member rotating relative to the first rotary member and the second rotary member; and a rotational speed adjuster for adjusting the rotational speed of the third rotary member so as to variably control a rotational phase of the camshaft relative to the rotor for the increased rotational speed and the decreased rotational speed;

a one-way clutch disposed between the third rotary member and the camshaft, the one-way clutch preventing the third rotary member from rotating in a first direction relative to the camshaft and allowing the third rotary member to rotate in a second direction opposite to the first direction relative to the camshaft, and in which the clutch comprises:

a first spring clutch wound around the first rotary member and the camshaft, the first spring clutch receiving, as the holding torque, one of an accelerating force and a decelerating force caused between the first rotary member and the camshaft, the first spring clutch having a first clutch releasing means for releasing the holding condition of the first spring clutch with an external signal applied to the first clutch releasing means, the first spring clutch independently releasing the holding condition; and a second spring clutch wound around the second rotary member and the camshaft, the second spring clutch receiving, as the holding torque, one of an accelerating force and a decelerating force caused between the second rotary member and the camshaft, the second spring clutch having a second clutch releasing means for releasing the holding condition of the second spring clutch with the external signal applied to the second clutch releasing means, the second spring clutch releasing the holding condition of the second spring clutch independently of the releasing operation of the first spring clutch.

12. The valve timing control system as claimed in claim 11, in which the second planet gear is larger in the number of teeth than the first planet gear, and in which the camshaft rotates at the decreased rotational speed relative to the rotor in a same direction as the rotor when the third rotary member rotates substantially free of the load from the rotational speed adjuster and when the second clutch releasing means releases the second spring clutch, and the camshaft rotates at the increased rotational speed relative to the rotor in the same direction as the rotor when the third rotary member receives the load from the rotational speed adjuster and when the first clutch releasing means releases the first spring clutch.

13. The valve timing control system as claimed in claim 5, in which the sun-and-planet gear set comprises:

a first rotary member having the first gear, and rotatable integrally with the rotor;

a second rotary member having the second gear, and rotatable relative to the camshaft;

a planet shaft having a first end and a second end;

a first planet gear disposed at the first end of the planet shaft and meshing with the first gear;

a second planet gear disposed at the second end of the planet shaft and meshing with the second gear;

a third rotary member disposed between the first planet gear and the second planet gear in such a manner as to rotatably support the first planet gear and the second planet gear via the planet shaft, the third rotary member rotating relative to the first rotary member and the second rotary member; and a rotational speed adjuster for adjusting a rotational speed of the third rotary member so as to variably control a rotational phase of the camshaft relative to the rotor for an increased rotational speed and an decreased rotational speed, and in which the clutch comprises:

a first spring clutch wound around. the first rotary member, the camshaft and the third rotary member, the first spring clutch preventing the third rotary member from rotating in the first direction relative to the camshaft and allowing the third rotary member to rotate in the second direction opposite to the first direction relative to the camshaft, the first spring clutch receiving, as the holding torque, one of an accelerating force and a decelerating force caused between the first rotary member and the camshaft; and a second spring clutch wound around the second rotary member and the camshaft, the second spring clutch receiving, as the holding torque, one of an accelerating force and a decelerating force caused between the second rotary member and the camshaft, the second spring clutch having the clutch releasing means for releasing the holding condition of the second spring clutch with an external signal applied to the clutch releasing means.

14. The valve timing control system as claimed in claim 13, in which the second planet gear is larger in the number of teeth than the first planet gear, and in which the camshaft rotates at the decreased rotational speed relative to the rotor in the same direction as the rotor when the third rotary member rotates substantially free of the load from the rotational speed adjuster and when the clutch releasing means releases the second spring clutch, and the camshaft rotates at the increased rotational speed relative to the rotor in the same direction as the rotor when the third rotary member receives the load from the rotational speed adjuster.

15. The valve timing control system for as claimed in claim 5, in which the sun-and-planet gear set comprises:

a planet gear;

a first rotary member rotatably supporting the planet gear, and rotatable integrally with the rotor;

a second rotary member having a first gear, and rotatable relative to the camshaft, the first gear meshing with the planet gear;

a third rotary member disposed in such a manner as to rotate relative to the first rotary member and the second rotary member, the third rotary member having the second gear meshing with the planet gear; and a rotational speed adjuster for adjusting the rotational speed of the third rotary member so as to variably control a rotational phase of the camshaft relative to the rotor for an increased rotational speed and a decreased rotational speed, and in which the clutch comprises:

a first spring clutch wound around the first rotary member, the camshaft and the third rotary member, the first spring clutch preventing the third rotary member from rotating in a first direction relative to the camshaft and allowing the third rotary member to rotate in a second direction opposite to the first direction relative to the camshaft, the first spring clutch receiving, as the holding torque, an accelerating force and a decelerating force caused between the first rotary member and the camshaft; and a second spring clutch wound around the second rotary member and the camshaft, the second spring clutch receiving, as the holding torque, an accelerating force and a decelerating force caused between the second rotary member and the camshaft, the second spring clutch having a clutch releasing means for releasing the holding condition of the second spring clutch with an external signal applied to the clutch releasing means.

16. The valve timing control system as claimed in claim 15, in which the first gear is an external gear and the second gear is an internal gear, each of the external and internal gears meshing with the planet gear, and in which the camshaft rotates at the decreased rotational speed relative to the rotor in the same direction as the rotor when the third rotary member rotates substantially free of the load from the rotational speed adjuster and the clutch releasing means releases the second spring clutch, and the camshaft rotates at the increased rotational speed relative to the rotor in the same direction as the rotor when the third rotary member receives the load from the rotational speed adjuster to thereby release the first spring clutch.

17. The valve timing control system as claimed in claim 5, in which the sun-and-planet gear set comprises:

a first rotary member having a first gear, and rotatable integrally with the rotor;

a second rotary member having a second gear, and rotatable integrally with the camshaft;

a planet shaft having a first end and a second end;

a first planet gear disposed at the first end of the planet shaft and meshing with the first gear;

a second planet gear disposed at the second end of the planet shaft and meshing with the second gear;

a third rotary member disposed between the first planet gear and the second planet gear in such a manner as to rotatably support the first planet gear and the second planet gear via the planet shaft, the third rotary member rotating relative to the first rotary member and the second rotary member; and a rotational speed adjuster for adjusting a rotational speed of the third rotary member so as to variably control a rotational phase of the camshaft relative to the rotor for an increased rotational speed and a decreased rotational speed, and in which the clutch comprises:

a first spring clutch wound around the first rotary member, the camshaft and the third rotary member, the first spring clutch preventing the third rotary member from rotating in a first direction relative to the camshaft and allowing the third rotary member to rotate in a second direction opposite to the first direction relative to the camshaft, the first spring clutch receiving, as the holding torque, an accelerating force and a decelerating force caused between the first rotary member and the camshaft, the first spring clutch having a clutch releasing means for releasing the holding condition of the first spring clutch with an external signal applied to the clutch releasing means; and a second spring clutch wound around an outer surface of the first spring clutch and disposed at the third rotary member, the second spring clutch releasing the holding torque of the first spring clutch when the third rotary member rotates in the second direction relative to the camshaft.

18. The valve timing control system for as claimed in claim 17, in which the second planet gear is larger in the number of teeth than the first planet gear, and in which the camshaft rotates at the decreased rotational speed relative to the rotor in the same direction as the rotor when the third rotary member rotates substantially free of the load from the rotational speed adjuster and the clutch releasing means releases the first spring clutch, and the camshaft rotates at the increased rotational speed relative to the rotor in the same direction as the rotor when the third rotary member receives the load from the rotational speed adjuster such that the second spring clutch releases the first spring clutch.

19. The valve timing control system as claimed in claim 17, in which the clutch releasing means comprises:

a clutch releasing cylinder disposed in the third rotary member, and driving the first spring clutch in a direction to increase a diameter of the first spring clutch with pressure oil supplied to the clutch releasing cylinder; and an oil control valve for controlling the pressure oil to be supplied to the clutch releasing cylinder and to be discharged from the clutch releasing cylinder.

20. The valve timing control system as claimed in claim 19, in which the oil control valve supplies the pressure oil to the clutch releasing cylinder and discharges the pressure oil from the clutch releasing cylinder, the pressure oil lubricating a sliding surface of the sun-and-planet gear set.

21. The valve timing control system as claimed in claim 19, in which the oil control valve comprises:

a spool slidably disposed in the camshaft so as to supply the pressure oil to the clutch releasing cylinder and discharge the pressure oil from the clutch releasing cylinder;

an electromagnetic actuator disposed outside the camshaft, the electromagnetic actuator driving the spool in accordance with the external signal; and a spring disposed inside the camshaft for biasing the spool toward the electromagnetic actuator, the spring and the electromagnetic actuator interposing therebetween the spool.

22. The valve timing control system for the internal combustion engine as claimed in claim 17, in which the clutch releasing means comprises:

a first intermediate gear and a second intermediate gear, the first and second intermediate gears meshing with each other;

a first gear member meshing with the first intermediate gear, and receiving a braking force with the external signal; and a second gear member meshing with the second intermediate gear, and applying the rotational torque to the first spring clutch for releasing the first spring clutch when the second gear member rotates in a direction opposite to a rotational direction of the third rotatable member.

* * * * *